US009557685B2

(12) United States Patent
Yamabe et al.

(10) Patent No.: US 9,557,685 B2
(45) Date of Patent: Jan. 31, 2017

(54) NOZZLE RECEIVER, POWDER CONTAINER, AND IMAGE FORMING APPARATUS

(71) Applicants: Junji Yamabe, Shizuoka (JP); Keiichi Yano, Shizuoka (JP); Michiharu Suzuki, Kanagawa (JP); Hideki Kimura, Kanagawa (JP); Hideki Zemba, Kanagawa (JP); Takahiro Ikuma, Kanagawa (JP); Seiji Terazawa, Shizuoka (JP)

(72) Inventors: Junji Yamabe, Shizuoka (JP); Keiichi Yano, Shizuoka (JP); Michiharu Suzuki, Kanagawa (JP); Hideki Kimura, Kanagawa (JP); Hideki Zemba, Kanagawa (JP); Takahiro Ikuma, Kanagawa (JP); Seiji Terazawa, Shizuoka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/896,852

(22) PCT Filed: Mar. 16, 2015

(86) PCT No.: PCT/JP2015/058643

§ 371 (c)(1),
(2) Date: Dec. 8, 2015

(87) PCT Pub. No.: WO2015/141861

PCT Pub. Date: Sep. 24, 2015

(65) Prior Publication Data

US 2016/0124346 A1 May 5, 2016

(30) Foreign Application Priority Data

Mar. 17, 2014 (JP) ..... 2014-053806
Jun. 11, 2014 (JP) ..... 2014-120636
Jul. 14, 2014 (JP) ..... 2014-144148

(51) Int. Cl.
*G03G 15/08* (2006.01)

(52) U.S. Cl.
CPC ..... *G03G 15/0879* (2013.01); *G03G 15/0886* (2013.01); *G03G 15/0898* (2013.01)

(58) Field of Classification Search
CPC ..... G03G 15/08
See application file for complete search history.

(56) References Cited

U.S. PATENT DOCUMENTS 6,678,492 B1 1/2004 Terazawa et al.
6,701,112 B2 3/2004 Kusano et al.
(Continued)

FOREIGN PATENT DOCUMENTS

CN 103488069 A 1/2014
JP 2003-316139 11/2003
(Continued)

OTHER PUBLICATIONS

International Search Report issued Jun. 9, 2015 in PCT/JP2015/058643 filed Mar. 16, 2015.
(Continued)

*Primary Examiner* — Clayton E Laballe
*Assistant Examiner* — Victor Verbitsky
(74) *Attorney, Agent, or Firm* — Oblon, McClelland, Maier & Neustadt, L.L.P.

(57) ABSTRACT

A nozzle receiver is to be arranged in a powder container used in an image forming apparatus. The nozzle receiver includes a nozzle receiving opening, in which a conveying nozzle for conveying powder supplied from the powder container is inserted in the image forming apparatus; an opening/closing member to open and to close the nozzle receiving opening; and a supporter to support the opening/
(Continued)

closing member. The opening/closing member includes a sealing portion to seal the nozzle insertion opening. The supporter includes an end surface portion perpendicular to a moving direction of the opening/closing member. The projection area of the end surface portion in the moving direction of the opening/closing member is smaller than a projection area of the sealing portion in the moving direction of the opening/closing member.

16 Claims, 47 Drawing Sheets

(56) References Cited

U.S. PATENT DOCUMENTS

| | | | | |
|---|---|---|---|---|
| 7,822,371 | B2 | 10/2010 | Taguchi et al. | |
| 2001/0017998 | A1 | 8/2001 | Terazawa et al. | |
| 2001/0031153 | A1* | 10/2001 | Sameshima | G03G 21/1817 399/111 |
| 2002/0114646 | A1* | 8/2002 | Sudo | G03G 15/0874 399/258 |
| 2003/0081969 | A1* | 5/2003 | Muramatsu | G03G 15/0874 399/258 |
| 2004/0223762 | A1 | 11/2004 | Lee et al. | |
| 2007/0147900 | A1* | 6/2007 | Taguchi | G03G 15/0855 399/258 |
| 2010/0129118 | A1 | 5/2010 | Kimura et al. | |
| 2011/0020039 | A1 | 1/2011 | Mitsuishi et al. | |
| 2012/0213555 | A1 | 8/2012 | Komatsu et al. | |
| 2012/0301188 | A1 | 11/2012 | Yamabe et al. | |
| 2012/0321341 | A1* | 12/2012 | Hori | G03G 15/0881 399/110 |
| 2013/0272750 | A1 | 10/2013 | Matsumoto et al. | |
| 2013/0330105 | A1 | 12/2013 | Komatsu et al. | |
| 2014/0029973 | A1 | 1/2014 | Terazawa et al. | |
| 2014/0064794 | A1 | 3/2014 | Takahashi et al. | |
| 2014/0212180 | A1 | 7/2014 | Kadota et al. | |
| 2014/0241757 | A1 | 8/2014 | Kikuchi et al. | |
| 2014/0270859 | A1 | 9/2014 | Hosokawa et al. | |
| 2014/0348551 | A1 | 11/2014 | Yamabe et al. | |

FOREIGN PATENT DOCUMENTS

| | | |
|---|---|---|
| JP | 2009-276659 | 11/2009 |
| JP | 2012-133349 | 7/2012 |
| JP | 2012-185474 | 9/2012 |
| JP | 2013-113945 | 6/2013 |
| JP | 2013-254170 | 12/2013 |
| JP | 2013-254181 | 12/2013 |
| JP | 2014-013371 | 1/2014 |
| JP | 2014-013372 | 1/2014 |
| WO | 2013/183782 | 12/2013 |
| WO | 2014/142362 | 9/2014 |

OTHER PUBLICATIONS

Combined Office Action and Search Report issued Aug. 31, 2016 in Taiwanese Patent Application No. 104108508 (with Partial English translation and English translation of Categories of Cited documents).

* cited by examiner

NOZZLE RECEIVER, POWDER CONTAINER, AND IMAGE FORMING APPARATUS

TECHNICAL FIELD

The present invention relates to a powder container for storing developer that is powder used in an image forming apparatus, such as a printer, a facsimile machine, a copier, or a multifunction peripheral with multiple functions of the printer, the facsimile machine, and the copier, a nozzle insertion member attached to the powder container, and an image forming apparatus including the powder container.

BACKGROUND ART

In electrophotography image forming apparatuses, a powder replenishing device supplies (replenishes) toner that is developer from a toner container serving as a powder container containing the developer that is powder to a developing device. A toner container described in Japanese Patent Application Laid-open No. 2012-133349 and Japanese Patent Application Laid-open No 2009-276659 includes a rotatable cylindrical powder storage, a nozzle receiver attached to the powder storage, an opening arranged on the nozzle receiver, and an opening/closing member that moves to a closing position at which the opening is closed and to an opening position at which the opening is opened along with insertion of the conveying nozzle of the powder replenishing device. When the opening/closing member is moved to the opening position by the conveying nozzle inserted in the toner container along with attachment of the toner container to the powder replenishing device, the opening/closing member moves toner located near the opening.

In the configuration as described above, if there is no escape for toner that moves with the movement of the opening/closing member, the toner is compressed and cohered, and prevents the opening/closing member from moving to the closing position when the toner container is detached from the powder container, for example.

It is an object of the present invention to cope with the abovementioned issues.

SUMMARY OF THE INVENTION

According to an embodiment, a nozzle receiver is to be arranged in a powder container used in an image forming apparatus. The nozzle receiver includes a nozzle receiving opening, in which a conveying nozzle for conveying powder supplied from the powder container is inserted in the image forming apparatus; an opening/closing member to open and to close the nozzle receiving opening; and a supporter to support the opening/closing member. The opening/closing member includes a sealing portion to seal the nozzle insertion opening. The supporter includes an end surface portion perpendicular to a moving direction of the opening/closing member. The projection area of the end surface portion in the moving direction of the opening/closing member is smaller than a projection area of the sealing portion in the moving direction of the opening/closing member.

DESCRIPTION OF EMBODIMENTS

Figure 1:
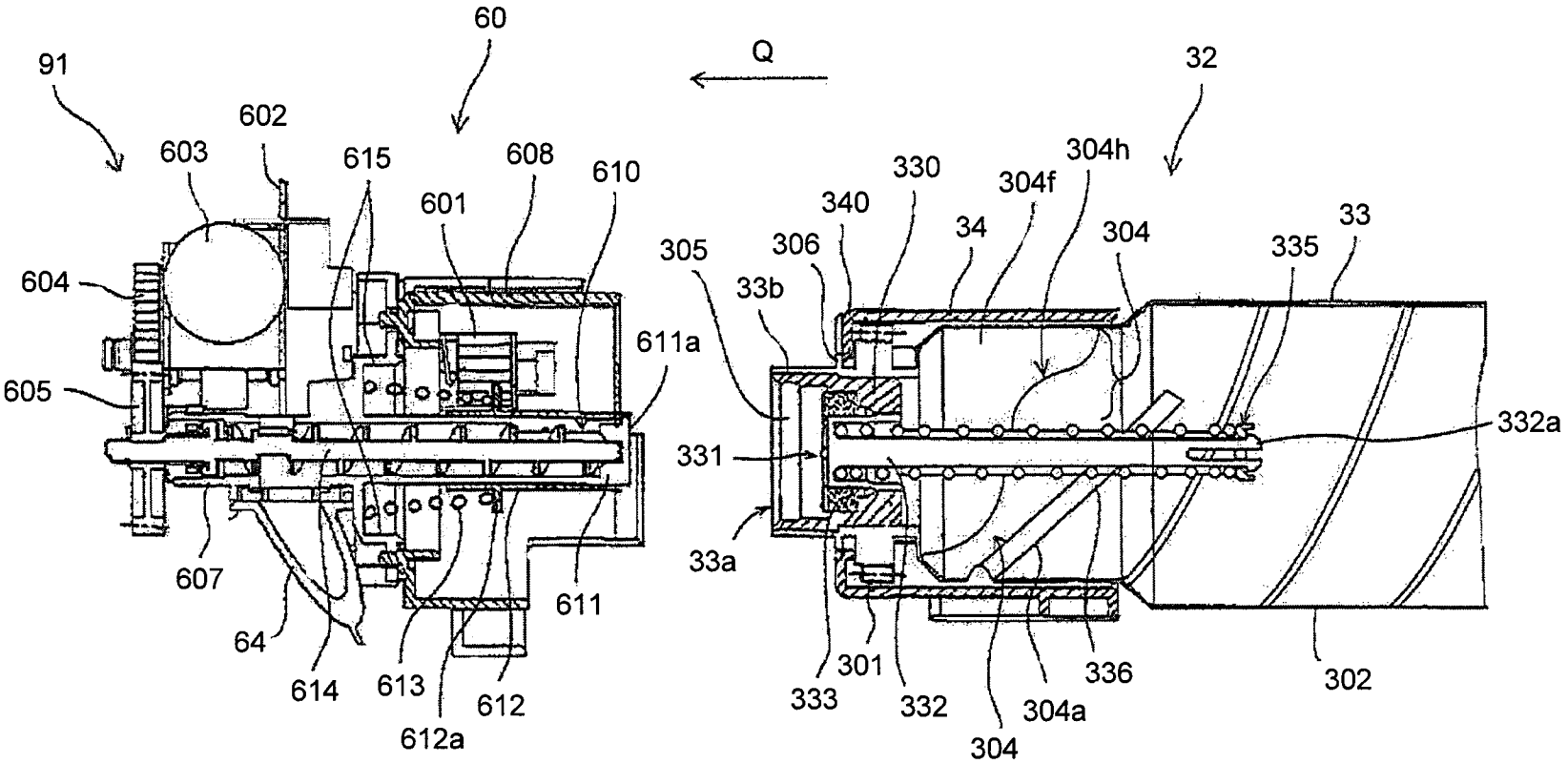
FIG. 1 is an explanatory cross-sectional view of a powder replenishing device before a powder container according to embodiments of the present invention is attached and the powder container.

Embodiments of the present invention will be described below with reference to the accompanying drawings. In the descriptions of the embodiments and conventional configurations, the same components or components with the same functions are basically denoted by the same reference symbols, and the same explanation will not be repeated in subsequent embodiments and conventional configurations. The descriptions below are mere examples and do not limit the scope of the appended claims. Further, a person skilled in the art may easily conceive other embodiments by making modifications or changes within the scope of the appended claims; however, such modifications and changes obviously fall within the scope of the appended claims. In the drawings, Y, M, C, and K are symbols appended to components corresponding to yellow, magenta, cyan, and black, respectively, and will be omitted appropriately.

First Embodiment

A first embodiment of the present invention will be described below. The first embodiment includes techniques according to first to third examples to be described later.

Figure 2:
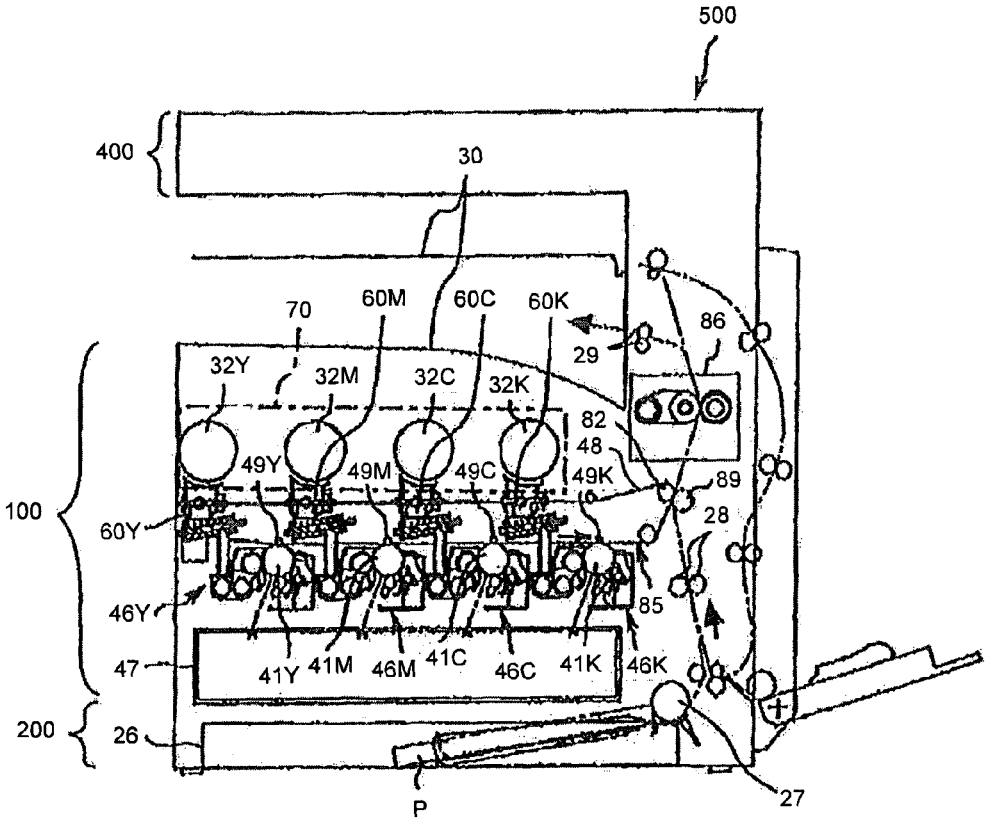
FIG. 2 is a diagram illustrating an overall configuration of an image forming apparatus according to the embodiments.

FIG. 2 is an overall configuration diagram of an electrophotography tandem-type color copier (hereinafter, referred to as "a copier 500") serving as an image forming apparatus according to an embodiment. The copier 500 may be a monochrome copier. The image forming apparatus may be a printer, a facsimile machine, or a multifunction with at least two of the functions of a copier, a printer, a facsimile machine, and a scanner, instead of the copier. The copier 500 mainly includes a copier main-body (hereinafter, referred to as "a printer 100"), a sheet feed table (hereinafter, referred to as "a sheet feeder 200"), and a scanner section (hereinafter, referred to as "a scanner 400") mounted on the printer 100.

Four toner containers 32Y, 32M, 32C, 32K serving as powder containers corresponding to different colors (yellow, magenta, cyan, black) are detachably (replaceably) attached to a toner container holder 70 serving as a container holding section provided in the upper part of the printer 100. An intermediate transfer device 85 is arranged below the toner container holder 70.

The intermediate transfer device 85 includes an intermediate transfer belt 48 serving as an intermediate transfer medium, four primary-transfer bias rollers 49Y, 49M, 49C, 49K, a secondary-transfer backup roller 82, multiple tension rollers, an intermediate-transfer cleaning device, and the like. The intermediate transfer belt 48 is stretched and supported by multiple rollers and endlessly moves counterclockwise in FIG. 2 along with rotation of the secondary-transfer backup roller 82 serving as one of the rollers.

In the printer 100, four image forming sections 46 (Y, M, C, K), as image forming units, corresponding to the respective colors are arranged in tandem so as to face the intermediate transfer belt 48. Four toner replenishing devices 60Y, 60M, 60C, 60K serving as powder supply (replenishing) devices corresponding to the four toner containers 32Y, 32M, 32C, 32K of the four colors are arranged below the toner containers 32Y, 32M, 32C, 32K, respectively. The toner replenishing devices 60Y, 60M, 60C, 60K respectively supply (replenish) toner that is powder developer contained in the toner containers 32Y, 32M, 32C, 32K to developing devices of the image forming sections 46Y, 46M, 46C, 46K for the respective colors. In the embodiment, the four image forming sections 46Y, 46M, 46C, 46K form an image forming unit.

As illustrated in FIG. 2, the printer 100 includes an exposing device 47 serving as a latent-image forming means below the four image forming sections 46Y, 46M, 46C, 46K. The exposing device 47 exposes and scans the surfaces of photoconductors 41Y, 41M, 41C, 41K serving as image bearers (to be described later) with light based on image information of an original image read by the scanner 400, so that electrostatic latent images are formed on the surfaces of the photoconductors. The image information may be input from an external apparatus, such as a personal computer, connected to the copier 500, instead of being read by the scanner 400.

In the embodiment, a laser beam scanning system using a laser diode is employed as the exposing device 47. However, other configurations, such as a configuration including an LED array, may be employed as the exposing means.

Figure 3:
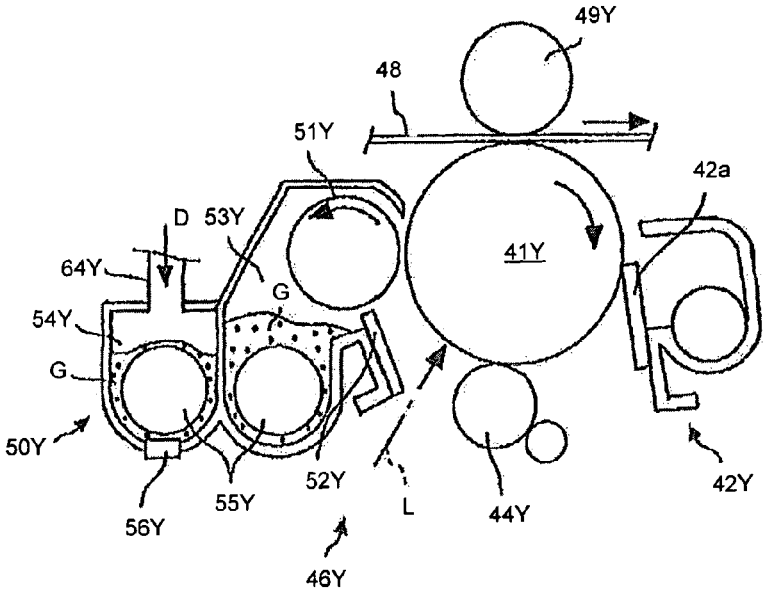
FIG. 3 is a schematic diagram illustrating a configuration of an image forming section of the image forming apparatus illustrated in FIG. 2.

FIG. 3 is a schematic diagram illustrating an overall configuration of the image forming section 46Y corresponding to yellow.

The image forming section 46Y includes the drum-shaped photoconductor 41Y. The image forming section 46Y includes a charging roller 44Y serving as a charging device, a developing device 50Y serving as a developing means, a cleaning device 42Y serving as a photoconductor cleaning device, a neutralizing device, and the like, all of which are arranged around the photoconductor 41Y. Image forming processes (a charging process, an exposing process, a developing process, a transfer process, and a cleaning process) are performed on the photoconductor 41Y, so that a yellow toner image is formed on the photoconductor 41Y.

The other three image forming sections 46M, 46C, 46K have almost the same configurations as the image forming section 46Y for yellow except that colors of toner to be used are different and toner images corresponding to the respective toner colors are formed on the photoconductors 41M, 41C, 41K. Hereinafter, explanation of only the image forming section 46Y for yellow will be given, and explanation of the other three image forming sections 46 (M, C, K) will be omitted appropriately.

The photoconductor 41Y is rotated clockwise in FIG. 3 by a drive motor. The surface of the photoconductor 41Y is uniformly charged at a position facing the charging roller 44Y (charging process). Subsequently, the surface of the photoconductor 41Y reaches a position of irradiation with laser light L emitted by the exposing device 47, where an electrostatic latent image for yellow is formed through exposure scanning (exposing process). The surface of the photoconductor 41Y then reaches a position facing the developing device 50Y, where the electrostatic latent image is developed with yellow toner to form a yellow toner image (developing device).

The primary-transfer bias roller 49Y of the intermediate transfer device 85 and the photoconductor 41Y sandwich the intermediate transfer belt 48, so that a primary transfer nip for yellow is formed. A transfer bias with polarity opposite to the polarity of toner is applied to the primary-transfer bias roller 49Y.

The surface of the photoconductor 41Y, on which the toner image is formed through the developing process, reaches the primary transfer nip facing the primary-transfer bias roller 49Y across the intermediate transfer belt 48, and the toner image on the photoconductor 41Y is transferred to the intermediate transfer belt 48 at the primary transfer nip (primary transfer process). At this time, a slight amount of non-transferred toner remains on the photoconductor 41Y. The surface of the photoconductor 41Y, from which the toner image has been transferred to the intermediate transfer belt 48 at the primary transfer nip, reaches a position facing the cleaning device 42Y. At this position, the non-transferred toner remaining on the photoconductor 41Y is mechanically collected by a cleaning blade 42*a* included in the cleaning device 42Y (cleaning process). The surface of the photoconductor 41Y finally reaches a position facing the neutralizing device, where the residual potential on the photoconductor 41Y is removed. In this way, a series of the image forming processes performed on the photoconductor 41Y is completed.

The above image forming processes are also performed on the other image forming sections 46M, 46C, 46K in the same manner as the image forming section 46Y for yellow. Specifically, the exposing device 47 arranged below the image forming sections 46M, 46C, 46K emits laser light L based on the image information toward the photoconductors 41M, 41C, 41K of the image forming sections 46M, 46C, 46K. More specifically, the exposing device 47 emits the laser light L from a light source and irradiates each of the photoconductors 41M, 41C, 41K with the laser light L via multiple optical elements while performing scanning with the laser light L by a rotating polygon mirror.

Subsequently, toner images of the respective colors formed on the photoconductors 41M, 41C, 41K through the developing process are transferred to the intermediate transfer belt 48 due to the action of transfer biases applied to the respective primary-transfer bias rollers at the four-color primary-transfer nips that are formed by sandwiching the intermediate transfer belt 48 between the primary-transfer bias rollers 49M, 49C, 49K and the photoconductors 41M, 41C, 41K.

At this time, the intermediate transfer belt 48 moves counterclockwise in FIG. 2 and sequentially passes through the primary transfer nips of the primary-transfer bias rollers 49Y, 49M, 49C, 49K. Therefore, the toner images of the respective colors on the photoconductors 41Y, 41M, 41C, 41K are primary-transferred to the intermediate transfer belt 48 in a superimposed manner, so that a color toner image is formed on the intermediate transfer belt 48.

The intermediate transfer belt 48, on which the color toner image is formed by the superimposed toner images of the respective colors, reaches a position facing a secondary-transfer roller 89. At this position, the secondary-transfer backup roller 82 and the secondary transfer roller 89 sandwich the intermediate transfer belt 48, so that a secondary transfer nip is formed. The color toner image formed on the intermediate transfer belt 48 is transferred to a recording medium P, such as a sheet of paper, conveyed to the position of the secondary transfer nip, due to the action of a transfer bias applied to the secondary-transfer backup roller 82, for example. At this time, non-transferred toner which has not been transferred to the recording medium P remains on the intermediate transfer belt 48. The intermediate transfer belt 48 that has passed through the secondary transfer nip reaches the position of the intermediate-transfer cleaning device, where the non-transferred toner remaining on the surface is collected. In this way, a series of transfer processes performed on the intermediate transfer belt 48 is completed.

Movement of the recording medium P will be explained below.

The recording medium P is conveyed to the secondary transfer nip from a feed tray 26 provided in the sheet feeder 200 arranged below the printer 100 via a feed roller 27, a registration roller pair 28, and the like. Specifically, multiple recording media P are stacked in the feed tray 26. When the feed roller 27 is rotated counterclockwise in FIG. 2, the topmost recording medium P is fed to a nip between two rollers of the registration roller pair 28.

The recording medium P conveyed to the registration roller pair 28 temporarily stops at the position of the nip between the rollers of the registration roller pair 28, the rotation of which is being stopped. The registration roller pair 28 is rotated to convey the recording medium P toward the secondary transfer nip in accordance with the timing at which the color toner image on the intermediate transfer belt 48 reaches the secondary transfer nip. Accordingly, a desired color image is formed on the recording medium P.

The recording medium P on which the color toner image is transferred at the secondary transfer nip is conveyed to the position of a fixing device 86. In the fixing device 86, the color toner image transferred on the surface of the recording medium P is fixed to the recording medium P by heat and pressure applied by a fixing belt and a pressing roller. The recording medium P that has passed through the fixing device 86 is discharged to the outside of the apparatus via a nip between rollers of a discharge roller pair 29. The recording medium P discharged to the outside of the apparatus by the discharge roller pair 29 is sequentially stacked, as an output image, on a stack section 30. In this way, a series of image forming processes in the copier 500 is completed.

A configuration and operation of the developing device 50 in the image forming section 46 will be explained in detail below. In the following, the image forming section 46Y for yellow will be explained by way of example. However, the image forming sections 46M, 46C, 46K for the other colors have the same configurations and perform the same operation.

As illustrated in FIG. 3, the developing device 50Y includes a developing roller 51Y serving as a developer bearer, a doctor blade 52Y serving as a developer regulating plate, two developer conveying screws 55Y, a toner density sensor 56Y, and the like. The developing roller 51Y faces the photoconductor 41Y. The doctor blade 52Y faces the developing roller 51Y. The two developer conveying screws 55Y are arranged inside two developer accommodating sections, i.e., first and second developer accommodating sections 53Y and 54Y. The developing roller 51Y includes a magnet roller disposed inside thereof, a sleeve that rotates around the magnet roller, and the like. Two-component developer G containing carrier and toner is stored in the first developer accommodating section 53Y and the second developer accommodating section 54Y. The second developer accommodating section 54Y communicates with a toner dropping passage 64Y via an opening provided in the upper side thereof. The toner density sensor 56Y detects a toner density in the developer G stored in the second developer accommodating section 54Y.

The developer G in the developing device 50 circulates between the first developer accommodating section 53Y and the second developer accommodating section 54Y while being stirred by the two developer conveying screws 55Y. The developer G in the first developer accommodating section 53Y is supplied to and borne on the surface of the sleeve of the developing roller 51Y due to a magnetic field generated by the magnet roller in the developing roller 51Y while the developer G is being conveyed by one of the developer conveying screws 55Y. The sleeve of the developing roller 51Y rotates counterclockwise as indicated by an arrow in FIG. 3, and the developer G borne on the developing roller 51Y moves on the developing roller 51Y along with the rotation of the sleeve. At this time, the toner in the developer G electrostatically adheres to the carrier by being charged to the potential opposite to the polarity of the carrier due to triboelectric charging with the carrier in the developer G, and is borne on the developing roller 51Y together with the carrier that is attracted by the magnetic field generated on the developing roller 51Y.

The developer G borne on the developing roller 51Y is conveyed in the arrow direction in FIG. 3 and reaches a doctor section where the doctor blade 52Y and the developing roller 51Y face each other. The amount of the developer G on the developing roller 51Y is regulated and adjusted to an appropriate amount when the developer G passes through the doctor section, and then the developer G is conveyed to a development area facing the photoconductor 41Y. In the development area, the toner in the developer G adheres to the latent image formed on the photoconductor 41Y by a developing electric field generated between the developing roller 51Y and the photoconductor 41Y. The developer G remaining on the surface of the developing roller 51Y that has passed through the development area reaches the upper side of the first developer accommodating section 53Y along with the rotation of the sleeve. At this position, the developer G is separated from the developing roller 51Y.

The developer G in the developing device 50Y is adjusted so that the toner density falls within a predetermined range. Specifically, toner contained in the toner container 32Y is replenished to the second developer accommodating section 54Y by the toner replenishing device 60Y (to be described later) through the toner dropping passage 64Y in accordance with the consumption of toner of the developer G in the developing device 50Y through the development. The toner replenished to the second developer accommodating section 54Y circulates between the first developer accommodating section 53Y and the second developer accommodating section 54Y while being mixed and stirred with the developer G by the two developer conveying screws 55Y.

Next, the toner replenishing devices 60Y, 60M, 60C, 60K will be described.

Figure 4:
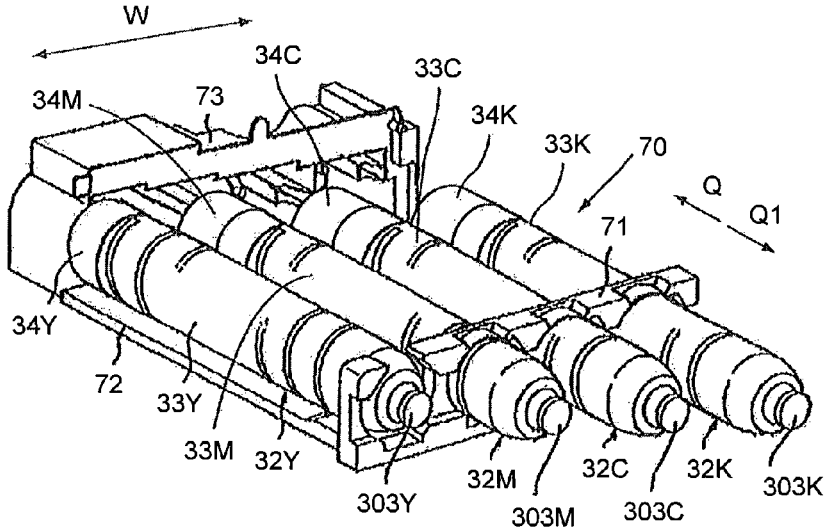
FIG. 4 is a schematic perspective view illustrating a state in which the powder containers are attached to a container holding section.
Figure 5:
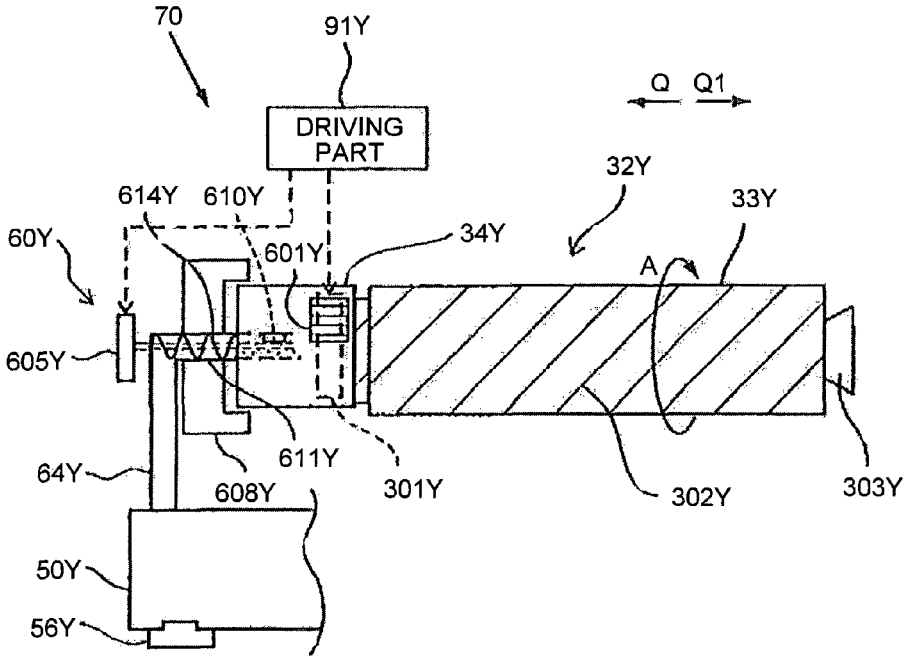
FIG. 5 is a schematic diagram illustrating a state in which the powder containers are attached to the powder replenishing device of the image forming apparatus illustrated in FIG. 2.

FIG. 4 is a schematic perspective view illustrating a state in which the four toner containers 32Y, 32M, 32C, 32K are attached to the toner container holder 70. FIG. 5 is a schematic diagram illustrating a state in which the toner container 32Y is attached to the toner replenishing device 60Y. The toner replenishing devices 60Y, 60M, 60C, 60K for the respective colors have the same configurations except that the colors of toner are different. Therefore, in FIG. 5, explanation of only the toner replenishing device 60Y and the toner container 32Y for yellow will be given, and explanation of the toner replenishing devices 60M, 60C, 60K and the toner containers 32M, 32C, 32K for the other three colors will be omitted appropriately. When the configurations vary depending on the colors, a symbol Y, M, C, or K representing a specific color is used. When the configurations do not vary depending on the colors or common to all of the colors, a symbol Y, M, C, or K may be used or all of the symbols may be omitted appropriately. In FIG. 4, an arrow Q indicates an attachment direction in which the toner containers 32 of the respective colors are attached to the toner replenishing devices 60, and Q1 indicates a detachment direction in which the toner containers 32 of the respective colors are detached from the toner replenishing devices 60.

Incidentally, the diameter of the toner container 32K containing black toner among the four toner containers 32 (Y, M, C, K) may be increased relative to the diameters of the toner containers 32 (Y, M, C) containing yellow toner, magenta toner, and cyan toner. With this configuration, it is possible to reduce the frequency to replace the toner container 32K containing black toner that is frequently used. Even in this case, the toner replenishing devices 60 have approximately the same configurations except that the colors of toner used in the image forming processes and the diameters of the toner containers 32 vary from one another. Therefore, the toner container 32Y will be mainly described below.

The yellow toner contained in the toner container 32Y among the toner containers 32Y, 32M, 32C, 32K for the respective colors attached to the toner container holder 70 of the printer 100 illustrated in FIG. 4 is appropriately replenished to the developing device in accordance with the consumption of toner in the developing device 50 as illustrated in FIG. 5. At this time, the toner in the toner container 32Y is replenished by the toner replenishing device 60Y. The toner replenishing device 60Y includes the toner container holder 70, a conveying nozzle 611Y serving as a conveying pipe, a conveying screw 614Y serving as a main body conveyor, the toner dropping passage 64Y, a driving part 91Y serving as a container rotating part, and the like. The toner replenishing devices for the other colors have the same configurations. When a user performs attachment operation to push the toner container 32Y in the attachment direction Q in FIG. 5 and the toner container 32Y is moved inside the toner container holder 70 of the printer 100 along with the attachment direction Q, the conveying nozzle 611Y of the toner replenishing device 60Y is inserted from a front side of the toner container 32Y in the attachment operation.

Therefore, the toner container 32Y and the conveying nozzle 611Y communicate with each other. A configuration for the communication along with the attachment operation will be described in detail later.

The toner container 32Y may be referred to as a toner bottle. The toner container 32Y mainly includes a container front end cover 34Y serving as a container cover or a held portion that is non-rotatably held by the toner container holder 70, and includes an approximately cylindrical container body 33Y serving as a powder storage integrated with a container gear 301Y serving as a container-side gear. The container body 33Y is rotatably held by the container front end cover 34Y. In FIG. 5, a setting cover 608Y is a part of a container cover receiving section 73 of the toner container holder 70.

As illustrated in FIG. 4, the toner container holder 70 mainly includes the container cover receiving section 73, a container receiving section 72, and an insertion hole part 71. The container cover receiving section 73 is a section for holding the container front end covers 34Y, 34M, 34C, 34K and the container bodies 33Y, 33M, 33C, 33K of the toner containers 32Y, 32M, 32C, 32K for the respective colors. The container receiving section 72 is a section for supporting the container bodies 33Y, 33M, 33C, 33K of the toner containers 32Y, 32M, 32C, 32K. An insertion hole 71*a* serving as an insertion opening used in the attachment operation of the toner containers 32Y, 32M, 32C, 32K is defined by the insertion hole part 71. When a main-body cover arranged on the front side of the copier 500 (the front side in the direction normal to the sheet of FIG. 2) is opened, the insertion hole part 71 of the toner container holder 70 is exposed. Then, attachment/detachment operation of the toner containers 32Y, 32M, 32C, 32K (attachment/detachment operation with the longitudinal direction of the toner containers 32 taken as an attachment/detachment direction in which the toner containers 32 of the respective colors are attached to and detached from the toner replenishing devices 60) is performed from the front side of the copier 500 while the toner containers 32Y, 32M, 32C, 32K are oriented with their longitudinal directions being parallel to the horizontal direction.

The container receiving section 72 is provided such that its longitudinal length becomes approximately the same as the longitudinal lengths of the container bodies 33Y, 33M, 33C, 33K of the respective colors. The container cover receiving section 73 is arranged on a container front side (a side in the attachment direction Q) of the container receiving section 72 in the longitudinal direction (attachment/detachment direction), and the insertion hole part 71 is arranged on one end side (a side in the detachment direction Q1) of the container receiving section 72 in the longitudinal direction. The four toner containers 32Y, 32M, 32C, 32K are able to moves on the container receiving section 72 in a sliding manner. Therefore, along with the attachment operation of the toner containers, the container front end covers 34Y, 34M, 34C, 34K first pass through the insertion hole part 71, slides on the container receiving section 72 for a while, and are finally attached to the container cover receiving section 73.

While the container front end cover 34Y is attached to the container cover receiving section 73, the driving part (container rotating part) 91Y including a driving motor, a driving gear, and the like as illustrated in FIG. 5 inputs rotation drive to the container gear 301Y that is a gear arranged in the container body 33Y, via a container driving gear 601Y serving as an apparatus main-body gear. Therefore, the container body 33Y is rotated in the arrow A direction in FIG. 5. With the rotation of the container body 33Y, a spiral rib 302Y formed in a spiral shape on the inner surface of the container body 33Y conveys toner in the container body 33Y from one end on the right side in FIG. 5 to the other end on the left side in FIG. 5 along the longitudinal direction of the container body. Namely, in the embodiment, the spiral rib 302Y serves as a rotary conveyor. Consequently, the toner is supplied to the inside of the conveying nozzle 611Y via a nozzle hole 610Y serving as a powder receiving hole provided on the conveying nozzle 611Y, and supplied from the other side of the toner container 32Y where the container front end cover 34Y is attached. The nozzle hole 610Y communicates with an opening of shutter supporting portion 335*b* serving as a shutter side opening (to be described later), at an inner position relative to the position where the container gear 301Y is arranged in the longitudinal direction of the container body 33Y. Specifically, the container gear 301Y meshes with the container driving gear 601Y on a container opening 33*a* side in the longitudinal direction of the toner container, relative to the position where the nozzle hole 610 and the opening of shutter supporting portion 335*b* communicate with each other.

The conveying screw 614Y is arranged in the conveying nozzle 611Y. When the driving part (container rotating part) 91Y inputs the rotation drive to a conveying screw gear 605Y, the conveying screw 614Y rotates to convey the toner supplied in the conveying nozzle 611Y. A downstream end of the conveying nozzle 611Y in the conveying direction is connected to the toner dropping passage 64Y. The toner conveyed by the conveying screw 614Y falls along the toner dropping passage 64Y by gravity and is replenished to the developing device 50Y (the second developer accommodating section 54Y).

The toner containers 32Y, 32M, 32C, 32K are replaced with new ones at the end of their lifetimes (when the containers become empty because almost all of the contained toner is consumed). Grippers 303Y, 303M, 303C, 303K are arranged on one ends of the toner containers 32Y, 32M, 32C, 32K opposite to the container front end covers 34Y, 34M, 34C, 34K in the longitudinal direction in FIG. 4, that is, on the detachment direction Q1 sides. When the toner containers are to be replaced, an operator can grip the grippers 303Y, 303M, 303C, 303K to pull out and detach the toner containers 32Y, 32M, 32C, 32K attached to the toner container holder 70.

Figure 6:
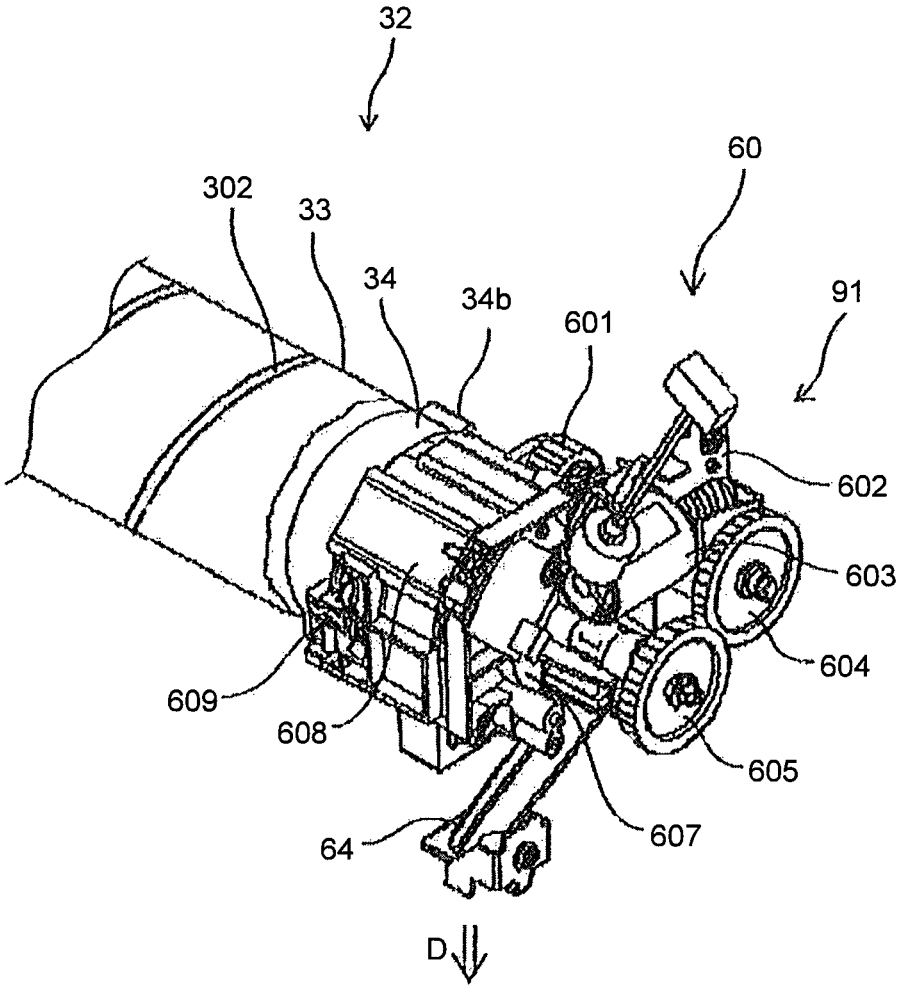
FIG. 6 is an explanatory perspective view of the powder replenishing device to which the powder container is attached and the powder container.

The configuration of the driving part 91 will be further described below with reference to FIG. 6. In FIG. 6, symbols representing the colors are omitted. The driving part 91 includes the container driving gear 601 and the conveying screw gear 605. When a driving motor 603 fixed to a mounting frame 602 is driven and an output gear is rotated, the container driving gear 601 rotates. The conveying screw gear 605 rotates by receiving the rotation of the output gear via a coupled gear 604.

As illustrated in FIG. 4, the toner replenishing device 60Y controls the amount of toner supplied to the developing device 50Y in accordance with the rotation frequency of the conveying screw 614Y. Therefore, toner that passes through the conveying nozzle 611Y is directly conveyed to the developing device 50Y through the toner dropping passage 64Y without the need to control the amount of toner supplied to the developing device 50Y. Even in the toner replenishing device 60Y configured to insert the conveying nozzle 611Y into the toner container 32Y as described in the embodiment, it may be possible to arrange a temporary toner storage, such as a toner hopper. In the toner replenishing devices 60M, 60C, 60K for the other colors, the supply amount of toner is controlled in the same manner as in the toner replenishing device 60Y.

The toner containers 32Y, 32M, 32C, 32K and the toner replenishing devices 60Y, 60M, 60C, 60K according to the embodiment will be described in detail below. As described above, the toner containers 32Y, 32M, 32C, 32K and the toner replenishing devices 60Y, 60M, 60C, 60K have almost the same configurations except that the colors of toner to be used are different. Therefore, in the following descriptions, symbols Y, M, C, and K representing the colors of toner will be omitted.

Figure 7:
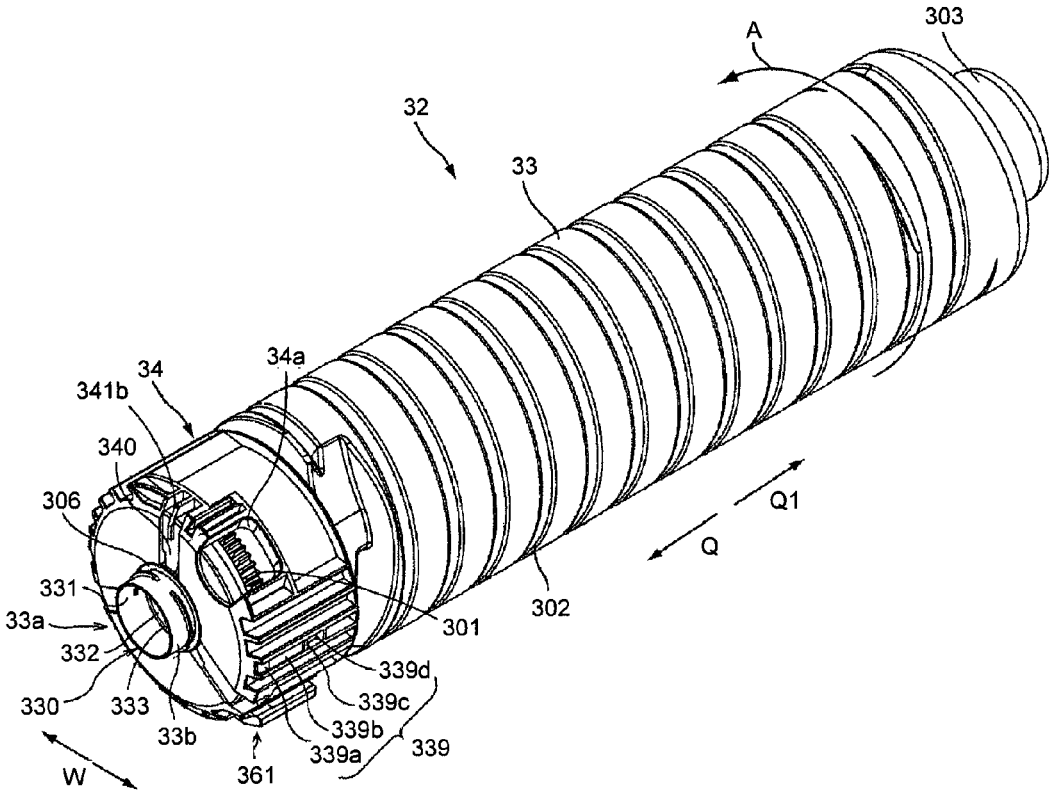
FIG. 7 is an explanatory perspective view illustrating a configuration of the powder container according to the embodiments.
Figure 8:
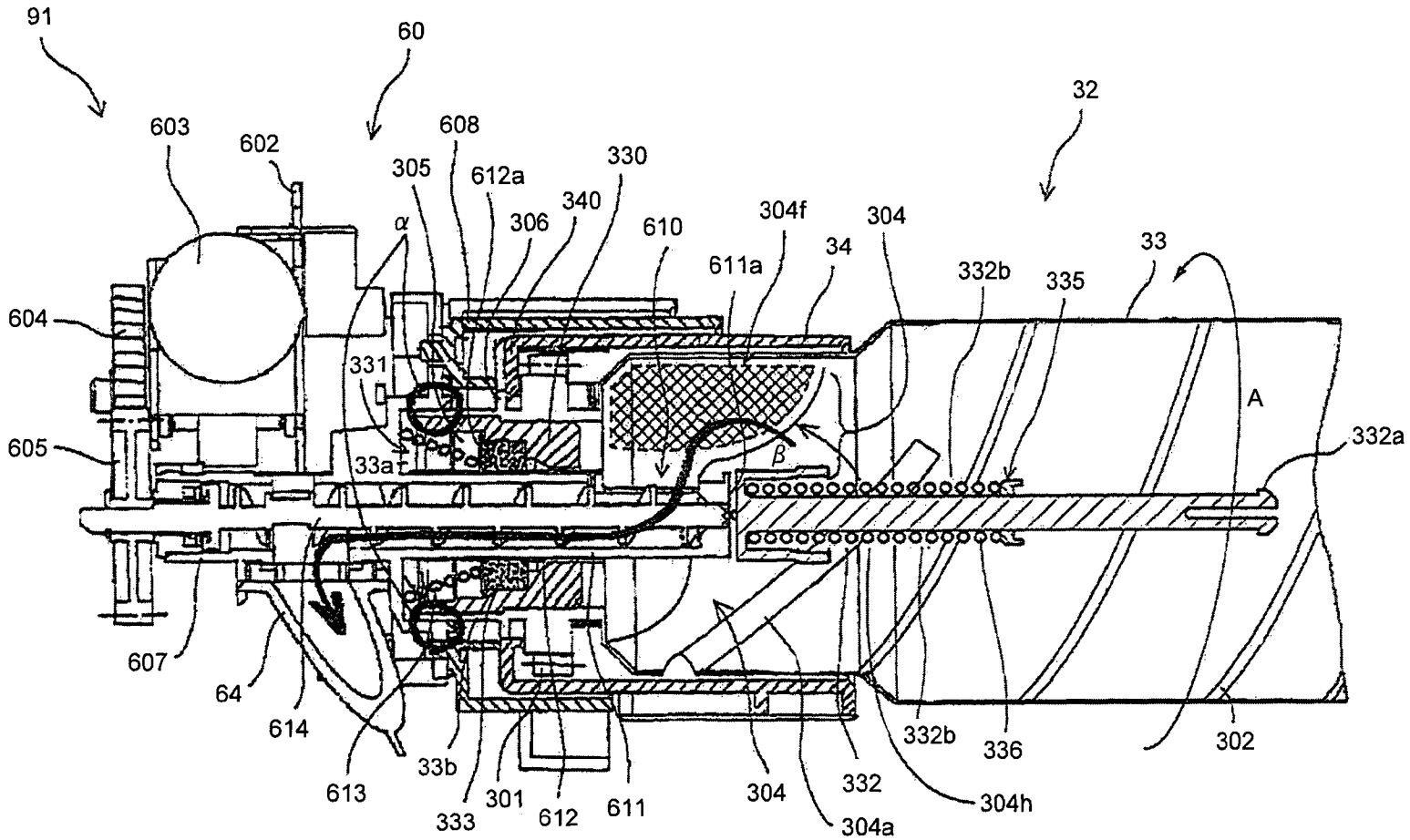
FIG. 8 is an explanatory cross-sectional view of the powder replenishing device to which the powder container is attached and the powder container.
Figure 9:
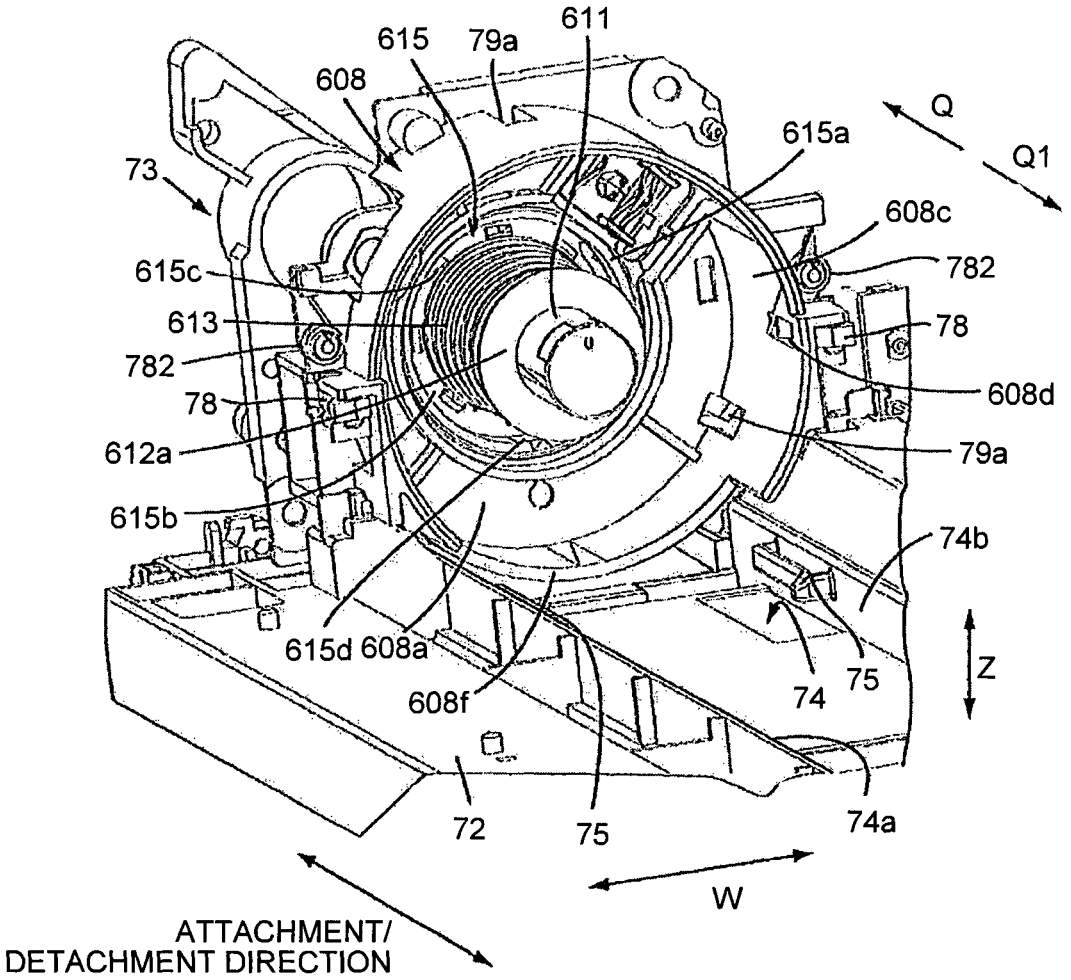
FIG. 9 is an explanatory partially-enlarged perspective view of the container holding section according to the embodiments.

FIG. 1 is an explanatory cross-sectional view of the toner replenishing device 60 before the toner container 32 is attached and a front end of the toner container 32. FIG. 7 is an explanatory perspective view of the toner container 32 viewed from above the container front end cover 34. FIG. 8 is an explanatory cross-sectional view of the toner replenishing device 60 to which the toner container 32 is attached and the front end of the toner container 32. FIG. 9 is a perspective view illustrating a configuration of the container cover receiving section 73 of the toner container holder 70.

The toner replenishing device 60 includes the conveying nozzle 611 in which the conveying screw 614 is arranged, and a nozzle shutter 612. The nozzle shutter 612 is slidably mounted on the outer surface of the conveying nozzle 611 so as to close the nozzle hole 610 at the time of detachment, which is before the toner container 32 is attached (in the state in FIG. 1), and to open the nozzle hole 610 at the time of attachment, which is when the toner container 32 is attached (in the state in FIG. 8). The nozzle shutter 612 includes a nozzle shutter flange 612*a* serving as a flange on the downstream side in the attachment direction relative to an end surface of a nozzle receiver 330 serving as a nozzle insertion member (to be described later) that comes in contact with the conveying nozzle 611.

As illustrated in FIG. 7, a receiving opening 331, which serves as a nozzle insertion opening into which the conveying nozzle 611 is inserted at the time of attachment, is provided in the center of the front end of the toner container 32, and a container shutter 332, which serves as an opening/closing member that closes the receiving opening 331 at the time of detachment, is arranged.

As illustrated in FIG. 4, the container receiving section 72 arranged on the toner container holder 70 is divided into four sections in a width direction W perpendicular to the longitudinal direction (attachment/detachment direction) of the toner container 32, and gutters 74 serving as container mounting sections as illustrated in FIG. 9 are provided so as to extend from the insertion hole part 71 to the container cover receiving section 73 along the longitudinal direction of the container bodies 33 (Y, M, C, K). The toner containers 32 (Y, M, C, K) for the respective colors are able to move on the gutters 74 in a sliding manner in the longitudinal direction.

As illustrated in FIG. 9, on side surfaces 74*a* and 74*b* of the gutter 74, which are opposite surfaces arranged in the width direction W, the guide rails 75 are arranged so as to face each other. The guide rails 75 protrude in the width direction W from the respective side surfaces 74*a* and 74*b*, extend in the longitudinal direction, and are arranged in front of the container cover receiving section 73. The guide rails 75 have functions to guide the container opening 33*a* serving as the opening to a container setting section 615 serving as a container receiving section by being fitted to sliding guides 361 serving as guiding portions on the toner container 32 side illustrated in FIG. 7 when the toner container 32 is attached to the printer 100 (the toner container holder 70 and the toner replenishing device 60). Each of the guide rails 75 is provided so as to be parallel to the rotation axis of the container body 33 when the toner container 32 is attached to the toner replenishing device 60.

As illustrated in FIG. 9, the setting cover 608 for each color is arranged on the container cover receiving section 73. The conveying nozzle 611 is arranged in the center of the setting cover 608. The conveying nozzle 611 is arranged so as to protrude from an end surface 615*b*, which is on the inner side in the attachment direction, of the container setting section 615, which is located on the downstream side in the attachment direction of the toner container 32, toward the upstream side in the attachment direction inside the container cover receiving section 73. The container setting section 615 serving as the container receiving section is arranged in the protruding direction of the conveying nozzle 611, that is, toward the upstream side in the attachment direction of the toner container 32 so as to surround the conveying nozzle 611. Specifically, the container setting section 615 is arranged at the base of the conveying nozzle 611 and serves as a positioner to determine the position of the container opening 33*a* relative to the toner container holder 70, where the container opening 33*a* functions as a rotational shaft when the rotary conveyor inside the toner container 32 rotates to convey the toner contained in the toner container 32. Namely, when the container opening 33*a* is inserted in and mated to the container setting section 615, the radial position of the container opening 33*a* is determined.

When the toner container 32 is attached to the toner replenishing device 60, an outer surface 33*b* of the container opening 33*a* of the toner container 32 is slidably mated to the container setting section 615. On an inner surface 615*a* of the container setting section 615, contact surfaces 615*d*, which are parts of the inner surface 615*a* of the container setting section 615 and which protrude inward in the radial direction from the inner surface 615*a* of the container setting section 615, are provided at four evenly-spaced positions. The contact surfaces 615*d* and the outer surface 33*b* slide against each other with rotation of the toner container 32.

By the mating of the inner surface 615*a* of the container setting section 615 and the outer surface 33*b* of the container opening 33*a* of the toner container 32, the position of the toner container 32 relative to the toner replenishing device 60 in the radial direction perpendicular to the longitudinal direction (attachment/detachment direction) of the toner container 32 is determined. Further, when the toner container 32 rotates, the outer surface 33*b* of the container opening 33*a* functions as a rotational shaft, and the inner surface 615*a* of the container setting section 615 functions as a bearing. In FIG. 8, a indicates the position at which the outer surface 33*b* of the container opening 33*a* comes in sliding contact with the contact surfaces 615*d* as the parts of the inner surface 615*a* of the container setting section 615 and at which the radial position of the toner container 32 relative to the toner replenishing device 60 is determined at this time.

In the descriptions below, it is repeatedly explained that the outer surface 33*b* of the container opening 33*a* of the toner container 32 and the container setting section 615 mate with each other in a slidable manner. The mating state is, in a precise sense, a state in which the outer surface 33*b* of the container opening 33*a* of the toner container 32 is in contact with the contact surfaces 615*d* provided on the inner surface 615*a* of the container setting section 615. Hereinafter, for simplicity of explanation, the mating will be referred to as mating the outer surface 33*b* of the container opening 33*a* with the inner surface 615*a* of the container setting section 615 by omitting the contact surfaces 615*d*.

As illustrated in FIG. 9, holes 608*d* are provided so as to face each other in the width direction W of the setting cover 608. On the setting cover 608, replenishing device engaging members 78 (to be described later) are arranged so as to be able to move back and forth from the outer surface to an inner surface 608*c* side of the setting cover 608 via the holes 608*d*. The replenishing device engaging members 78 are biased from the outer side to the inner side of the setting cover 608 by biasing means, such as torsion coil springs 782.

The toner container 32 will be described below.

As illustrated in FIG. 7, the toner container 32 mainly includes the container body 33 containing toner, and includes the container front end cover 34. The container body 33 is in the form of an approximate cylinder and rotates about a central axis of the cylinder as a rotation axis. Hereinafter, one side of the toner container 32 where the receiving opening 331 is provided (the side where the container front end cover 34 is arranged) in the longitudinal direction of the toner container 32 may be referred to as "a container front end". The other side of the toner container 32 where the gripper 303 is arranged (the side opposite the container front end) may be referred to as "a container rear end". The longitudinal direction of the toner container 32 is the rotation axis direction, and corresponds to the horizontal direction when the toner container 32 is attached to the toner replenishing device 60. The container rear end of the container body 33 relative to the container gear 301 has a greater outer diameter than that of the container front end, and the spiral rib 302 is provided on the inner surface of the container body 33. When the container body 33 rotates in the arrow A direction in the figures, a conveying force for moving toner from one end (the container rear end) to the other end (the container front end) in the rotation axis direction is applied to the toner in the container body 33 due to the action of the spiral rib 302.

As illustrated in FIG. 8, scooping portions 304, which scoop up the toner conveyed to the container front end by the spiral rib 302 along with the rotation of the container body 33 in the arrow A direction in the figures, are provided on the inner wall of the container front end of the container body 33. Each of the scooping portions 304 scoops up toner, which has been conveyed by the conveying force of the spiral rib 302, by using a scooping wall surface 304*f* along with the rotation of the container body 33. Therefore, the toner can be scooped up so as to be located above the inserted conveying nozzle 611. As illustrated in FIGS. 1 and 8 for example, a spiral rib 304*a* of the scooping portion is formed in a spiral shape on the inner surface of each of the scooping portions 304 in order to convey the internally-located toner, similarly to the spiral rib 302.

As illustrated in FIGS. 7 and 8, the container gear 301 is provided on the container front side relative to the scooping portions 304 on the container body 33. A gear exposing opening 34*a* is arranged on the container front end cover 34 so that a part of the container gear 301 can be exposed when the container front end cover 34 is attached to the container body 33. When the toner container 32 is attached to the toner replenishing device 60, the container gear 301 exposed from the gear exposing opening 34*a* meshes with a container driving gear 601 of the toner replenishing device 60. The container gear 301 is arranged on the container opening 33*a* side (near the container opening 33*a*) relative to the nozzle hole 610 in the longitudinal direction of the container body 33 such that the container gear 301 can mesh with the container driving gear 601. The container gear 301 meshes with the container driving gear 601 to thereby rotate the rotary conveyor.

The container opening 33*a* in the form of a cylinder is provided on the container front side relative to the container gear 301 of the container body 33 so as to be coaxial with the container gear 301. As illustrated in FIGS. 1 and 8, a nozzle receiver attachment portion 337 of the nozzle receiver 330 is press fitted to the container opening 33*a* so as to be coaxial with the container opening 33*a*, so that the nozzle receiver 330 is fixed to the container body 33. The toner container 32 is configured such that toner is replenished from the container opening 33*a* serving as the opening provided on one end of the container body 33, and thereafter, the nozzle receiver 330 is attached to the container opening 33*a* of the container body 33.

As illustrated in FIG. 7, a cover hook stopper 306 serving as a restrictor is provided between the container opening 33*a* of the container body 33 and the container gear 301. The cover hook stopper 306 has a ring shape extending in the rotation direction (circumferential direction) on the front end of the container front end cover 34 in the attachment direction. At least a part of the cover hook stopper 306 is provided with openings 3061 (to be described later with reference to FIGS. 11A to 11C and 12), each of which serves as a notch or a cutout for passage in a direction perpendicular to the circumferential direction. Namely, the cover hook stopper 306 is provided so as to surround the outer surface of the container opening 33*a*. In the embodiment, the direction perpendicular to the circumferential direction is the longitudinal direction (attachment/detachment direction).

The container front end cover 34 is attached to the toner container 32 (the container body 33) from the container front end (from the bottom left side in FIG. 8). Therefore, the container body 33 penetrates through the container front end cover 34 in the longitudinal direction, and cover hooks 340 serving as protrusions are engaged with the cover hook stopper 306 serving as the restrictor. The container body 33 and the container front end cover 34 are attached so as to rotate relative to each other when the cover hooks 340 are engaged with the cover hook stopper 306. The cover hooks 340 are made of resin material.

Configurations of the cover hook stopper 306 and the cover hooks 340 will be described with reference to FIGS. 11A to 11C and FIG. 12. As described above, the cover hook stopper 306 serving as the restrictor provided on the container body 33 includes the openings 3061 through which the cover hooks 340 arranged on the container front end cover 34 pass in the attachment/detachment direction of the container body 33 perpendicular to the rotation direction.

On a front surface 34*c* of the container front end cover 34 in the attachment direction Q, a hole 34*d* serving as a through hole is provided, which penetrates in the attachment/detachment direction of the container body 33 and into which the container opening 33*a* is inserted. The cover hooks 340 are provided such that front ends 340A protrude toward the center of the hole 34*d*. As indicated by a dashed-line circle 34*e* in FIG. 11B, tips of the front ends 340A protrude inward relative to the outer periphery of the hole 34*d*.

Figure 11A:
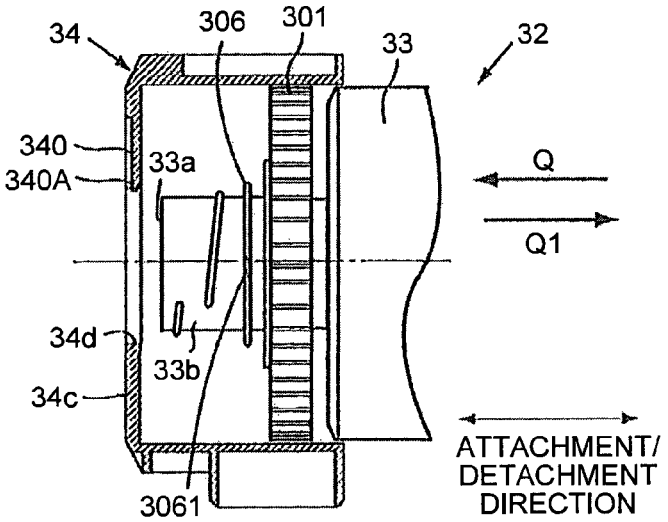
FIG. 11A is a partially-enlarged perspective view illustrating a process of attaching a container front end cover to a container body (powder storage) according to the embodiments.
Figure 11B:
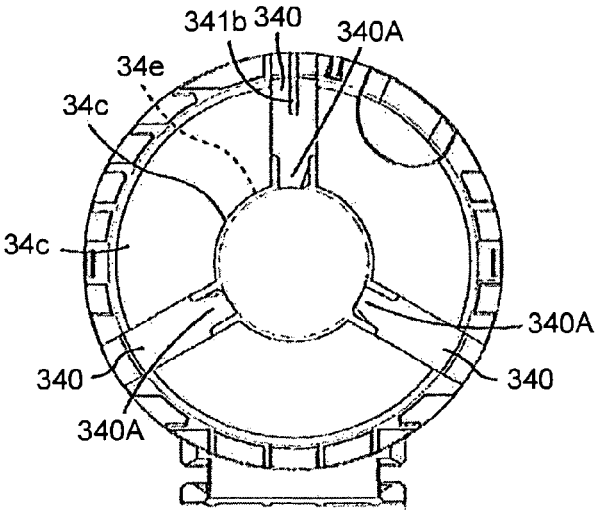
FIG. 11B is a front view illustrating a state in which protrusions of the container front end cover are inserted in a restrictor from the state illustrated in FIG. 11A.
Figure 11C:
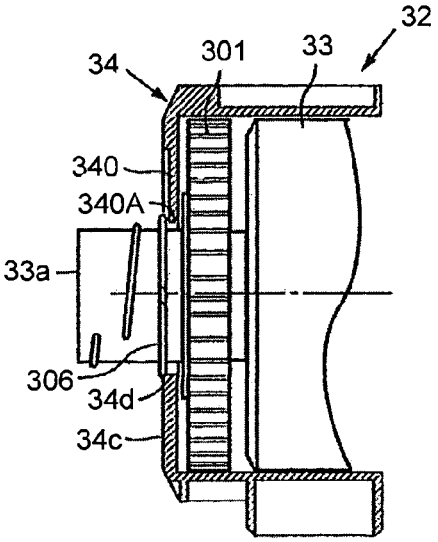
FIG. 11C illustrates a state in which the protrusions of the container front end cover illustrated in FIG. 17A are inserted in the restrictor.

The openings 3061 are openings through which the cover hooks 340 pass in the attachment/detachment direction when the container body 33 rotates relative to the container front end cover 34. In the first embodiment, the three openings 3061 are provided on the cover hook stopper 306 in the rotation direction. The openings 3061 are arranged such that spaces between the openings 3061 in the circumferential direction coincide with the spaces between cover hooks 340 in the circumferential direction. In the first embodiment, the three cover hooks 340 and the three openings 3061 are provided in the rotation direction; however, it is sufficient that at least one cover hook 340 and one opening 3061 are provided. FIG. 11C illustrates a state into which the cover hooks 340 are inserted in the cover hook stopper 306 from a state into which the cover hooks 340 are not inserted in the cover hook stopper 306 as illustrated in FIG. 11A. As illustrated in FIG. 11C, a center side surface of the front surface 34*c* and a side surface of the cover hook stopper 306 face each other. The cover hooks 340 are thinner than the front surface 34*c* (in FIG. 11B, recessed toward the rear side relative to the front surface 34*c*), and the cover hooks 340 and the cover hook stopper 306 face each other in the attachment direction Q. Therefore, the movement of the container front end cover 34 relative to the container body 33 in the attachment direction Q and the detachment direction Q1 is restricted. The restriction involves allowing the cover hooks 340 to move between the cover hook stopper 306 and the container gear 301 in the attachment direction Q and the detachment direction Q1 in FIG. 11C. Accordingly, the container body 33 becomes rotatable relative to the container front end cover 34.

In the first embodiment, "the rotation direction A" is a direction in which the container front end cover 34 rotates relative to the container body 33 in the toner container 32 attached to the copier 500 (the toner replenishing device 60 and the toner container holder 70), and "the attachment rotation direction R" is a direction in which the container front end cover 34 (the cover hooks 340) rotates relative to the container body 33 when the container front end cover 34 is attached to the container body 33. The three cover hooks 340 and the three openings 3061 have the same configurations, respectively; therefore, the configurations and operation of the single cover hook 340 and the single opening 3061 will be described below as representatives. The outer diameter of the cover hook stopper 306 is greater than the inner diameter of the hole 34*d* in the center.

Figure 12:
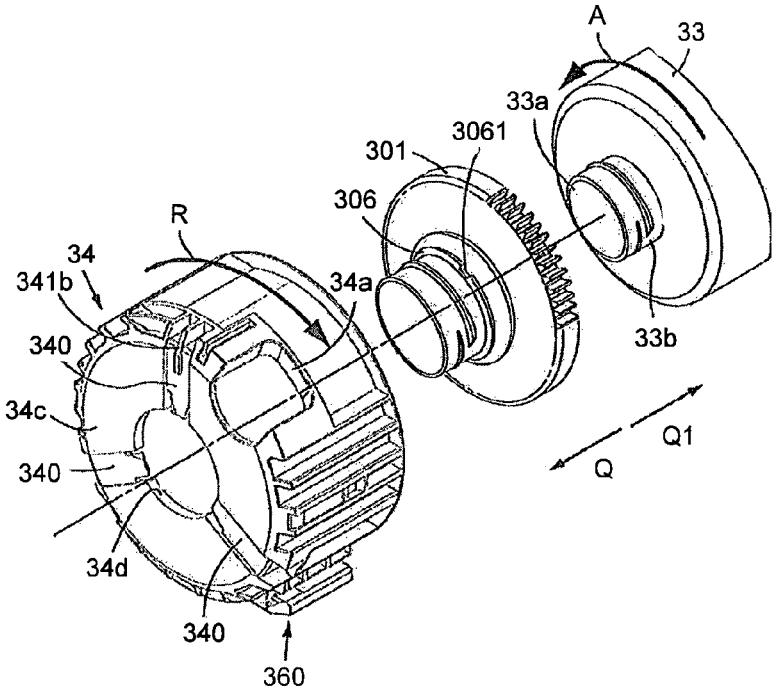
FIG. 12 is an enlarged perspective view for explaining a configuration of the protrusion of the container front end cover and configurations of the restrictor and an opening on the container body side.

The container body 33 and the container gear 301 may be integrally formed. Alternatively, the container body 33 and the container gear 301 may be separately formed depending on the resin material used for the container body 33. In this case, as illustrated in FIG. 12, the cover hook stopper 306 is formed on the container gear 301, the openings 3061 are formed on the cover hook stopper 306 on the container gear 301, and the container gear 301 is attached to the container body 33 in an integrated manner.

As illustrated in FIG. 7, on the container front end cover 34 of the toner container 32, the sliding guides 361 serving as guiding portions are provided on lower portions in the width direction W, where the sliding guides 361 restrict the toner container 32 being attached from moving in directions other than the attachment direction to thereby guide the container opening 33*a* to the container setting section 615 when the toner container 32 is attached to the printer 100. In FIG. 7, only one of the sliding guides 361 is illustrated. Each of the sliding guides 361 includes a gutter extending in the longitudinal direction of the container body 33. The sliding guides 361 are configured such that the guide rails 75, as a pair, provided on the gutters 74 of the container receiving section 72 as illustrated in FIG. 9 are inserted in the respective gutters and sandwiched in the vertical direction. Therefore, the sliding guides 361 function as positioners of the container front end cover 34 in the width direction W perpendicular to a vertical direction Z and the detachment direction Q1 when the toner container 32 is attached to the printer 100 (the toner replenishing device 60 and the toner container holder 70).

As illustrated in FIG. 7, container engaging portions 339 are provided on the surface of the container front end cover 34 in the width direction W to determine the position of the toner container 32 relative to the toner replenishing device 60 in the longitudinal direction (attachment/detachment direction). In FIG. 7, only one of the container engaging portions 339 is illustrated. When the toner container 32 is attached to the toner replenishing device 60, the replenishing device engaging members 78 (see FIGS. 9 and 10) arranged on the setting covers 608 are engaged with the container engaging portions 339.

As illustrated in FIG. 7, each of the container engaging portions 339 includes a guiding protrusion 339*a*, a guiding groove 339*b*, a bump 339*c*, and an engaging opening 339*d* serving as an axial restrictor. A pair of the container engaging portions 339 is arranged so as to be located on left and right sides of the container front end cover 34. Namely, the engaging openings 339*d* are arranged on the left and right sides across the center of the container opening 33*a*. Each of the guiding protrusions 339*a* is provided on the container front end of the container front end cover 34 and located on a vertical plane perpendicular to the longitudinal direction of the toner container 32 and on a horizontal plane passing through the rotation axis of the container body 33. Each of the guiding protrusions 339*a* includes an inclined surface adjoined to each of the guiding grooves 339*b* so as to come in contact with the replenishing device engaging members 78 and to guide the replenishing device engaging members 78 to the guiding grooves 339*b* when the toner container 32 is attached. The guiding grooves 339*b* are grooves recessed from the side surface of the container front end cover 34.

The container rear ends of the guiding grooves 339*b* are not directly connected to the respective engaging openings 339*d* but are terminated, and are located at the same height as the side surfaces of the container front end cover 34. Namely, the outer surface of the container front end cover 34 with a width of about 1 mm is exposed between each of the guiding grooves 339*b* and each of the quadrangular engaging openings 339*d*, and this portion serves as the bump 339*c*. The replenishing device engaging members 78 pass over the bumps 339*c* and fall in the engaging openings 339*d*, so that the toner container 32 and the toner replenishing device 60 are engaged with each other. This state is the set position (set state) of the toner container 32. In the embodiment, the replenishing device engaging members 78 are configured to fall in the engaging openings 339*d* of the container engaging portions 339. However, as the shapes of the container engaging portions 339, in which the replenishing device engaging members 78 falls to enable engagement between the toner container 32 and the toner replenishing device 6, through hole shapes like the engaging openings 339*d* or recessed shapes such as non-penetrating engaging portions in closed-end shapes.

Figure 10:
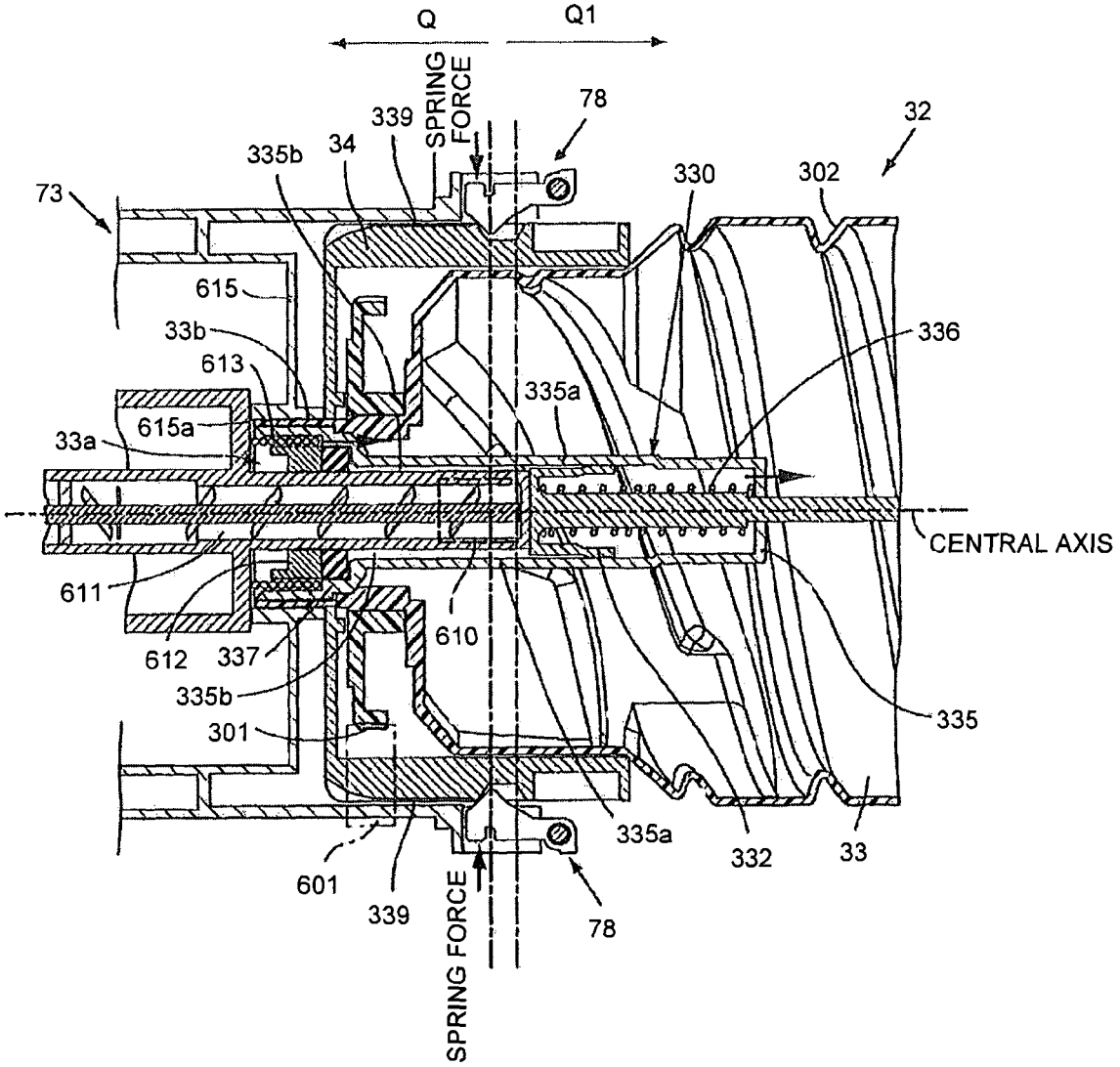
FIG. 10 is an explanatory cross-sectional view of the container holding section to which the powder container is attached.

As illustrated in FIG. 10, the driving part (container rotating part) 91 inputs rotation drive to the container gear 301 of the toner container 32 via the container driving gear 601. When the drive is input to the container gear 301, the outer surface 33*b* of the container opening 33*a* of the container body 33 functions as a rotational shaft and the inner surface 615*a* of the container setting section 615 functions as a bearing, so that the container body 33, in which the container gear 301 is attached or integrated, rotates. In the first embodiment, the rotation center of the container gear 301 is located so as to be concentric with the axis of the container opening 33*a*.

In the state in which the toner container 32 is held by the toner container holder 70 (the set state), the outer surface 33*b* of the container opening 33*a* serving as the container front end of the toner container 32 serves as the rotational shaft and is supported by the inner surface 615*a* of the container setting section 615 in the toner container 32, and the engaging openings 339*d* of the container engaging portions 339 are engaged with the replenishing device engaging members 78. The container gear 301 is arranged between the container engaging portions 339 and the container opening 33*a*.

The appearance of the toner container 32 will be described below with reference to FIG. 7 and FIG. 13 to FIG. 19.

Figure 13:
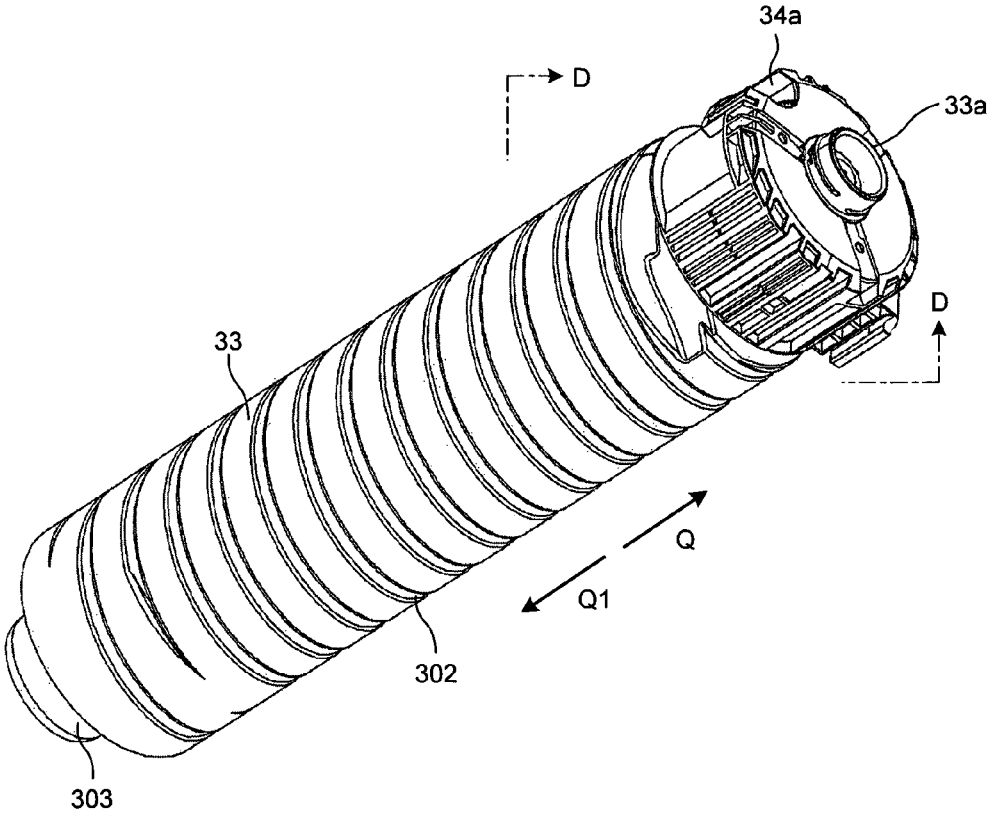
FIG. 13 is a perspective view for explaining an external appearance of the powder container according to the embodiments.
Figure 14:
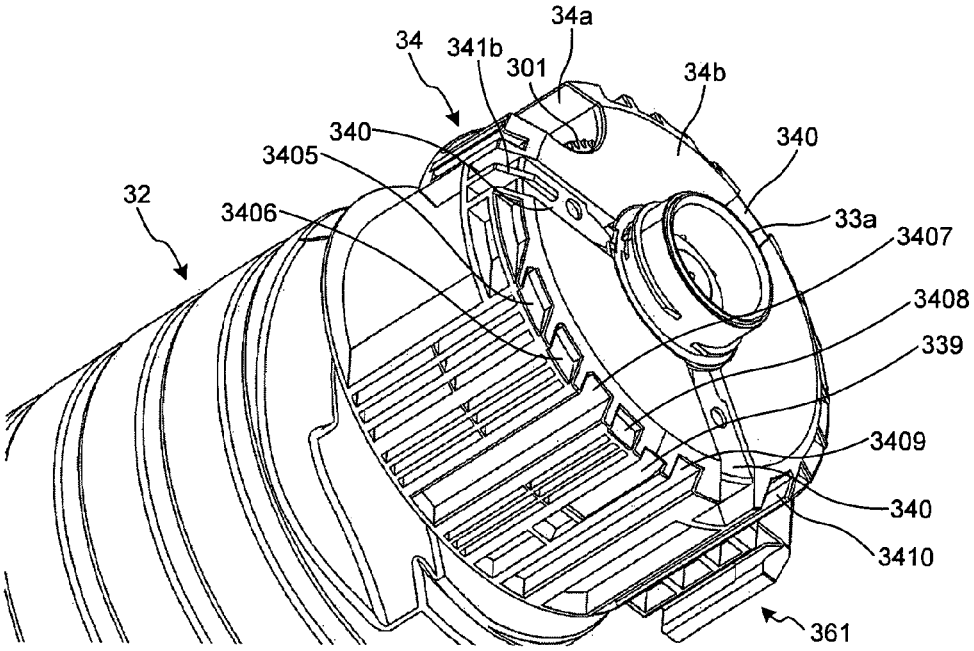
FIG. 14 is an enlarged perspective view of a D-D region illustrated in FIG. 13.
Figure 15:
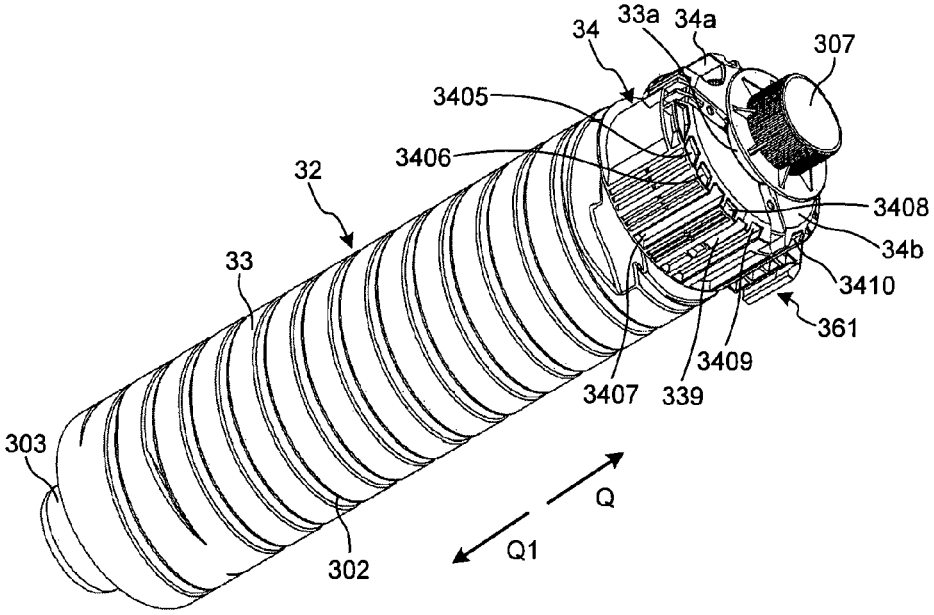
FIG. 15 is a perspective view for explaining a state in which a cap is attached to the powder container according to the embodiments.

When the toner container 32 is transported, a cap 307 serving as a seal to seal the container opening 33*a* as illustrated in FIG. 15 is attachable to the container opening 33*a* on the container front end as illustrated in FIG. 13 and FIG. 14. Therefore, it is possible to prevent unexpected communication between the outside and the inside, of the toner container 32, to thereby prevent toner leakage, deterioration of toner due to absorption of water from air into the toner, or the like.

When the toner container 32 is used for the first time, the cap 307 as described above is first detached. A state in which the cap 307 is detached and the container opening 33*a* is exposed is illustrated in FIGS. 7, 13, and 14.

Figure 16:
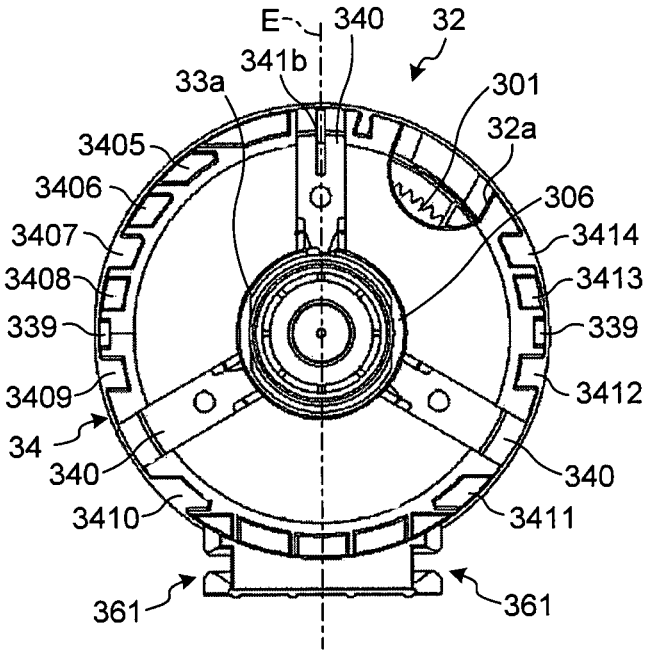
FIG. 16 is an enlarged view of the powder container according to the embodiments when viewed from a container front end cover side.
Figure 17A:
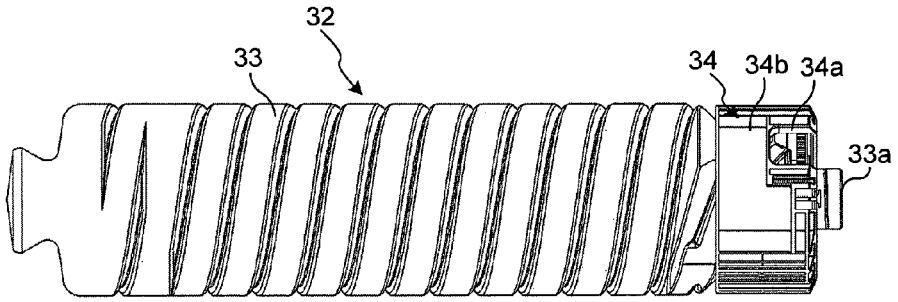
FIG. 17A is a plan view illustrating a configuration of the powder container according to the embodiments.
Figure 17B:
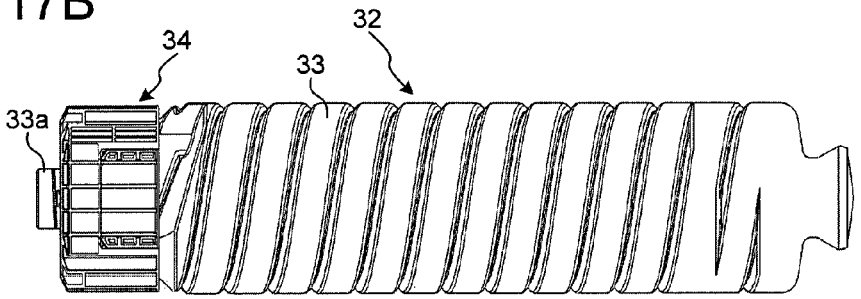
FIG. 17B is a bottom view of the powder container.
Figure 17C:
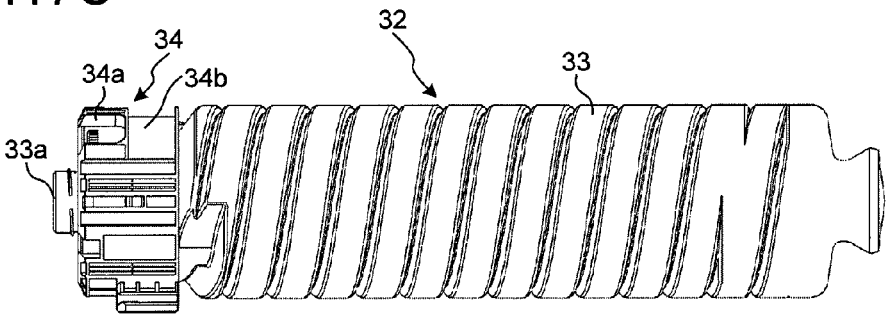
FIG. 17C is a right side view of the powder container.
Figure 17D:
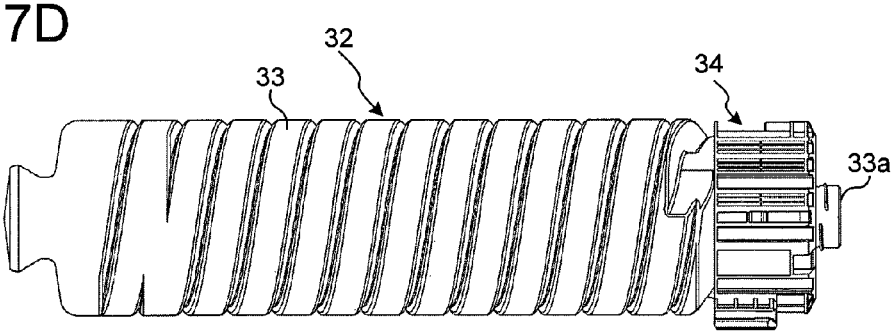
FIG. 17D is a left side view of the powder container.
Figure 18A:
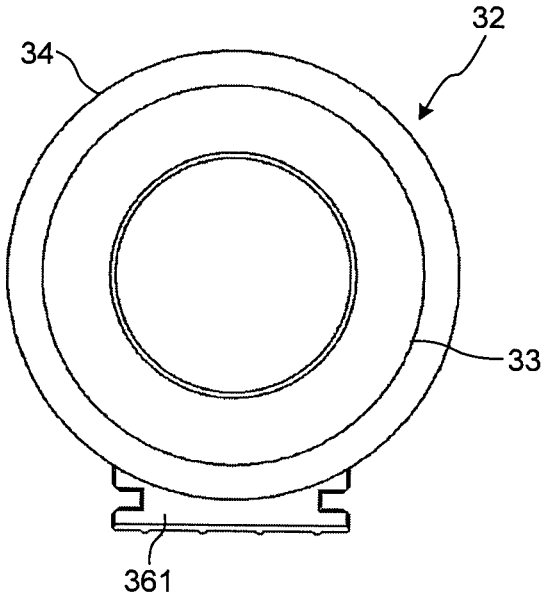
FIG. 18A is a back view illustrating the configuration of the powder container according to the embodiments.
Figure 18B:
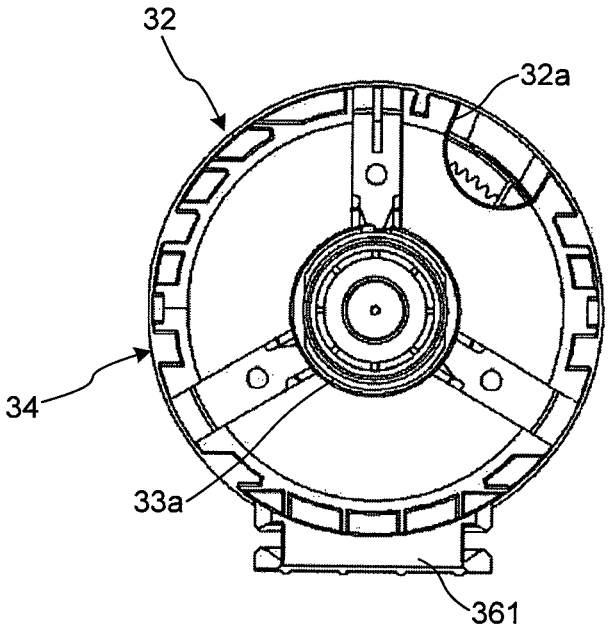
FIG. 18B is a front view of the powder container.

FIG. 13 is an explanatory perspective view of the toner container 32 viewed from obliquely below. FIG. 14 is an enlarged perspective view of a D-D region illustrated in FIG. 13. FIG. 15 is an explanatory perspective view illustrating a state in which the cap 307 is attached to the toner container 32 illustrated in FIG. 13. FIG. 16 is a view from the container front end cover 34 side. FIG. 17A is a plan view of the toner container 32 illustrated in FIG. 13. FIG. 17B is a bottom view of the toner container 32 illustrated in FIG. 13. FIG. 17C is a right side view of the toner container 32 illustrated in FIG. 13. FIG. 17D is a left side view of the toner container 32 illustrated in FIG. 13. FIG. 18A is a back view of the toner container 32 illustrated in FIG. 13. FIG. 18B is a front view of the toner container 32 illustrated in FIG. 13.

On the container front end cover 34 of the toner container 32, as illustrated in FIGS. 13 to 16, a plurality of identification grooves 3405 to 3414 are arranged in addition to the above described components. Among the identification grooves 3411 to 3420, as illustrated in FIG. 16, the identification grooves 3411 to 3414 are provided on the right side of the outer surface of the container front end cover 34 with respect to a virtual line E passing through the rotation center of the toner container 32 and a rib 341*b* of the cover hook 340. The rib 341*b* has a function to come in sliding contact with an upper part (ceiling surface) of the toner container holder 70 when the toner container 32 is attached to the copier 500 (the toner replenishing device 60 and the toner container holder 70) and stably maintain the posture of the toner container 32. Further, among the identification grooves 3405 to 3414, the identification grooves 3405 to 3410 are arranged on the left side of the outer surface of the container front end cover 34 with respect to the virtual line E in FIG. 16. In FIGS. 13, 14, and 15, reference signs of the identification grooves 3411 to 3414 are not illustrated because they are located on the rear side in the direction normal to the sheets of the figures.

Among the identification grooves 3405 to 3414, the identification grooves 3407, 3409, 3410, 3411, 3412, 3414 are grooves that linearly extend from the front surface 34*c* of the container front end cover 34 in the longitudinal direction of the toner container 32 (the detachment direction Q1), and are provided on an outer surface 34*b* of the container front end cover 34. Further, the identification grooves 3405, 3406, 3408, 3413 when viewed from front, are concave portions that are shallowly recessed from the front surface 34*c* toward the rear side in the figures relative to the identification grooves 3407, 3409, 3410, 3411, 3412, 3414. A grid-shaped rib with approximately the same height as the periphery of the outer surface 34*b* is arranged in each of the identification grooves. Therefore, the height of the periphery of the outer surface 34*b* of the container front end cover 34 varies in the circumferential direction because of the identification grooves 3405 to 3414 and the grid-shaped ribs arranged in the identification grooves. The grid-shaped ribs in the identification grooves are arranged in positions corresponding to types of toner or models of apparatuses to be attached. Therefore, by combinations of the positions at which the grid-shaped ribs arranged in the identification grooves 3405 to 3414 are provided in the circumferential direction, irregularities corresponding to the types of toner or the models of apparatuses to be attached are formed, and the grid-shaped ribs function to provide information, such as the type of the toner container 32, to the copier 500 (the toner replenishing device 60 and the toner container holder 70).

As illustrated in FIG. 16, the container engaging portions 339 are arranged at symmetric positions, which are separated by 180 degrees, with respect to the virtual line E, and have functions to engage the copier 500 (the toner replenishing device 60 and the toner container holder 70) and the toner container 32 when the toner container 32 is attached to the copier 500 (the toner replenishing device 60 and the toner container holder 70). The container gear 301 has a function to mesh with the gear 601 on the copier 500 (the toner replenishing device 60 and the toner container holder 70) after the toner container 32 is attached to the copier 500 (the toner replenishing device 60 and the toner container holder 70), and appropriately and automatically rotate the cylindrical container body 33 of the toner container 32.

FIGS. 17A to 17D and FIGS. 18A and 18B are six views of the toner container 32. However, the external shape of the container front end cover 34 varies depending on the color of toner or an apparatus to which the toner container 32 is attached; therefore, the six views are not the same for all of the toner containers 32.

Figure 19:
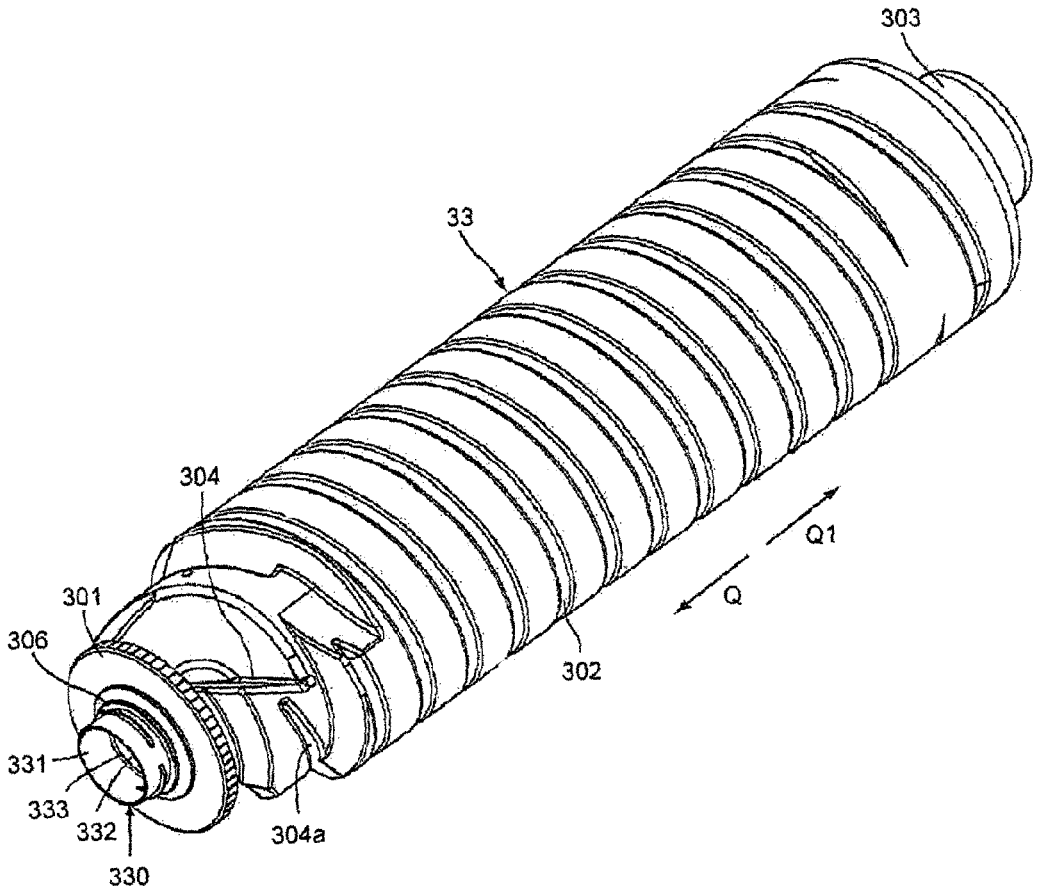
FIG. 19 is an enlarged perspective view for explaining a configuration of the container body of the powder container according to the embodiments.

FIG. 19 is an explanatory perspective view of the container body 33 from which the container front end cover 34 on the front end of the toner container 32 is detached. As illustrated in FIG. 19, the spiral rib 304*a* in a spiral shape is provided on the inner periphery of the scooping portion 304 in order to convey the internally-located toner, similarly to the spiral rib 302.

The nozzle receiver 330 attached to the container body 33 will be described below.

Figure 20:
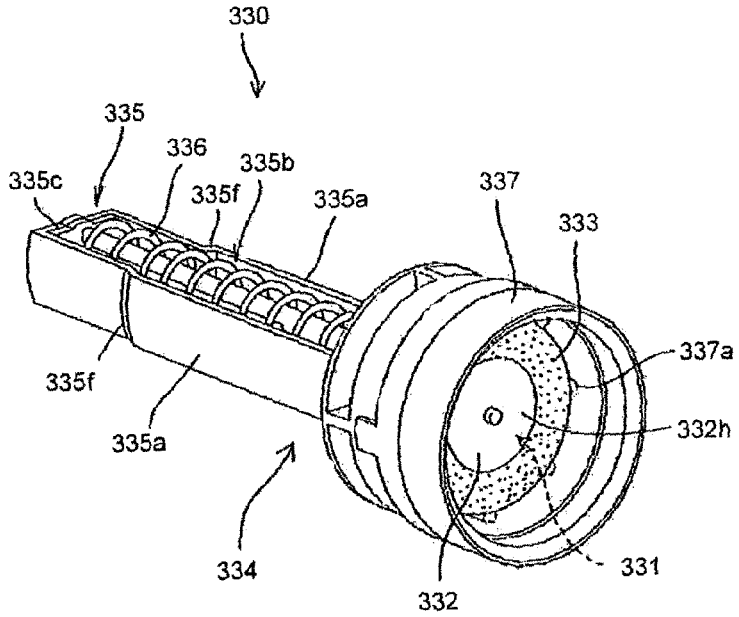
FIG. 20 is an explanatory perspective view of a nozzle receiver when viewed from a container front side.
Figure 21:
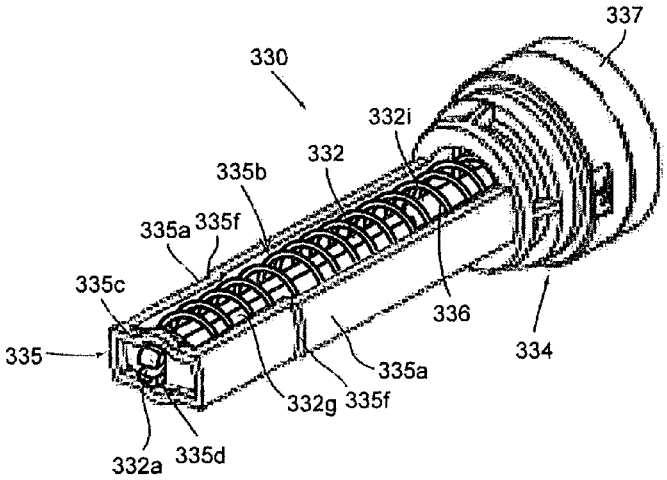
FIG. 21 is an explanatory perspective view of the nozzle receiver when viewed from a container inner side.
Figure 22:
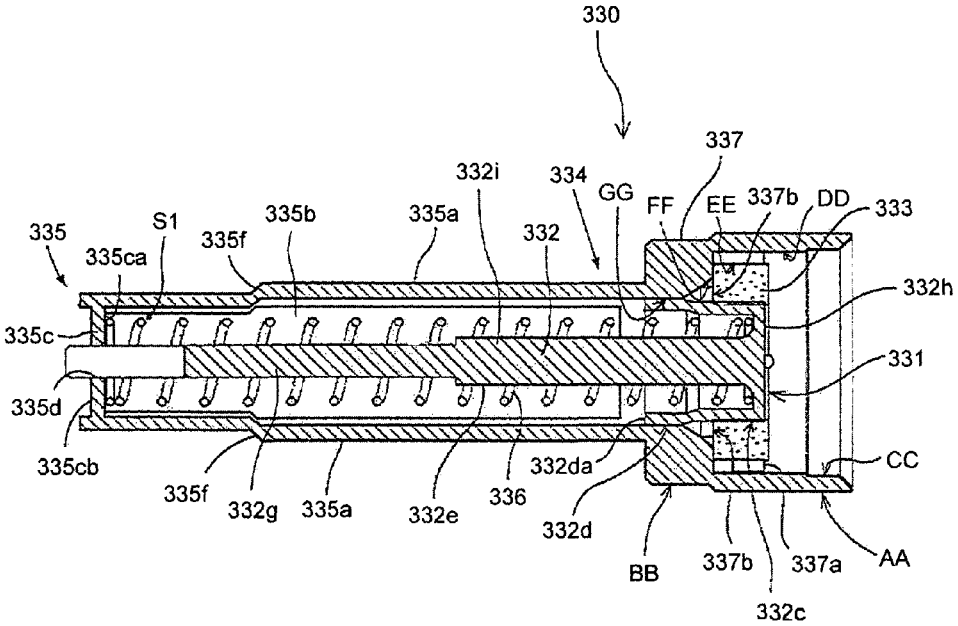
FIG. 22 is a cross-sectional view for explaining a configuration of the nozzle receiver.

As illustrated in FIGS. 20 to 22, the nozzle receiver 330 is arranged on the toner container 32, and includes the receiving opening 331 serving as a nozzle insertion opening. The conveying nozzle 611 for conveying toner supplied from the toner container 32 in the image forming apparatus is inserted in the receiving opening 331. The nozzle receiver 330 includes the container shutter 332 serving as an opening/closing member, a container seal 333 serving as a seal, a container shutter supporter 334 serving as a supporter, a container shutter spring 336 serving as a biasing member, and the nozzle receiver attachment portion 337. The container shutter 332 is inserted in and supported by the container shutter supporter 334 in a reciprocating manner so as to move to the opening position to open the receiving opening 331 by being pressed with insertion of the conveying nozzle 611, and to move a closing position to close the receiving opening 331 with removal of the conveying nozzle 611. Namely, the container shutter supporter 334 supports the container shutter 332 to guide the movement to the opening position and the closing position. The container shutter spring 336 is a coil spring that is arranged inside the container shutter supporter 334 and biases the container shutter 332 toward the closing position.

The container shutter supporter 334 includes a shutter rear end supporting portion 335 as a shutter rear portion, a pair of shutter side supporting portions 335*a* as shutter side portions, the openings of shutter supporting portion 335*b* as side openings, and the nozzle receiver attachment portion 337. The shutter side supporting portions 335*a* are arranged so as to face each other, and extend along the moving direction of the container shutter 332. One ends of the shutter side supporting portions 335*a* are connected by the shutter rear end supporting portion 335, and the other ends are connected to the cylindrical nozzle receiver attachment portion 337. The shutter side supporting portions 335*a* and the openings of shutter supporting portion 335*b* are arranged adjacent to each other in the rotation direction of the toner container. Namely, the container shutter supporter 334 has a shape in which cylindrical portions corresponding to the shutter side supporting portions 335*a* from the nozzle receiver attachment portion 337 side to the shutter rear end supporting portion 335 are vertically cut out along the moving direction of the container shutter 332, and the openings of shutter supporting portion 335*b* are provided in the cutout portions. The container shutter supporter 334 is configured such that the container shutter 332 can move along the insertion direction of the conveying nozzle 611 in a space S1. The space S1 is enclosed by the pair of the shutter side supporting portions 335*a*, the shutter rear end supporting portion 335, and the nozzle receiver attachment portion 337. In other words, the container shutter supporter 334 is configured to be able to guide the movement of the container shutter 332 to the opening position to open the receiving opening 331 and the closing position to close the receiving opening 331.

Figure 23:
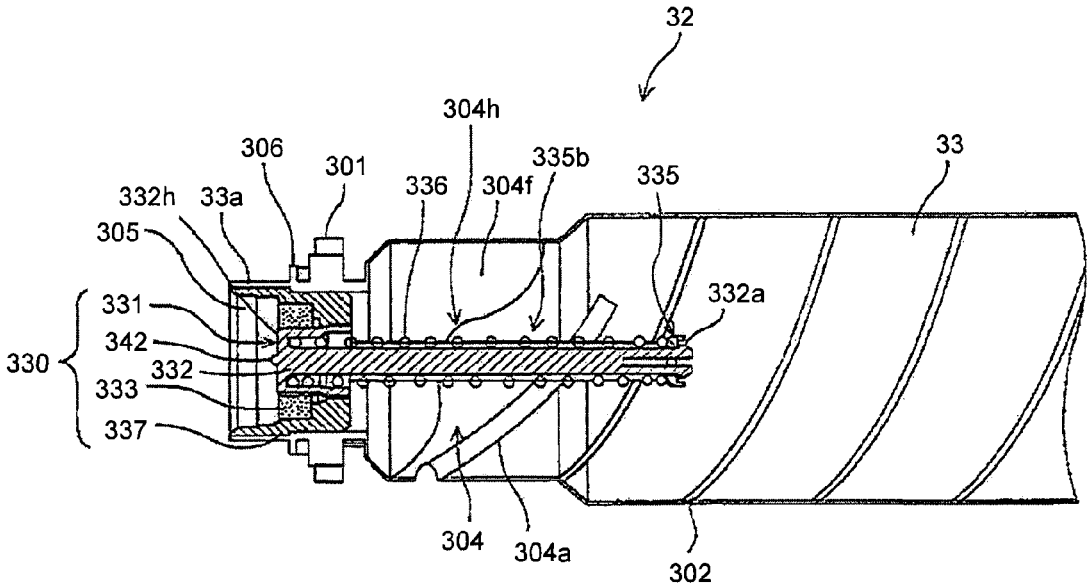
FIG. 23 is an explanatory cross-sectional view of the powder container in which the nozzle receiver is attached to the container body.

As illustrated in FIG. 23, the nozzle receiver 330 attached to the container body 33 rotates with the container body 33 when the container body 33 rotates. At this time, the shutter side supporting portions 335*a* of the nozzle receiver 330 rotate around the conveying nozzle 611 of the toner replenishing device 60. Therefore, the shutter side supporting portions 335*a* being rotated alternately pass a space just above the nozzle hole 610 provided in the upper side of the conveying nozzle 611. Consequently, even if toner is instantaneously accumulated above the nozzle hole 610, because the shutter side supporting portions 335*a* cross the accumulated toner and alleviate the accumulation, it becomes possible to prevent cohesion of the accumulated toner when the apparatus is not used and prevent a toner conveying failure when the apparatus is resumed. In contrast, when the shutter side supporting portions 335*a* are located on the sides of the conveying nozzle 611 and the nozzle hole 610 and the opening of shutter supporting portion 335*b* face each other, toner in the container body 33 is supplied to the conveying nozzle 611 as indicated by an arrow β in FIG. 8.

As illustrated in FIG. 22, the container shutter 332 includes a front cylindrical portion 332*c* serving as a closure, a slide area 332*d*, a guiding rod 332*e* serving as an elongated portion, and shutter hooks 332*a*. The front cylindrical portion 332*c* is a container front end portion to be tightly fitted to a cylindrical opening (the receiving opening 331) of the container seal 333. The slide area 332*d* is a cylindrical portion serving as a gliding portion or a sealing portion, which is provided on the container rear end relative to the front cylindrical portion 332*c*. The slide area 332*d* has an outer diameter slightly greater than that of the front cylindrical portion 332*c*, slides on the inner surfaces of the pair of the shutter side supporting portions 335*a*, and seals the receiving opening 331.

The guiding rod 332*e* is a cylinder that stands from the inner side of the cylinder of the front cylindrical portion 332*c* toward the container rear end, and serves a rod portion that prevents the container shutter spring 336 from being buckled when the guiding rod 332*e* is inserted to the inside of the coil of the container shutter spring 336. A guiding rod sliding portion 332*g*, serving as a flat guiding portion, includes a pair of flat surfaces that are provided on both sides across the central axis of the cylindrical guiding rod 332*e* from the middle of the guiding rod 332*e*. The container rear end of the guiding rod sliding portion 332*g* is bifurcated into a pair of cantilevers as illustrated in FIGS. 21 and 23. The shutter hooks 332*a* are provided on ends of the cantilevers opposite to the base from which the guiding rod 332*e* stands, and form an engaging portion to be hooked on the container shutter supporter 334. The shutter hooks 332*a* and the guiding rod sliding portion 332*g* are inserted in a rear end opening 335*d* serving as a through hole provided on the shutter rear end supporting portion 335, and the shutter hooks 332*a* are hooked on the rear end opening 335*d*, so that the shutter hooks 332*a* and the guiding rod sliding portion 332*g* serve as a pair of hooks that prevent the container shutter 332 from coming off from the container shutter supporter 334.

A front end of the container shutter spring 336 abuts against an inner wall surface of the front cylindrical portion 332*c*, and a rear end of the container shutter spring 336 abuts against an inner wall surface 335*ca* that is an opposite surface of the shutter rear end supporting portion 335. At this time, the container shutter spring 336 is in a compressed state, so that the container shutter 332 receives a biasing force in a direction away from the shutter rear end supporting portion 335 (to the right or toward the container front end in FIG. 22). However, the shutter hooks 332*a* provided on the container rear end of the container shutter 332 are hooked on the rear end opening 335*d* of the shutter rear end supporting portion 335. Therefore, the container shutter 332 is prevented from moving further in the direction away from the shutter rear end supporting portion 335 in the state illustrated in FIG. 22.

Due to the hooked state between the shutter hooks 332*a* and the shutter rear end supporting portion 335 and the biasing force of the container shutter spring 336, the position of the container shutter 332 is determined. Specifically, the positions of the front cylindrical portion 332*c* and the container seal 333 in the axial direction, both of which have a toner leakage preventing function of the container shutter 332, are determined relative to the container shutter supporter 334. Therefore, it becomes possible to determine the positions of the front cylindrical portion 332*c* and the container seal 333 so that they can be fitted to each other, enabling to prevent toner leakage.

As illustrated in FIG. 22, the nozzle receiver attachment portion 337 is in the form of a cylinder, the outer diameter and the inner diameter of which are reduced in a stepped manner toward the container rear end. The diameters are gradually reduced from the container front end to the container rear end. As illustrated in FIG. 22, two outer diameter portions (outer surfaces AA and BB located in this order from the container front end) are provided on the outer surface, and five inner diameter portions (inner surfaces CC, DD, EE, FF, and GG located in this order from the container front end) are provided on the inner surface. The outer surfaces AA and BB on the outer surface are connected by a tapered surface at their boundary. Similarly, the fourth inner diameter portion FF and the fifth inner diameter portion GG on the inner surface are connected by a tapered surface at their boundary. The inner diameter portion FF on the inner surface and the connected tapered surface correspond to a seal jam preventing space 337*b* to be described later, and the ridge lines of these surfaces correspond to sides of a pentagonal cross-section to be described later.

As illustrated in FIG. 22, the pair of the shutter side supporting portions 335*a*, which face each other and which have flake shapes obtained by cutting a cylinder in the axial direction, protrude from the nozzle receiver attachment portion 337. The ends of the two shutter side supporting portions 335*a* on the container rear side are connected by the shutter rear end supporting portion 335. The nozzle receiver attachment portion 337 includes the inner diameter portion GG, which is the fifth portion from the front end, as a cylindrical inner surface having the same inner diameter as the diameter of the slide area 332*d* of the container shutter 332. The third inner surface EE of the nozzle receiver attachment portion 337 is a virtual periphery that passes through longitudinal tips of nozzle shutter positioning ribs 337*a* that are equally spaced at 45°. The container seal 333 with a quadrangular cylindrical (cylindrical tube shaped) cross section (the cross section in the cross-sectional view in FIG. 22) is arranged so as to correspond to the inner surface EE. The container seal 333 is fixed to a vertical surface connecting the third inner surface EE and the fourth inner surface FF with adhesive agent, double-stick tape, or the like. The exposed surface of the container seal 333 opposite to the attachment surface (the right side in FIG. 22) serves as an inner bottom of the cylindrical opening of the cylindrical nozzle receiver attachment portion 337 (the container opening).

Further, as illustrated in FIG. 22, the seal jam preventing space 337*b* (a catch preventing space) is provided so as to correspond to the inner surface FF of the nozzle receiver attachment portion 337 and the connected tapered surface. The seal jam preventing space 337*b* is a ring-shaped sealed space enclosed by three different parts. Specifically, the seal jam preventing space 337*b* is a ring-shaped space enclosed by the inner surface (the fourth inner surface FF and the connected tapered surface) of the nozzle receiver attachment portion 337, the vertical surface on the attachment side of the container seal 333, and the outer surface from the front cylindrical portion 332*c* to the slide area 332*d* of the container shutter 332. A cross section of the ring-shaped space is in the form of a pentagon. The angle between the inner surface of the nozzle receiver attachment portion 337 and the end surface of the container seal 333 and the angle between the outer surface of the container shutter 332 and the end surface of the container seal 333 are 90°.

Functions of the seal jam preventing space 337*b* will be described below. When the container shutter 332 moves toward the container rear end from the state in which the receiving opening 331 is closed by the container shutter 332, the inner surface of the container seal 333 slides against the front cylindrical portion 332*c* of the container shutter 332. Therefore, the inner surface of the container seal 333 is pulled by the container shutter 332 and elastically deformed so as to move toward the container rear end. At this time, if the seal jam preventing space 337*b* is not provided and the vertical surface (the attachment surface of the container seal 333) continuing from the third inner surface is connected to the fifth inner surface GG so as to be perpendicular to each other, the following situation may occur. Specifically, the elastically-deformed portion of the container seal 333 may be caught between the inner surface of the nozzle receiver attachment portion 337 sliding against the container shutter 332 and the outer surface of the container shutter 332, resulting in causing a jam. If the container seal 333 is jammed in the portion where the nozzle receiver attachment portion 337 and the container shutter 332 slide against each other, that is, between the front cylindrical portion 332*c* and the inner surface GG, the container shutter 332 is firmly attached to the nozzle receiver attachment portion 337, so that the receiving opening 331 may not be opened and closed.

In contrast, the nozzle receiver 330 according to the first embodiment is provided with the seal jam preventing space 337*b* in the inner area thereof. The inner diameter of the seal jam preventing space 337*b* (the inner diameter of each of the inner surface EE and the connected tapered surface) is smaller than the outer diameter of the container seal 333. Therefore, the entire container seal 333 can hardly be entered into the seal jam preventing space 337*b*. Further, an area of the container seal 333 to be elastically deformed by being pulled by the container shutter 332 is limited, and the container seal 333 can be restored by its own elasticity before the container seal 333 is brought to and jammed at the inner surface GG. With this action, it becomes possible to prevent a situation in which the receiving opening 331 cannot be opened and closed because of the attached state between the container shutter 332 and the nozzle receiver attachment portion 337.

As illustrated in FIGS. 20 and 22, the multiple nozzle shutter positioning ribs 337*a* are provided so as to radially extend on the inner surface of the nozzle receiver attachment portion 337 that comes in contact with the outer periphery of the container seal 333. When the container seal 333 is attached to the nozzle receiver attachment portion 337, the vertical surface of the container seal 333 on the container front side slightly protrudes relative to the front ends of the nozzle shutter positioning ribs 337*a* in the rotation axis direction.

As illustrated in FIG. 8, when the toner container 32 is attached to the toner replenishing device 60, the nozzle shutter flange 612*a* of the nozzle shutter 612 of the toner replenishing device 60 presses and deforms the protruding portion of the container seal 333 by being biased by a nozzle shutter spring 613. The nozzle shutter flange 612*a* further moves inward and abuts against the container front ends of the nozzle shutter positioning ribs 337*a*, thereby covering and sealing the front end surface of the container seal 333 from the outside of the container. Therefore, it becomes possible to ensure the sealing performance in the periphery of the conveying nozzle 611 at the receiving opening 331 in the attached state, enabling to prevent toner leakage.

The back side of a biased surface 612*f* of the nozzle shutter flange 612*a* biased by the nozzle shutter spring 613 abuts against the nozzle shutter positioning ribs 337*a*, so that the position of the nozzle shutter 612 relative to the toner container 32 in the rotation axis direction is determined. Therefore, a positional relationship of the front end surface of the container seal 333, the front end surface of a front end opening 305 (an inner space of the cylindrical nozzle receiver attachment portion 337 arranged in the container opening 33*a* as will be described later), and the nozzle shutter 612 in the rotation axis direction is determined.

Figure 24A:
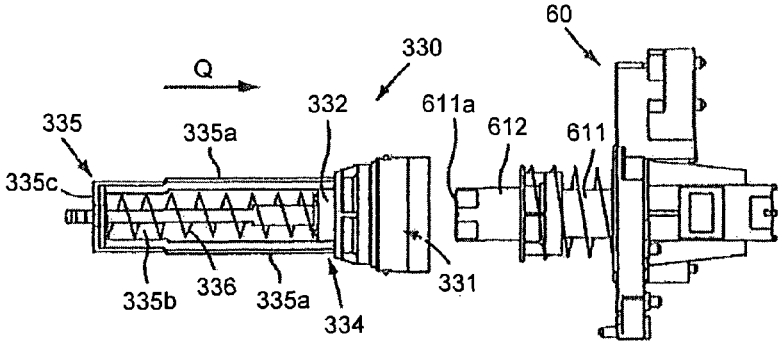
FIGS. 24A to 24D are top plan views for explaining states of an opening/closing member and a conveying nozzle in attachment operation.
Figure 24B:
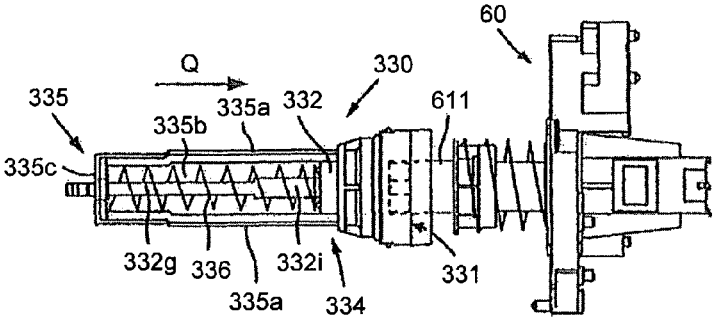
Figure 24C:
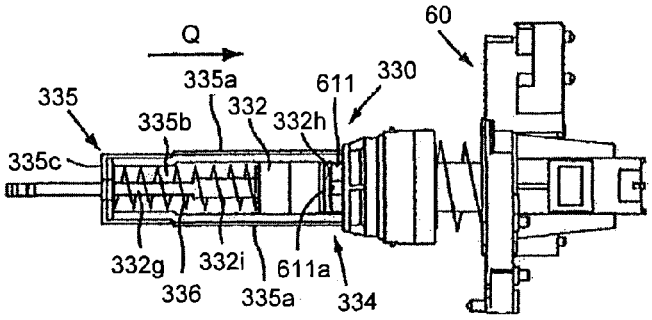
Figure 24D:
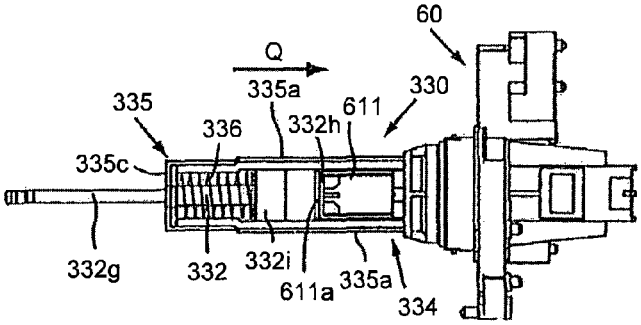
Figure 25:
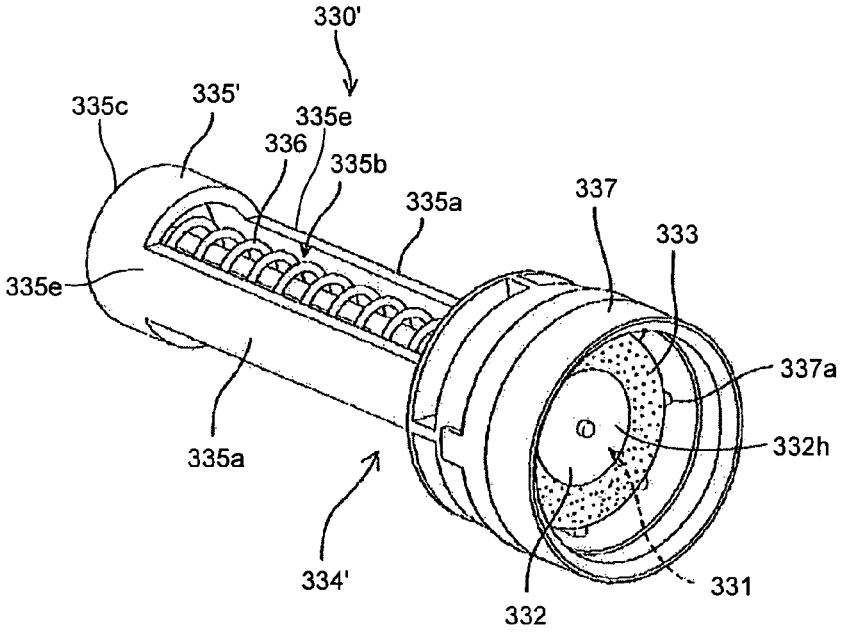
FIG. 25 is an explanatory perspective view illustrating a configuration of a conventional nozzle receiver.
Figure 26:
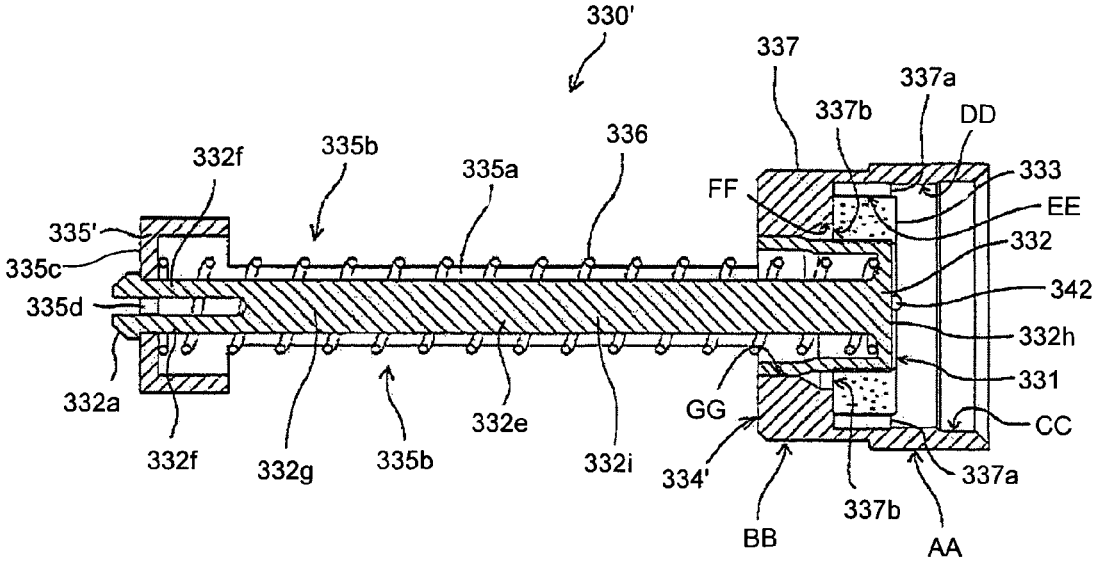
FIG. 26 is a cross-sectional view illustrating the configuration of the conventional nozzle receiver.
Figure 27A:
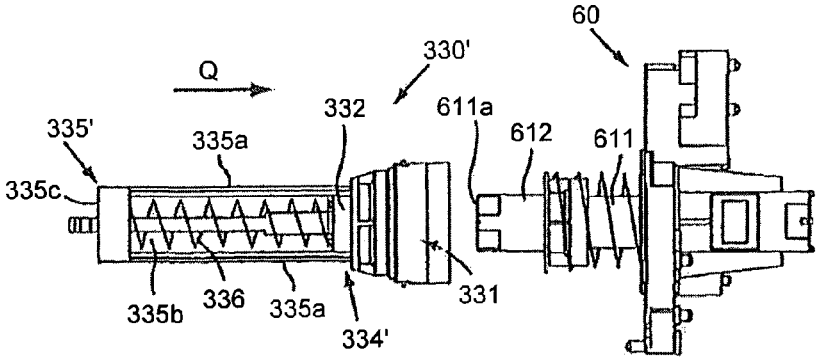
FIGS. 27A to 27D are bottom plan views for explaining states of a conventional opening/closing member and the conventional conveying nozzle in attachment operation.
Figure 27B:
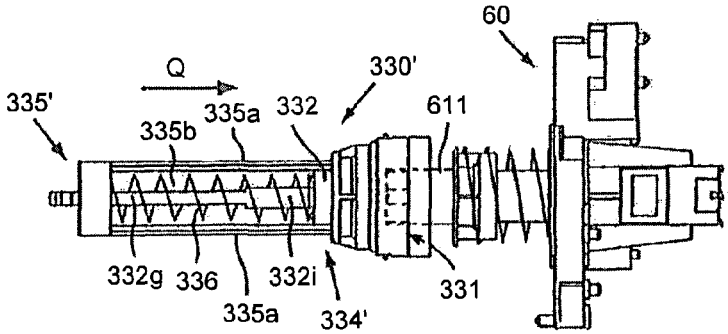
Figure 27C:
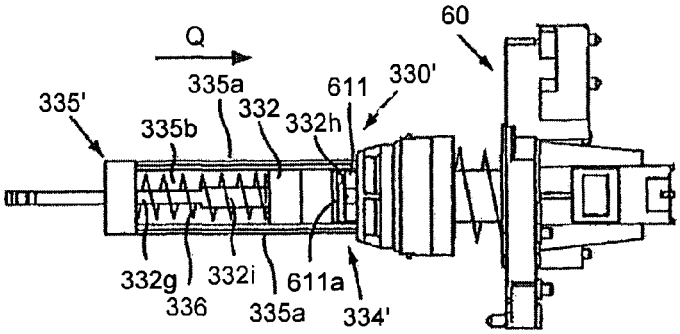
Figure 27D:
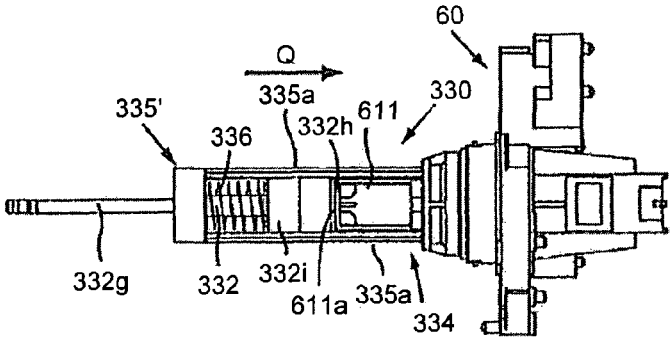

The operation of the container shutter 332 and the conveying nozzle 611 will be described below with reference to FIGS. 1, 8, and 24A to 24D. Before the toner container 32 is attached to the toner replenishing device 60, as illustrated in FIG. 1, the container shutter 332 is biased by the container shutter spring 336 toward the closing position so as to close the receiving opening 331. The appearance of the container shutter 332 and the conveying nozzle 611 at this time is illustrated in FIG. 24A. When the toner container 32 is attached to the toner replenishing device 60, as illustrated in FIG. 24B, the conveying nozzle 611 is inserted in the receiving opening 331. When the toner container 32 is further pushed into the toner replenishing device 60, an end surface 332*h* of the front cylindrical portion 332*c*, which serves as an end surface of the container shutter 332 (hereinafter, referred to as "the end surface 332*h* of the container shutter") and an end surface 611*a* located in the insertion direction of the conveying nozzle 611 (hereinafter, referred to as "the front end (end surface) 611*a* of the conveying nozzle") come in contact with each other. When the toner container 32 is further pushed from the state as described above, the container shutter 332 is pushed as illustrated in FIG. 24C. Accordingly, as illustrated in FIG. 24D, the conveying nozzle 611 is inserted in the shutter rear end supporting portion 335 from the receiving opening 331. Therefore, as illustrated in FIG. 8, the conveying nozzle 611 is inserted in the container body 33 and located at the set position. At this time, as illustrated in FIG. 24D, the nozzle hole 610 is located at a position overlapping the opening of shutter supporting portion 335*b*.

Subsequently, when the container body 33 rotates, toner scooped up above the conveying nozzle 611 by the scooping portions 304 falls in and is introduced into the conveying nozzle 611 via the nozzle hole 610. The toner introduced into the conveying nozzle 611 is conveyed inside the conveying nozzle 611 toward the toner dropping passage 64 along with the rotation of the conveying screw 614. Subsequently, the toner falls in and is supplied to the developing device 50 through the toner dropping passage 64.

A configuration of a conventional nozzle receiver 330' will be described below with reference to FIGS. 25, 26, and 27A to 27D. The same components as those of the nozzle receiver 330 of the first embodiment are denoted by the same reference symbols.

Toner stored in the toner container 32 serving as a toner bottle contains air and has predetermined fluidity just after the toner is sealed in the toner container 32. However, the toner in the toner container 32 is gradually deaerated and the fluidity is reduced during transportation or storage. Therefore, it is preferable to shake the toner container 32 to mix the internal toner and air to thereby obtain the predetermined fluidity just before the toner container 32 is attached to the copier 500.

Figure 29A:
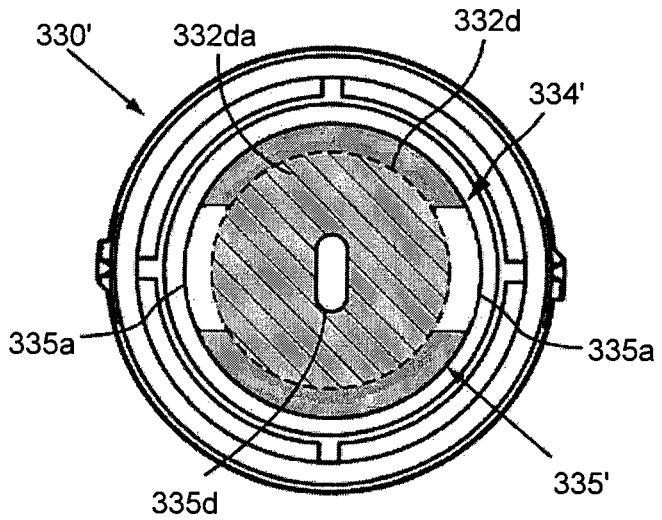
FIG. 29A is a diagram illustrating a relationship between a projected area of a conventional container shutter supporter and a projected area of the conventional opening/closing member for comparison between the conventional container shutter supporter and the container shutter supporter according to the embodiments.

However, in some cases, the toner container 32 may be inserted without being shaken just before the toner container 32 is attached to the copier 500. In this case, as illustrated in FIGS. 27A to 27D, when the conveying nozzle 611 is inserted in the nozzle receiver 330', the container shutter 332 starts to move. At this time, toner with the reduced fluidity remains in the space S1, which is defined by the two shutter side supporting portions 335*a* of the container shutter supporter 334' that guides the container shutter 332 and by the shutter rear end supporting portion 335' of the container shutter supporter 334' and in which the container shutter spring 336 is held. Further, in the conventional configuration, as illustrated in FIG. 29A, the shutter rear end supporting portion 335' is formed in a cylindrical shape, and the projection area of the shutter rear end supporting portion 335' is greater than the projection area of a rear end surface 332*da* of the slide area 332*d* of the container shutter 332; therefore, toner is likely to be accumulated in the cylindrical portion. Further, as illustrated in FIG. 29A, the projection area, which is indicated by the gray-shaded area, of an end surface portion 335*c* of the supporter from which the portions 335*e* connected to the two shutter side supporting portions 335*a* are excluded is made nearly equal to or slightly larger than the projection area in the same direction, which is indicated by the hatched area, of the rear end surface 332*da* of the slide area 332*d* of the container shutter 332. Therefore, the toner is pressed between the rear end surface 332*da* of the slide area 332*d* of the container shutter 332 and an opposite surface of the nozzle receiver 330' facing the shutter rear end supporting portion 335'.

At this time, if the toner has the predetermined fluidity, the toner can move away from the openings of shutter supporting portion 335*b'*. By contrast, when the fluidity is low, such as when the toner container 32 is inserted without being shaken, the toner is pressed and compressed between the rear end surface 332*da* of the slide area 332*d* of the container shutter 332 and the opposite surface of the container shutter supporter 334' (the nozzle receiver 330') facing the shutter rear end supporting portion 335' as described above. When the toner container 32 is further pushed, the compressed toner enters between the slide area 332*d* of the container shutter 332 and the two shutter side supporting portions 335*a* of the container shutter supporter 334' (the nozzle receiver 330'). If the compressed and cohered toner enters between the slide area 332*d* of the container shutter 332 and the two shutter side supporting portions 335*a* of the container shutter supporter 334' (the nozzle receiver 330') as described above, the container shutter 332 is prevented from returning to the closing position when the toner container 32 is detached from the copier 500. Consequently, the toner container 32 may be detached while the receiving opening 331 remains open, resulting in toner leakage.

First Example

Figure 28A:
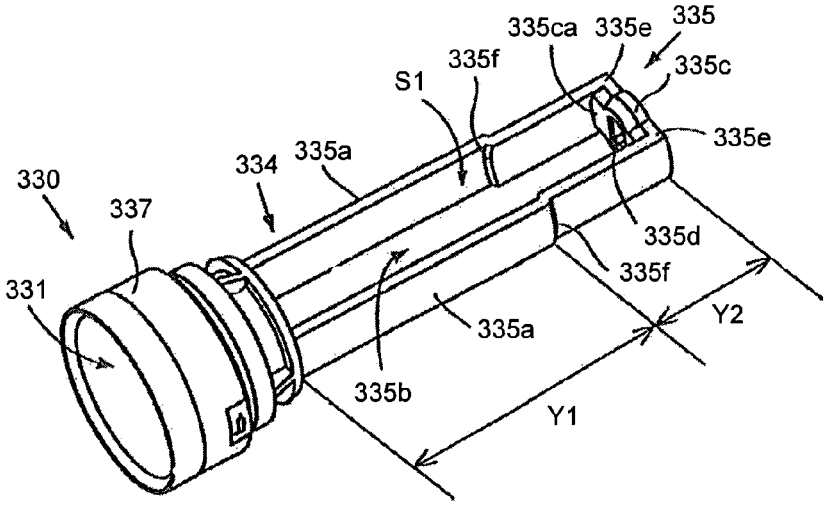
FIG. 28A is a perspective view illustrating a configuration of a container shutter supporter according to the embodiments when viewed from a conveying nozzle insertion side.
Figure 28B:
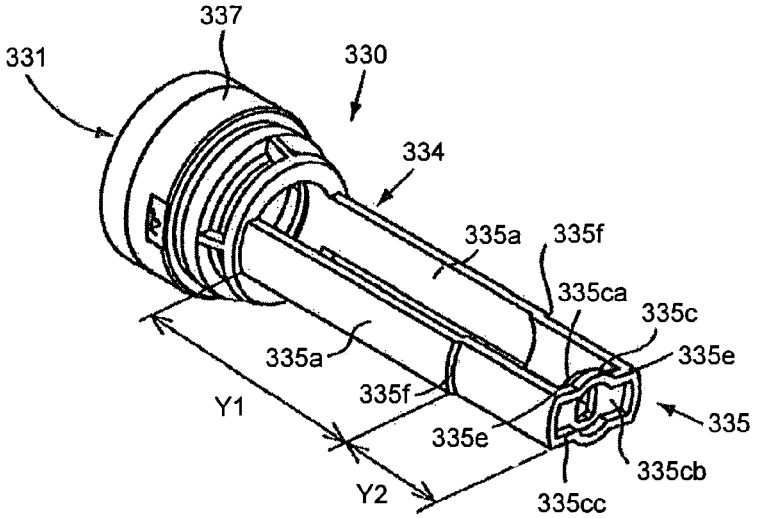
FIG. 28B is a perspective view of the container shutter supporter viewed from a side opposite to the conveying nozzle insertion side.
Figure 29B:
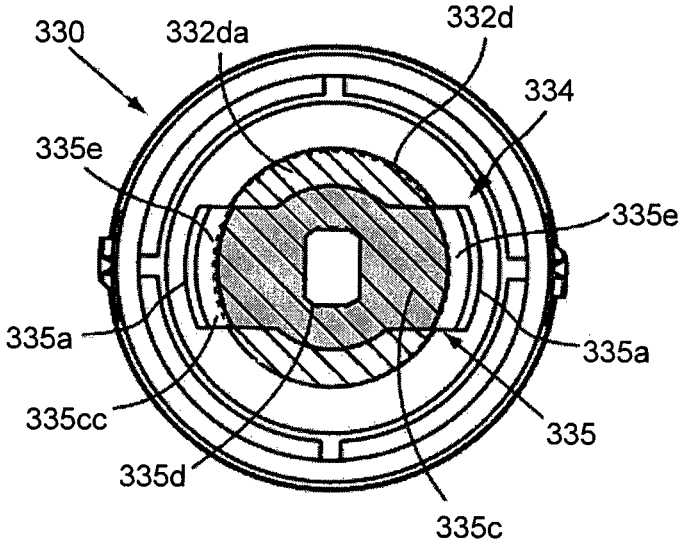
FIG. 29B is a diagram illustrating a relationship between a projected area of the container shutter supporter and a projection area of the opening/closing member according to the embodiments for comparison between the conventional container shutter supporter and the container shutter supporter according to the embodiments.

In a first example of the first embodiment, as illustrated in FIGS. 28A, 28B, and 29B, the container shutter supporter 334 of the nozzle receiver 330 is configured as described below. Specifically, the end surface portion 335*c*, which serves as the end surface portion of supporter, is provided on the shutter rear end supporting portion 335 of the container shutter supporter 334. At the end surface portion 335*c*, portions other than the portions 335*e* connected to the two shutter side supporting portions 335*a* are opened. Namely, when the portions 335*e* is on both side of the end surface portion 335*c* in the horizontal direction, the portions other than the portions 335*e* are opened in the vertical direction. The end surface portion 335*c* is an opposite portion facing the rear end surface 332*da* of the slide area 332*d*.

Specifically, the container shutter 332 includes the guiding rod 332*e* serving as an elongated portion extending toward the end surface portion 335*c* serving as the end surface portion of supporter.

The shutter rear end supporting portion 335 includes the end surface portion 335*c*, which is a portion facing the rear end surface 332*da* of the slide area 332*d*, and includes the rear end opening 335*d* provided on the end surface portion 335*c*. The end surface portion 335*c* is integrally formed with the two shutter side supporting portions 335*a*, and the portions other than the portions 335*e* connected to the shutter side supporting portions 335*a* are opened. As illustrated in FIG. 29B, the shutter rear end supporting portion 335 is configured such that, within the projection area in the direction perpendicular to the moving direction of the container shutter 332 of the shutter rear end supporting portion 335, the projection area, which is indicated by the gray-shaded area, of the end surface portion 335*c* of the supporter from which the portions 335*e* connected to the two shutter side supporting portions 335*a* are excluded is smaller than the projection area in the same direction, which is indicated by the hatched area, of the rear end surface 332*da* of the slide area 332*d* of the container shutter 332.

If the shutter rear end supporting portion 335 of the container shutter supporter 334 of the nozzle receiver 330 is configured as described above, the following advantage is achieved. Even when the container shutter 332 moves with insertion of the conveying nozzle 611, and then toner is moved by the rear end surface 332*da* of the slide area 332*d* of the container shutter 332, a first part of the toner moves to the inside of the toner container 32 without being compressed. The first part of the toner is toner moved by a region, which is of the rear end surface 332*da* of the slide area 332*d* of the container shutter 332 and which does not overlap with the end surface portion 335*c* in the moving direction of the container shutter 332. Further, a second part of the toner can easily move away from the opening of shutter supporting portion 335*b* because the first part of the toner located nearby is moved. The second part of the toner is toner moved by a region, which is of the rear end surface 332*da* of the slide area 332*d* of the container shutter 332 and which overlaps with the end surface portion 335*c* in the moving direction of the container shutter 332.

If the area of the shutter rear end supporting portion 335 facing the rear end surface 332*da* of the slide area 332*d* of the container shutter 332 is reduced, and even when the toner container 32 is attached to the copier 500 while the fluidity of toner is low, that is, even when the toner container 32 is attached without being shaken, it is possible to reduce the possibility that the toner is pressed between the rear end surface 332*da* of the slide area 332*d* of the container shutter 332 and the end surface portion 335*c* of the shutter rear end supporting portion 335 of the container shutter supporter 334 of the nozzle receiver 330.

Meanwhile, the end surface portion 335*c* of the shutter rear end supporting portion 335 functions as a bottom portion serving as a receiver of the container shutter spring 336 that biases the container shutter 332 toward the closing position. As illustrated in FIGS. 24B to 24D, in the process of attaching the toner container 32, in which the container shutter 332 moves along with insertion of the conveying nozzle 611 and the container shutter spring 336 is compressed, the end surface portion 335*c* receives the restoring force of the container shutter spring 336. Therefore, if the area of the end surface portion 335*c* of the shutter rear end supporting portion 335 is excessively reduced, the strength of the container shutter supporter 334 is reduced. If the strength is reduced, components may be broken during the process of attaching the toner container 32.

Figure 30A:
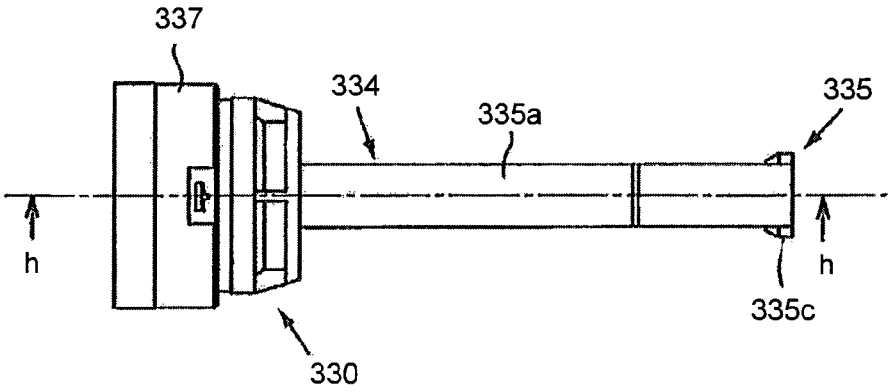
FIG. 30A is a plan view for explaining a configuration of a container shutter supporter according to a first example of a first embodiment.
Figure 30B:
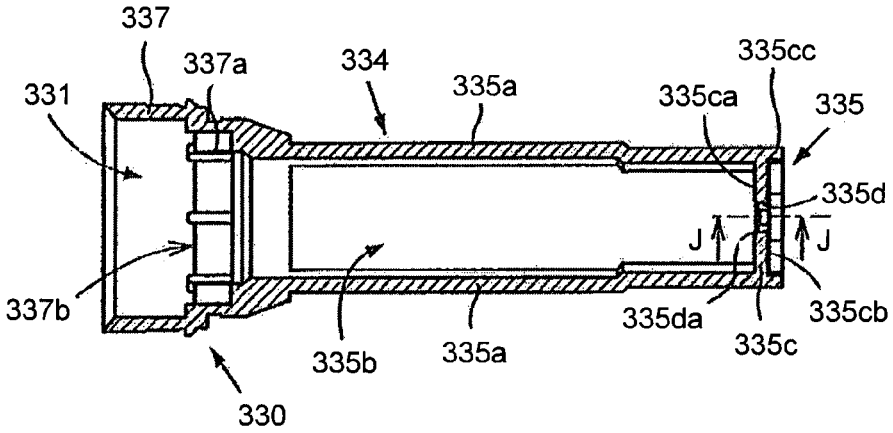
FIG. 30B is a cross-sectional view of the container shutter supporter illustrated in FIG. 30A.
Figure 30C:
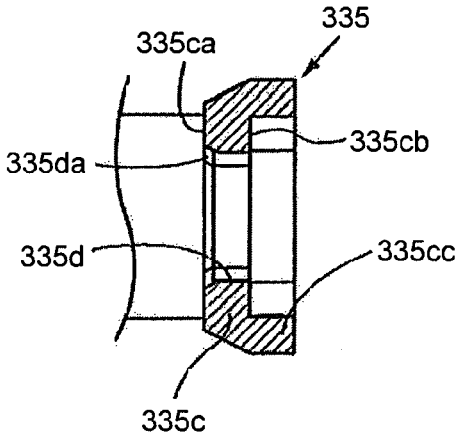
FIG. 30C is an explanatory cross-section of an end surface portion.

Therefore, as illustrated in FIGS. 30B and 30C, a tapered surface 335*da* as an inclined surface is provided along an opening edge of the rear end opening 335*d* of the inner wall surface 335*ca* with which the container shutter spring 336 on the end surface portion 335*c* of the shutter rear end supporting portion 335 comes in contact. FIG. 30A illustrates an appearance of the container shutter supporter 334. FIG. 30B is a cross-sectional view cut along the line in FIG. 30A. FIG. 30C is an end view cut along the J-J line in FIG. 30B. The tapered surface 335*da* is provided along the entire opening edge of the rear end opening 335*d*, which is tapered from the end surface portion 335*c* toward the inside of the rear end opening 335*d*. In other words, on the end surface portion 335*c* of the shutter rear end supporting portion 335, the tapered surface 335*da* is provided on the upstream surface 335*ca* in the moving direction, in which a container shutter 322 moves to the opening position, along the entire circumference of the opening edge of the rear end opening 335*d*.

The tapered surface 335*da* allows toner pressed between the rear end surface 332*da* of the slide area 332*d* of the container shutter 332 and the surface 335*ca* of the end surface portion 335*c* of the shutter rear end supporting portion 335 to easily move to the circumference, as compared to a flat surface. Therefore, if the tapered surface 335*da* is maintained even if the area of the end surface portion 335*c* (the surface 335*ca*) as a flat surface portion of the shutter rear end supporting portion 335 and as the bottom portion of the container shutter spring 336 is minimized, it becomes possible to let the toner out while maintaining the strength.

Further, in the first embodiment, as illustrated in FIGS. 28B, 30B, and 30C, the container shutter supporter includes a protrusion 335*cc* that protrudes from the end surface portion 335*c* in a longitudinal direction of the container shutter supporter. In other words, the protrusion 335*cc* protrudes from the end surface portion 335*c* in an opening direction of the opening/closing member. The protrusion 335*cc* extends in a direction parallel to the moving direction of the container shutter 322 and is arranged along the outer edge of a downstream surface 335*cb* (a container rear end surface when the nozzle receiver 330 is attached to the toner container 32) in the moving direction in which the container shutter 332 of the shutter rear end supporting portion 335 moves toward the opening position.

With the above configurations of the tapered surface 335*da* and the protrusion 335*cc*, even when the projection area of the shutter rear end supporting portion 335 is smaller than the projection area of the rear end surface 332*da* of the slide area 332*d* of the container shutter 332, it becomes possible to maintain the strength enough to prevent breakage when the restoring force due to the compression of the container shutter spring 336 is applied to the container shutter supporter 334.

As illustrated in FIG. 22, the flat guiding portion 332*g* of the container shutter 332 is provided so as to face the shutter side supporting portions 335*a* (vertical arrangement). The slide area 332*d* of the container shutter 332 slides by being guided by the two shutter side supporting portions 335*a* of the nozzle receiver 330, and the strength in the non-guided direction (the strength parallel to the shutter side supporting portions 335*a*) is lower than the strength on the guided side. However, by arranging the flat guiding portion 332*g* of the container shutter 332 so as to face the shutter side supporting portions 335*a* (vertical arrangement), the strength against a force parallel to the shutter side supporting portions 335*a* increases as compared to the configuration in which the flat guiding portion 332*g* of the container shutter 332 is arranged so as to face the openings of shutter supporting portion 335*b*

(horizontal arrangement), and therefore, deformation due to the toner pressed between the rear end surface 332*da* of the slide area 332*d* of the container shutter 332 and the end surface portion 335*c* of the shutter rear end supporting portion 335 of the nozzle receiver 330 is less likely to occur, which is advantageous.

Further, as illustrated in FIGS. 28A and 28B, on the pair of the shutter side supporting portions 335*a* facing each other in the container shutter supporter 334, stepped portions 335*f* are provided so as to have mutually different widths in the moving direction of the container shutter 322. The shutter side supporting portions 335*a* are divided into a first region Y1 and a second region Y2, which has a smaller width than the first region Y1, by the stepped portions 335*f*. The second region Y2 is located on the shutter rear end supporting portion 335 side, and has a width corresponding to the diameter of the container shutter spring 336 that is configured by a coil spring. Therefore, it is possible to stably hold an end of the container shutter spring 336 in the space S1.

Figure 31:
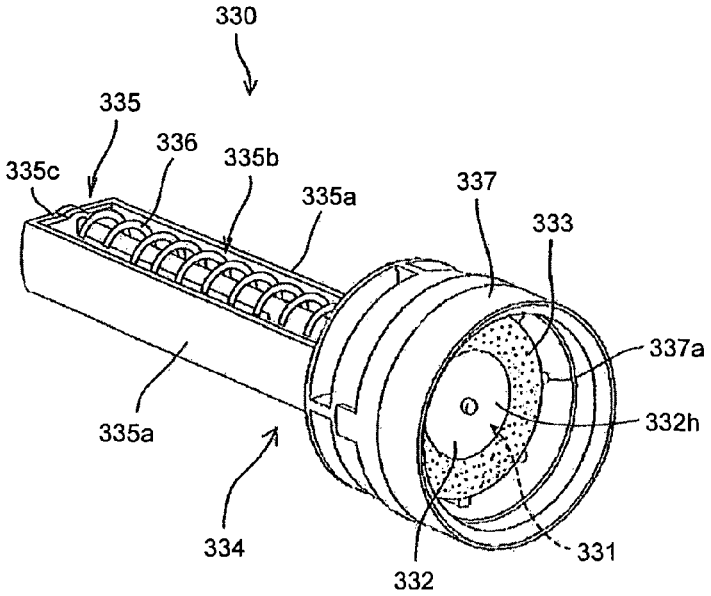
FIG. 31 is a perspective view illustrating another mode of the container shutter supporter.

The configuration of the container shutter supporter 334 is not limited to the configuration in which the stepped portions 335*f* are arranged on the shutter side supporting portions 335*a*. For example, as illustrated in FIG. 31, it is possible to employ a configuration that does not include the stepped portions 335*f* on the shutter side supporting portions 335*a* and does not include the regions Y1 and Y2 for the width.

Second Example

A second example of the first embodiment will be described below. In the second example, explanation of the same configurations as those of the first example will be omitted appropriately, and the same components are denoted by the same reference symbols.

In the first example, as described above, if compressed and cohered toner enters between the slide area 332*d* of the container shutter 332 and the two shutter side supporting portions 335*a* of the nozzle receiver 330, the container shutter 332 may be prevented from returning to the closing position when the toner container 32 is detached from the copier 500, and, the toner container 32 may be detached while the receiving opening 331 remains open, resulting in toner leakage.

Figure 32A:
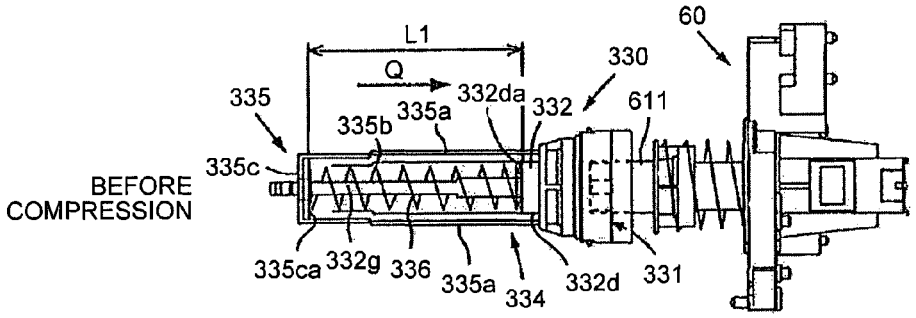
FIG. 32A is a diagram illustrating a state before the opening/closing member is compressed when a compression structure according to a second example of the first embodiment is applied.
Figure 32B:
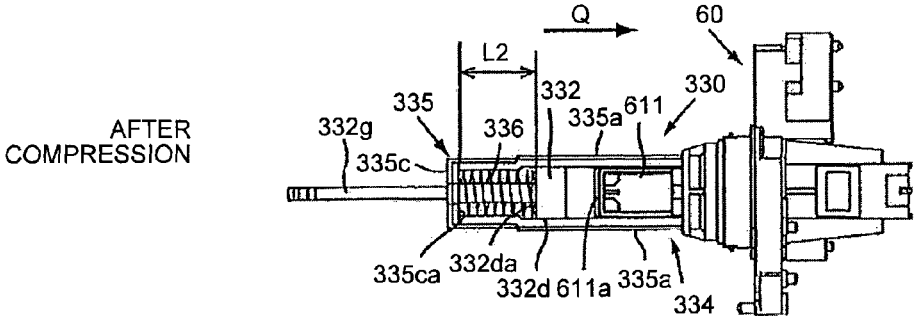
FIG. 32B is a diagram illustrating a state after the opening/closing member is compressed when the compression structure according to the second example is applied.

Therefore, the present inventors have studied a compressed state caused by the container shutter 332. The compressed state caused by the container shutter 332 will be described by the idea of a compression ratio. FIG. 32A illustrates a state before compression by the container shutter 332. FIG. 32B illustrates a state after compression. As illustrated in FIG. 32A, a distance from the rear end surface 332*da* of the slide area 332*d* of the container shutter 332 to the surface 335*ca* of the shutter rear end supporting portion 335 in the closed state is assumed as a before-compression distance L1. As illustrated in FIG. 32B, a distance from the rear end surface 332*da* of the slide area 332*d* of the container shutter 332 to the surface 335*ca* of the shutter rear end supporting portion in the opened state is assumed as an after-compression distance L2. The compression ratio is simply assumed as L1/L2.

Specifically, assuming that L1 denotes a distance in the case where the container shutter 332 is at the closing position and L2 denotes a distance in the case where the container shutter 332 is at the opening position with regard to the distance between the rear end surface 332*da* of the slide area 332*d* opposite to the end surface portion 335*c* and the end surface portion 335*c*, L1/L2 is set to be greater than one and not greater than two.

Experiments on a toner cohesion state were performed, in which the compression ratio (L1/L2) was changed by changing the before-compression distance L1 and the after-compression distance L2. The results are illustrated in Table 1 below. In Table 1, a stroke indicates a stroke (L1-L2) of the container shutter 332. The evaluation of the experiments is indicated by ○, Δ, and x. ○ indicates a state in which toner cohesion and toner leakage do not occur. Δ indicates a state in which toner cohesion occurs but toner leakage does not occur. x indicates a state in which toner cohesion and toner leakage occur.

TABLE 1

| Stroke | | | | |
|---|---|---|---|---|
| L1 | L1 − L2 | L2 | Compression Ratio | Result |
| 76.5 | 57.4 | 19.1 | 4.01 | x |
| 85.5 | 57.4 | 28.1 | 3.04 | Δ |
| 115 | 57.4 | 57.6 | 2.00 | ○ |
| 155 | 57.4 | 97.6 | 1.59 | ○ |

Through the experiments by the present inventors, it is found that when L1/L2 (the compression ratio) is set to be greater than one and not greater than two, it is possible to prevent a situation in which the compressed and cohered toner prevents the container shutter 332 from returning to the closing position at the time of detachment of the toner container 32 from the copier 500 and the toner container 32 is detached with the receiving opening 331 remaining open resulting in toner leakage.

Figure 33A:
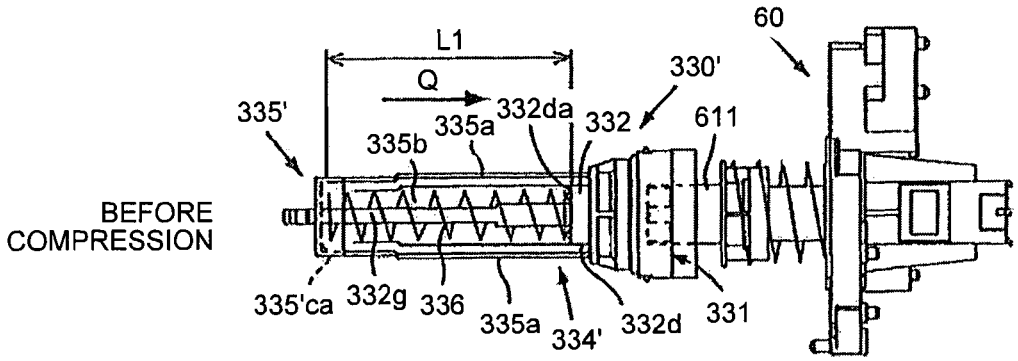
FIG. 33A is a diagram illustrating a state before the opening/closing member is compressed when the compression structure according to the embodiment is applied to the conventional nozzle receiver and a conventional container shutter.
Figure 33B:
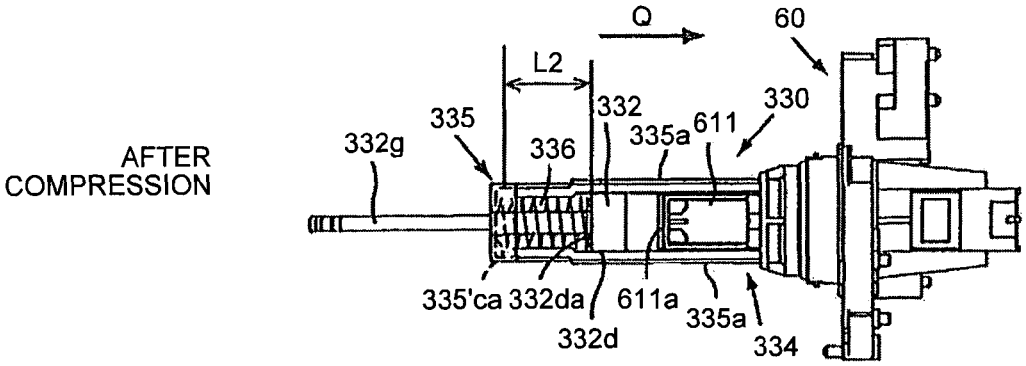
FIG. 33B is a diagram illustrating a state after the opening/closing member is compressed when the compression structure according to the embodiment is applied to the conventional nozzle receiver and the conventional container shutter.

The advantageous effect of a change in the compression ratio is not limited to the combination of the container shutter supporter 334 and the container shutter 332 of the embodiment. For example, as illustrated in FIGS. 33A and 33B, even when the same is applied to a combination of the conventional container shutter supporter 334' and the container shutter 332, if L1/L2 (the compression ratio) is set to be greater than one and not greater than two, it is possible to prevent a situation in which the compressed and cohered toner prevents the container shutter 332 from returning to the closing position at the time of detachment of the toner container 32 from the copier 500 and the toner container 32 is detached with the receiving opening 331 remaining open resulting in toner leakage. In FIG. 33A, the before-compression distance L1 is a distance from the rear end surface 332*da* of the slide area 332*d* of the container shutter 332 to the surface 335'*ca* of the shutter rear end supporting portion 335' in the closed state. As illustrated in FIG. 33B, the after-compression distance L2 is a distance from the rear end surface 332*da* of the slide area 332*d* of the container shutter 332 to the surface 335'*ca* of the shutter rear end supporting portion 335' in the opened state.

Third Example

A third example of the first embodiment will be described below. In the third example, explanation of the same configurations as those of the first and the second examples will be omitted appropriately, and the same components are denoted by the same reference symbols. Techniques according to the third example may preferably be implemented with the techniques described in the first and the second examples; however, even when the techniques according to the third example are implemented independently, the same advantageous effects as described below can be achieved.

In each of the examples, for convenience of assembly, as illustrated in FIGS. 20 and 21, the container shutter 332 and the container shutter spring 336 are assembled with the container shutter supporter 334 to fabricate the nozzle receiver 330, and thereafter the nozzle receiver 330 is assembled with the container body 33 to fabricate the toner container 32.

The shutter hooks 332*a* of the container shutter 332 are hooked on the rear end opening 335*d* of the container shutter supporter 334 to prevent the container shutter 332 from coming off from the container shutter supporter 334. However, during fabrication of the toner container 32 as described above, an external stress may be applied to the shutter hooks 332*a* when the shutter hooks 332*a* may bump against anything or may be touched by mistake, and the shutter hooks 332*a* may be elastically deformed, resulting in causing the container shutter 332 from coming off from the container shutter supporter 334.

Further, in a process of fabrication of the toner container 32, the nozzle receiver 330 may be fabricated in a different place and then conveyed or transported to assemble the nozzle receiver 330 with the container body 33 to fabricate the toner container 32. In this case, when the nozzle receiver 330 is conveyed or transported, a packing material for packing the nozzle receiver 330 may interfere with the shutter hooks 332*a* or the packed nozzle receivers may interfere with each other. If a stress is applied to the shutter hooks 332*a* due to the interference as described above, the shutter hooks 332*a* may be elastically deformed or broken, resulting in causing the container shutter 332 from coming off from the container shutter supporter 334.

Figure 34A:
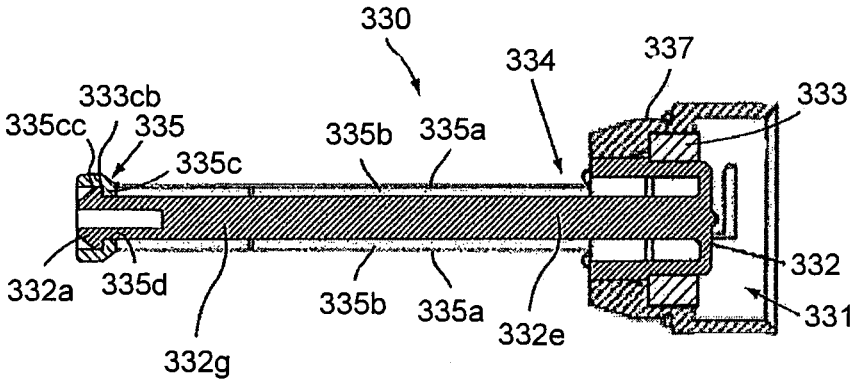
FIGS. 34A and 34B are diagrams illustrating a configuration according to a third example.
Figure 34B:
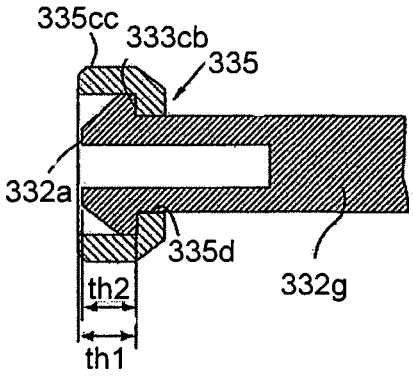

Therefore, in the third example, as illustrated in FIGS. 34A and 34B, a protrusion amount (height) th1 of the protrusion 335*cc*, which protrudes from the surface 335*cb* of the shutter rear end supporting portion 335, from the surface 335*cb* is set to be equal to or greater than a protrusion amount (height) th2 from the surface 335*cb* in the state in which the shutter hooks 332*a* are hooked on the rear end opening 335*d*. That is, the progrusion 335*cc* protrudes more than the shutter hook 332*a* in the opening direction of the opening/closing member.

The protrusion 335*cc* is provided so as to protrude toward a downstream side in the moving direction in which the container shutter 332 moves from the closing position to the opening position, relative to the shutter hooks (engaging portions) 332*a* when the container shutter 332 serving as the opening/closing member is located at the closing position.

As described above, when the protrusion amount (height) th1 of the protrusion 335*cc* from the surface 335*cb* is set to be equal to or greater than the protrusion amount (height) th2 protruding from the surface 335*cb* when the shutter hooks 332*a* are hooked on the rear end opening 335*d*, the peripheries of the shutter hooks 332*a* are covered. Therefore, an external stress is less likely to be applied to the shutter hooks 332*a*, so that it becomes possible to prevent the container shutter 332 from coming off from the container shutter supporter 334.

Further, even when the nozzle receiver 330 is conveyed or transported, a packing material for packing the nozzle receiver 330 is less likely to interfere with the shutter hooks 332*a* or the packed nozzle receivers 330 are less likely to interfere with each other, so that it becomes possible to prevent the container shutter 332 from coming off from the container shutter supporter 334.

Second Embodiment

A second embodiment of the present invention will be described. In the second embodiment, the same configurations as those of the first embodiment will be omitted appropriately, and the same components are denoted by the same reference symbols. Techniques according to the second embodiment may preferably be implemented with the techniques described in the first embodiment; however, even when the techniques according to the second embodiment are implemented independently, the same advantageous effects as described below can be achieved. Further, the second embodiment includes techniques according to fourth to eleventh examples to be described below.

First, a problem will be described.

Figure 35:
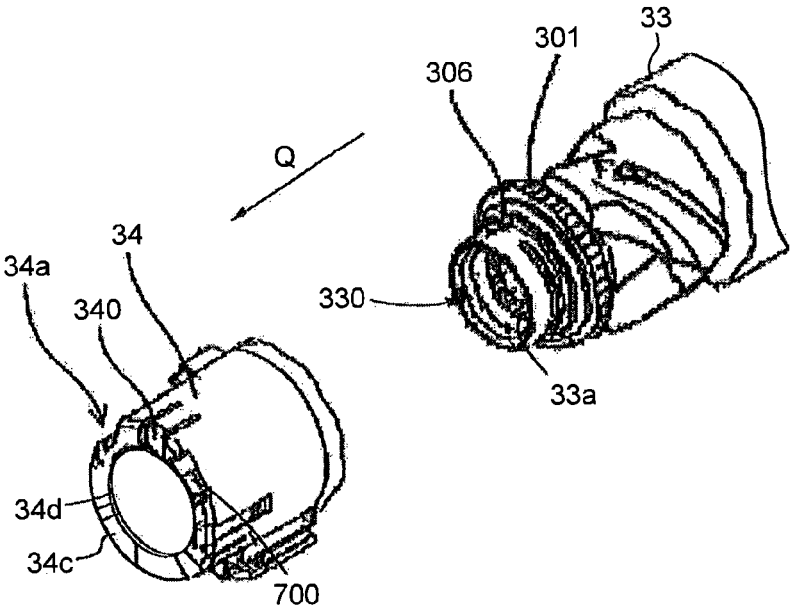
FIG. 35 is an enlarged perspective view for explaining a configurations of a protrusion of a container front end cover and configurations of a restrictor and an opening of a container body according to a comparative example.
Figure 36:
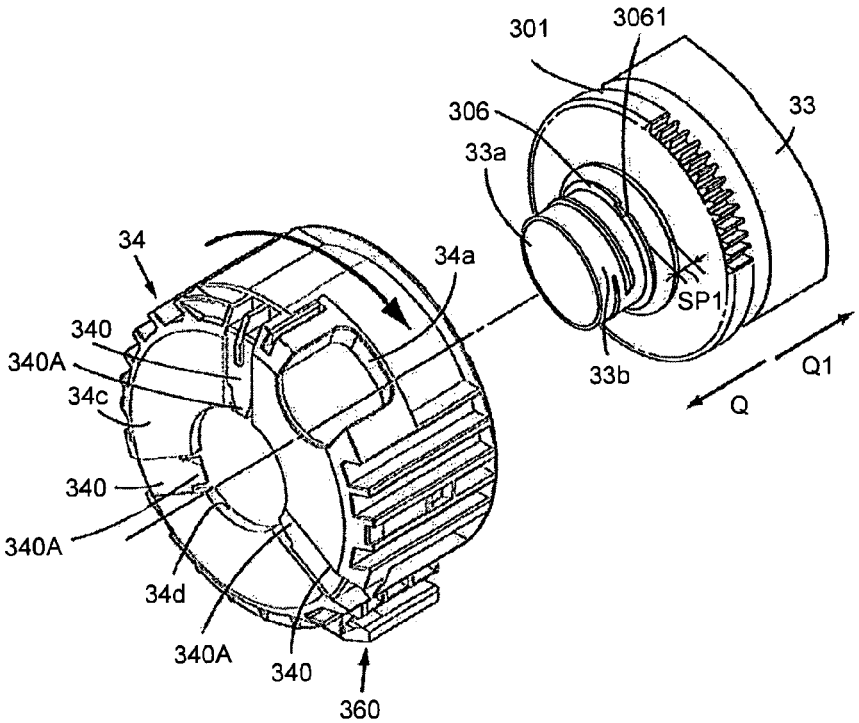
FIG. 36 is an enlarged perspective view illustrating a configuration of a protrusion of a container front end cover and configurations of a restrictor and an opening of a container body according to a second embodiment.

In a comparative example illustrated in FIG. 35, when the container front end cover 34 and the container body 33 are assembled by being attached to each other, the container body 33 is inserted in the container front end cover 34 in the direction Q, and the container body 33 is moved in the attachment direction Q from the hole 34*d* arranged in the center of the front surface 34*c* of the container front end cover 34. In this case, the tongue-shaped cover hook 340 is elastically deformed so as to spread from the cover hook stopper 306 in the radial direction and then passes over the cover hook stopper 306, so that the front end of the cover hook 340 is hooked on a groove between the cover hook stopper 306 and the container gear 301. The cover hook stopper 306 is arranged along the entire circumferential direction, and the outer diameter of the cover hook stopper 306 is greater than the inner diameter of the hole 34*d*. Therefore, the container front end cover 34 is restricted from moving in the direction Q, but is held so as to rotate relative to the container body 33. As described above, when the toner container 32 is held by the toner container holder 70, a stress (restoring force) for compressing the container shutter spring 336 and a stress caused by the compression of the nozzle shutter spring 613 are applied to the toner container 32 (the container front end cover 34). Therefore, if the cover hook 340 is configured so as to be easily attached (elastically deformed) to the cover hook stopper 306, and when a pushing force is applied in the detachment direction Q1, the container body 33 is easily detached from the container front end cover 34. By contrast, if the cover hook 340 is configured so as to be difficult to detach (less deformable) in order to prevent the container body 33 from being easily detached from the container front end cover 34, the cover hook 340 is not easily attached to the cover hook stopper 306.

Therefore, in the second embodiment, as illustrated in FIGS. 11A to 11C and 12, the cover hook stopper 306 provided on the container body 33 includes the openings 3061 through which the cover hooks 340 arranged on the container front end cover 34 respectively pass in the attachment/detachment direction of the container body 33 perpendicular to the rotation direction. The cover hook stopper 306 serves as a restrictor, and the opening 3061 serves as a notch or a cutout.

Herein, the attachment/detachment direction of the container body 33 is a direction in which the toner container 32 is attached to and detached from the toner replenishing devices 60. However, an attachment/detachment direction of the container front end cover 34 in which the container front end cover 34 is attached to and detached from the toner container body 33 is the same an opposite direction to the direction in which the toner container 32 is attached to and detached from the toner replenishing devices 60. Therefore, the term "the attachment direction" used in the second embodiment has two meanings, "the attachment direction of the container body 33" and "the detachment direction of the container front end cover 34". And the term "the detachment direction" used in the second embodiment has two meanings, "the detachment direction of the container body 33" and "the attachment direction of the container front end cover 34". Similarly, the term "the attachment direction Q" used in the second embodiment has two meanings, "the attachment direction of the container body 33" and "the detachment direction of the container front end cover 34"; and the term "the detachment direction Q1" used in the second embodiment has two meanings, "the detachment direction of the container body 33" and "the attachment direction of the container front end cover 34".

On the front surface 34*c* of the container front end cover 34 in the attachment direction Q, the hole 34*d* serving as a through hole is provided, which penetrates in the attachment/detachment direction of the container body 33 and into which the container opening 33*a* is inserted. The cover hooks 340 are provided such that the inner ends 340A protrude toward the center of the hole 34*d*. As indicated by the dashed-line circle 34*e* in FIG. 11B, the tips of the inner ends 340A protrude inward relative to the outer periphery of the hole 34*d*. The cover hooks 340 respectively pass through the openings 3061 in the attachment/detachment direction when the container body 33 rotates relative to the container front end cover 34. In the second embodiment, the three openings 3061 are provided on the cover hook stopper 306 in the rotation direction. The openings 3061 are arranged such that intervals between the openings 3061 in the circumferential direction coincide with the intervals between the cover hooks 340 in the circumferential direction. In the second embodiment, the three cover hooks 340 and the three openings 3061 are provided in the rotation direction; however, it is sufficient that at least one cover hook 340 and one opening 3061 are provided. FIG. 11C illustrates a state into which the cover hook 340 is inserted in the cover hook stopper 306 from the state illustrated in FIG. 11A. As illustrated in FIG. 11C, a center side portion of the front surface 34*c* and a outer side surface of the cover hook stopper 306 face each other. The cover hooks 340 are thinner than the front surface 34*c* (in FIG. 11B, recessed toward the rear side relative to the front surface 34*c*), and the cover hooks 340 and the cover hook stopper 306 face each other in the attachment direction Q. Therefore, the movement of the container front end cover 34 relative to the container body 33 in the attachment direction Q and the detachment direction Q1 is restricted. The restriction involves allowing the cover hooks 340 to move between the cover hook stopper 306 and the container gear 301 in the attachment direction Q and the detachment direction Q1 in FIG. 11C. Accordingly, the container body 33 becomes rotatable relative to the container front end cover 34.

Namely, in the configuration of the powder container described using the comparative example, the protrusion provided on the holder is elastically deformed in the radial direction so as to be hooked on the restrictor of the powder storage. Therefore, if the protrusion is configured to be easily detached or be difficult to detach, it becomes difficult to hook the restrictor on the protrusion, resulting in the reduced operability.

Therefore, the powder container according to the second embodiment includes a cylindrical powder storage to contain powder; a holder attachable to and detachable from the powder storage; a protrusion that is on one of the powder storage and the holder; and a restrictor that is on the other one of the powder storage and the holder and is to restrict the movement of the protrusion in the longitudinal direction of the powder storage. The powder storage is to rotate relative to the holder. The restrictor includes an opening through which the protrusion passes in the direction perpendicular to the rotation direction when the holder is attached to the powder storage.

According to the second embodiment, the protrusion is provided on one of the powder storage and the holder that are rotatable relative to each other, and a restrictor, on which the protrusion is hooked and which extends in the rotation direction, is provided on the other one of the powder storage and the holder. Further, the restrictor includes the opening through which the protrusion passes in the direction perpendicular to the rotation direction. Therefore, after the protrusion has passed through the opening, the hooked state between the opening and the protrusion is maintained. Consequently, it becomes possible to attach the protrusion to the restrictor without reducing the operability, enabling to prevent the protrusion from easily coming off, as compared to the conventional configuration.

Specific configurations of the cover hook 340 and the opening 3061 will be described in each of the examples below. In the examples, "a rotation direction A" is a direction in which the container front end cover 34 rotates relative to the container body 33 in the toner container attached to the image forming apparatus, and "an attachment rotation direction R" is a direction in which the container front end cover 34 (the cover hooks 340) rotates relative to the container body 33 when the container front end cover 34 is attached to the container body 33. The three cover hooks 340 and the three openings 3061 have the same configurations, respectively; therefore, the configurations and operation of the single cover hook 340 and the single opening 3061 will be described as representatives. The outer diameter of the cover hook stopper 306 is equal to or greater than the inner diameter of the hole 34*d* in the center.

Fourth Example

Figure 37A:
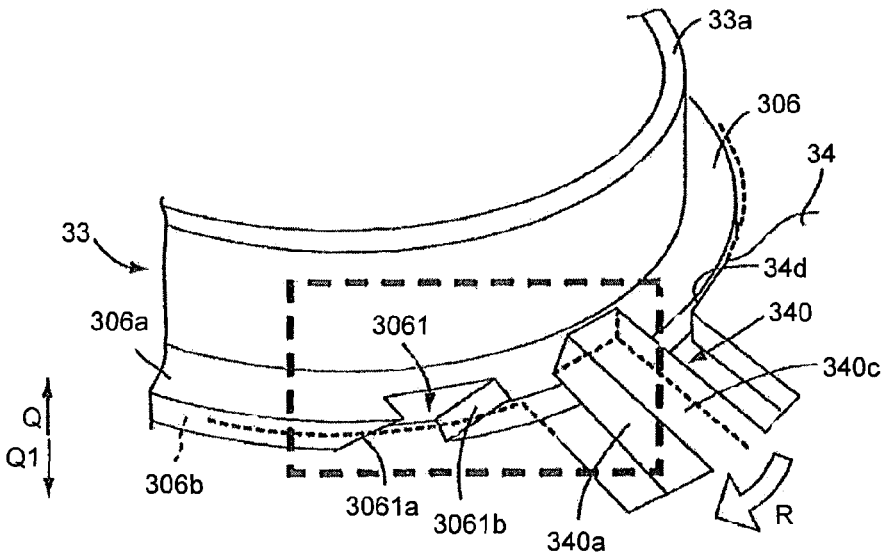
FIG. 37A is an enlarged view for explaining configurations of a protrusion and the vicinity of an opening according to a fourth example of the second embodiment.
Figure 37B:
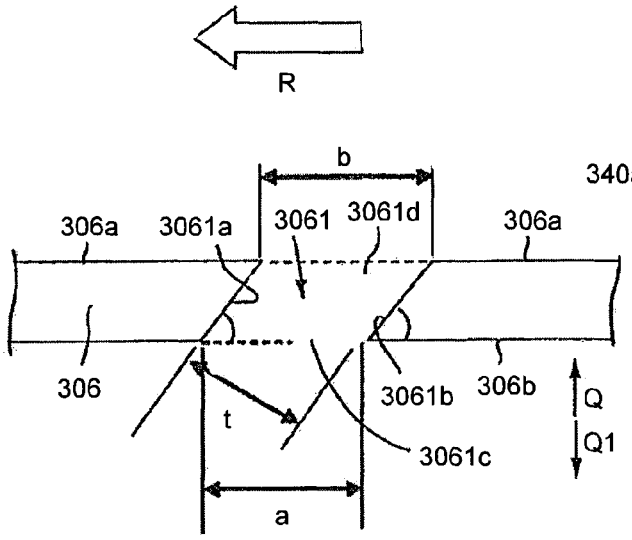
FIG. 37B is an enlarged view for explaining the configuration of the opening.
Figure 37C:
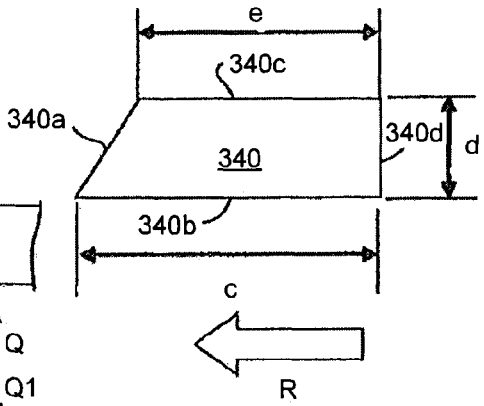
FIG. 37C is a diagram for explaining the configuration of the protrusion.

FIGS. 37A and 37B illustrate a cover hook and an opening according to a fourth example. FIG. 37A is a partially-enlarged perspective view illustrating the configurations of the opening 3061 provided on the container body 33 and the cover hook 340 provided on the container front end cover 34. FIG. 37B is an enlarged view for explaining the configurations of the opening 3061. FIG. 37C is an enlarged view for explaining the configuration of and the cover hook 340.

In the cover hook stopper 306 having a thickness in the attachment/detachment direction, an end surface 306*a* located in the attachment direction Q serves as a guiding surface toward the opening 3061 when the container front end cover 34 is attached to the container body 33, and an end surface 306*b* located in the detachment direction Q1 serves as a guiding surface toward the opening 3061 at the time of detachment.

The cover hook 340 serving as the protrusion includes an inclined portion 340*a* of the protrusion on an end surface serving as an end located on the downstream side in the attachment rotation direction R. The inclined portion 340*a* of the protrusion is inclined upward from the downstream side to the upstream side in the attachment rotation direction R. The inclined portion 340*a* of the protrusion is an inclined surface with a flat top surface. A surface of the cover hook 340 that is continued from the inclined portion 340*a* is referred to as a bottom surface 340*b* of the cover hook 340, which serves as a second surface of the protrusion. The bottom surface 340*b* faces the end surface 306*a* in the attachment operation of the container cover 34 to the container body 33. A surface of the cover hook 340 that is continued from the inclined portion 340*a* and located on the side opposite to the bottom surface 340*b* of the cover hook 340 is referred to as an upper surface 340*c* of the cover hook 340, which serves as a first surface of the protrusion.

In the cover hook 340, the bottom surface 340*b* of the cover hook 340 and the upper surface 340*c* of the cover hook 340 serve as parallel planes parallel to each other. It is preferable that the bottom surface 340*b* of the cover hook 340 and the end surface 306*a* of the cover hook stopper 306 are parallel to each other in the state before the container front end cover 34 is attached to the container body 33 as illustrated in FIG. 37A. It is also preferable that the upper surface 340*c* of the cover hook 340 and the end surface 306*b* are parallel to each other in the state in which the container front end cover 34 is attached to the container body 33. As illustrated in FIG. 37B, the width (length) of the bottom surface 340*b* of the cover hook 340 in the attachment rotation direction R is denoted by "c", the width (length) of the upper surface 340*c* of the cover hook 340 in the attachment rotation direction R is denoted by "e", and the thickness between the bottom surface 340*b* of the cover hook 340 and the upper surface 340*c* of the cover hook 340, which is the thickness of the cover hook 340, in the attachment/detachment direction is denoted by "d". In the cover hook 340, as illustrated in FIG. 37B, a width "c" of the bottom surface 340*b* of the cover hook 34 (i.e., a length of the bottom surface 340*b* in the rotation direction R) is greater than the width "e" of the upper surface 340*c* of the cover hook 340. The cover hook 340 has a trapezoidal cross-section, in which the inclined portion 340*a* serves as an inclined surface inclined downward from the upper surface 340*c* of the cover hook 340 to the bottom surface 340*b* of the cover hook 340 with respect to the rotation direction. In the descriptions below, it is assumed that the configuration of the cover hook 340 is the same in the fourth to the seventh examples.

A surface located on the downstream side of the opening 3061 in the attachment rotation direction R serves as an opening inclined portion 3061*a* inclined in the same direction as the inclined portion 340*a* of the protrusion. The opening 3061 includes an opposite surface 3061*b* facing the opening inclined portion 3061*a*. The opposite surface 3061*b* is an inclined surface. In the fourth example, the opening inclined portion 3061*a* and the opposite surface 3061*b* are parallel planes parallel to each other.

As illustrated in FIG. 37B, in the opening 3061, an interval between the opening inclined portion 3061*a* and the opposite surface 3061*b* is denoted by "t"; the width (length) of the opening 3061 on a first port 3061*c* side on the end surface 306*b* side in the attachment rotation direction R is denoted by "a"; and the width (length) of the opening 3061 on a second port 3061*d* side in the attachment rotation direction R is denoted by "b". The first port 3061*c* serves as an outlet port (a downstream end port, an outlet, or a first portion of the opening 3061). The second port 3061*d* serves as an inlet port (an upperstream end port, an inlet, or a second portion of opening). The second port 3061*d* of the opening 3061 is one end of the opening 3061 opened on the end surface 306*a* and is located on the upstream side in the direction in which the protrusion 340 passes through the opening 3061 when the container front end cover 34 serving as the holder is attached to the container body 33 serving as a powder storage. The first port 3061*c* of the opening 3061 is the other end of the opening 3061 opened on the end surface 306*b* and is located on the downstream side in the direction in which the protrusion 340 passes through the opening 3061 when the container front end cover 34 is attached to the container body 33. In the fourth example, the relation of (the thickness "d" of the cover hook 340)≤(the interval "t" of the opening 3061) and the relation of (the width "a" of the first port 3061*c* of the opening 3061)<(the width "e" of the upper surface 340*c* of the cover hook 340) are satisfied.

Figure 38A:
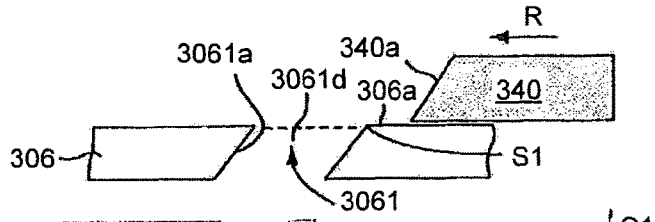
FIGS. 38A to 38G are diagrams for explaining operation of the opening and the protrusion according to the fourth example of the second embodiment.
Figure 38B:
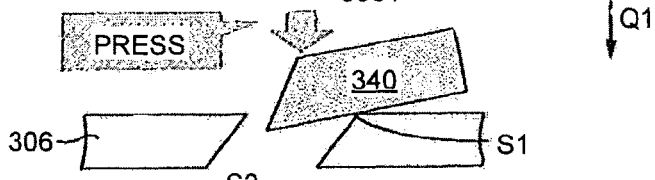
Figure 38C:
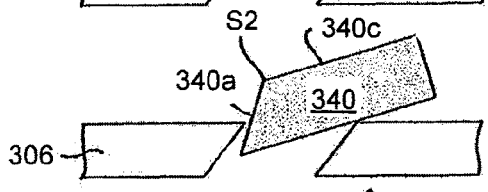
Figure 38D:
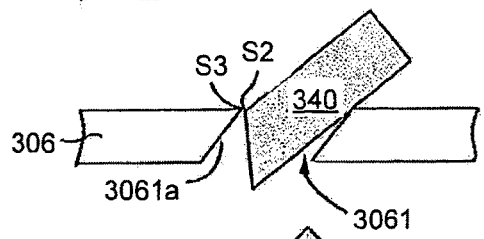
Figure 38E:
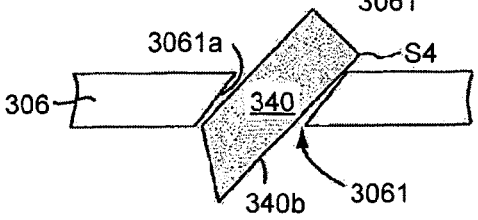
Figure 38F:
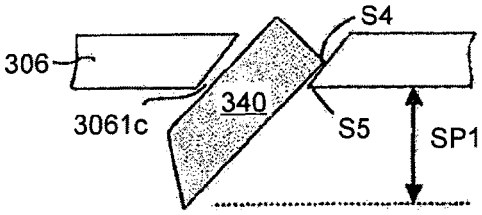
Figure 38G:
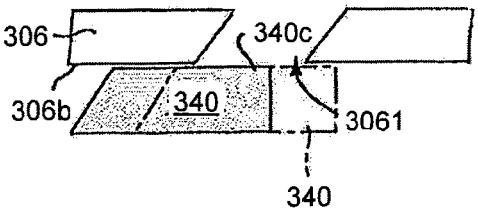

The entering operation of the cover hook 340 at the opening 3061 configured as described above will be described with reference to FIGS. 38A to 38G. As illustrated in FIG. 38A, when the container front end cover 34 is rotated in the attachment rotation direction R, the cover hook 340 moves from the right to the left on the end surface 306*a* in FIG. 38A. When the inclined portion 340*a* of the cover hook 340 is located above the second port 3061*d* of the opening 3061, the cover hook 340 is pressed toward the opening 3061 (from the upstream side to the downstream side in the detachment direction Q1) as illustrated in FIG. 38B. Accordingly, the cover hook 340 slightly deforms counterclockwise in the figures toward the inside of the opening 3061 by using an end S1 of the second port 3061*d* located on the upstream side in the attachment rotation direction R as a pivot, and enters the opening 3061 with the inclined portion 340*a* of the protrusion in the lead as illustrated in FIG. 38C. Subsequently, as illustrated in FIG. 38D, an end S2 defined by the inclined portion 340*a* and the upper surface 340*c* of the cover hook 340 passes by an end S3 of the second port 3061*d* of the opening 3061 located on the downstream side in the attachment rotation direction R. At this time, because the relation of (the thickness "d" of the cover hook 340)≤(the interval "t" of the opening 3061) is satisfied, the cover hook 340 passes through the opening 3061 as illustrated in FIG. 38E and FIG. 38F. When an upstream end S4 of the bottom surface 340*b* of the cover hook 340 in the attachment rotation direction R passes by an end S5 of the first port 3061*c* located on the upstream side in the attachment rotation direction R, the cover hook 340 is located such that the upper surface 340*c* and the end surface 306*b* face each other as illustrated in FIG. 38G. At this time, if the length of an interval SP1 between the end surface 306*b* and a component of the container body 33 located on the downstream side in the detachment direction Q1 of the container body 33 is set such that the cover hook 340 can sufficiently rotate and the end S4 can pass by the first port 3061*c*, rotational displacement of the cover hook 340 in the opening 3061 is smoothly performed, which is preferable.

That is, the opening 3061 is configured such that when the inclined portion 340*a* of the protrusion comes in contact with the opening inclined portion 3061*a*, the cover hook 340 passes through the opening 3061.

As described above, when the cover hook 340 passes through the opening 3061 that is provided in an inclined manner on the cover hook stopper 306, an engaged state is obtained, in which the upper surface 340*c* of the cover hook 340 and the end surface 306*b* of the cover hook stopper 306 face each other while maintaining the state of being hooked with each other. Therefore, it is possible to ensure the attached state between the container body 33 and the container front end cover 34, and simplify the assembly and attachment.

Further, the width "a" of the first port 3061*c* of the opening 3061 is smaller than the width "e" of the upper surface 340*c* of the cover hook 340, so that even when the opening 3061 and the cover hook 340 face each other after the container front end cover 34 is attached to the container body 33, the cover hook 340 does not easily pass through the opening 3061. Therefore, for example, when the toner container 32 is attached to and detached from the toner replenishing device 60, and even if a stress (restoring force) for compressing the container shutter spring 336 and a stress caused by the compression of the nozzle shutter spring 613 are applied to the toner container 32, the container body 33 and the container front end cover 34 are not detached from each other. Consequently, it is possible to improve the operability when the toner container 32 is attached and detached.

Fifth Example

Figure 39A:
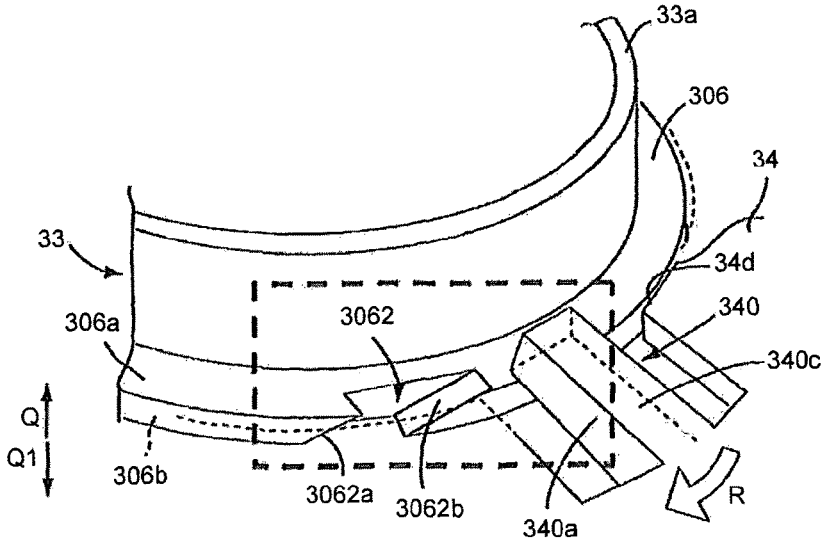
FIG. 39A is an enlarged view for explaining configurations of a protrusion and the vicinity of an opening according to a fifth example of the second embodiment.
Figure 39B:
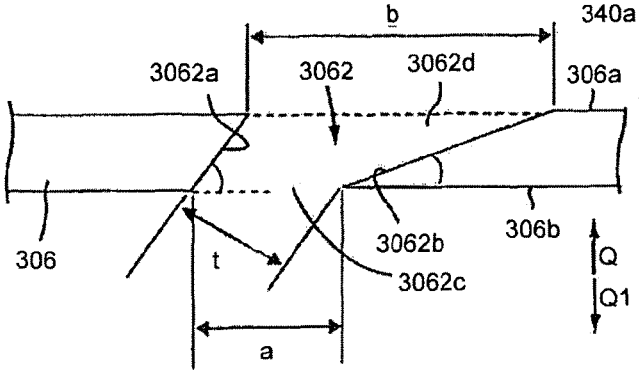
FIG. 39B is an enlarged view for explaining the configuration of the opening.
Figure 39C:
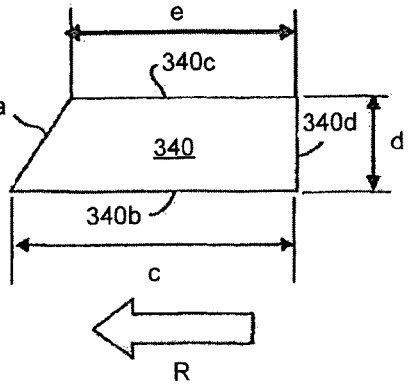
FIG. 39C is a diagram for explaining the configuration of the protrusion.

FIGS. 39A to 39C illustrate a cover hook and an opening according to a fifth example. FIG. 39A is a partially-enlarged perspective view illustrating the configurations of an opening 3062, which serves as a notch or a cutout and is provided on the container body 33, and the cover hook 340 provided on the container front end cover 34. FIG. 39B is an enlarged view for explaining the configuration of the opening 3062. FIG. 39C is an enlarged view for explaining the configuration of the cover hook 340.

The opening 3062 provided on the cover hook stopper 306 according to the fifth example differs from the opening 3061 according to the fourth embodiment. The opening 3062 includes an opening inclined portion 3062*a* and an opposite surface 3062*b* inclined in the same direction as the opening inclined portion 3062*a*. In the fifth example, the opposite surface 3062*b* is a surface moderately inclined by an acute angle, which is smaller than that of the opening inclined portion 3062*a*, from the downstream side to the upstream side in the attachment rotation direction R. Therefore, in the fifth example, in the opening 3062, a width "b" of a second port 3062*d* of the opening 3062 on the end surface 306*a* side and the width "a" of a first port 3062*c* side on the end surface 306*b* side differ from each other. The first port 3062*c* serves as an outlet port (a downstream end port, an outlet, or a first portion of the opening). Therefore, in the fifth example, an interval "t" between the opening inclined portion 3062*a* and the opposite surface 3062*b* corresponds to the minimum interval between the opening inclined portion 3062*a* and the opposite surface 3062*b*, and the dimension thereof corresponds to a dimension between an extended line of the opening inclined portion 3062*a* and a line that extends from the opposite surface 3062*b* so as to be parallel to the extended line. That is, the opening 3062 includes the opposite surface 3062*b* as a guiding portion inclined from the upstream side to the downstream side in the detachment direction Q on the second port of the opening side.

The width of the opening 3062 on the first port 3062*c* side in the attachment rotation direction R is denoted by "a", and the width of the opening 3062 on the second port 3062*d* side, which serves as an inlet port, an upperstream end port, an inlet, or a second portion of opening, in the attachment rotation direction R is denoted by "b". The second port 3062*d* of the opening 3062 corresponds to the width of one end of the opening 3062 opened on the end surface 306*a*, and the first port 3062*c* corresponds to the width of the other end of the opening 3062 opened on the end surface 306*b*. Even in the fifth example, the relation of (the thickness "d" of the cover hook 340)≤(the interval "t" of the opening 3062) and the relation of (the width "a" of the first port 3062*c* of the opening 3062)<(the width "e" of the upper surface 340*c* of the cover hook 340) are satisfied. In addition, the relation of (the width "c" of the bottom surface 340*b* of the cover hook 340)<(the width "b" of the second port 3062*d* of the opening 3062) is satisfied.

Figure 40A:
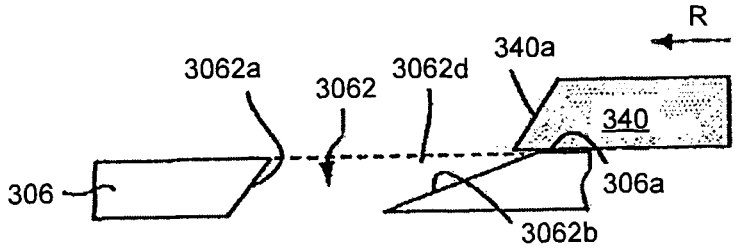
FIGS. 40A to 40G are diagrams for explaining operation of the opening and the protrusion according to the fifth example of the second embodiment.
Figure 40B:
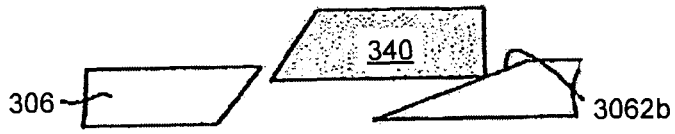
Figure 40C:
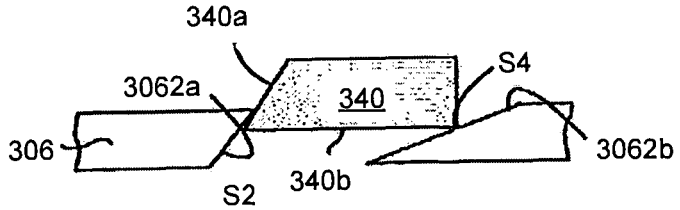

The entering operation of the cover hook 340 at the opening 3062 configured as described above will be described with reference to FIGS. 40A to 40G. As illustrated in FIG. 40A, when the container front end cover 34 is rotated in the attachment rotation direction R, the cover hook 340 moves from the right to the left on the end surface 306*a* in FIG. 40A. When the cover hook 340 is located above the second port 3062*d* of the opening 3062, the cover hook 340 is pressed toward the opening 3062 as illustrated in FIG. 40B. Accordingly, because the relation of (the width "c" of the bottom surface 340*b* of the cover hook 340)<(the width "b" of the second port 3062*d* of the opening 3062) is satisfied, the cover hook 340 enters the second port 3062*d* of the opening 3062 while maintaining the same posture. The posture is maintained until the inclined portion 340*a* of the protrusion comes in contact with the opening inclined portion 3062*a* as illustrated in FIG. 40C.

Figure 40D:
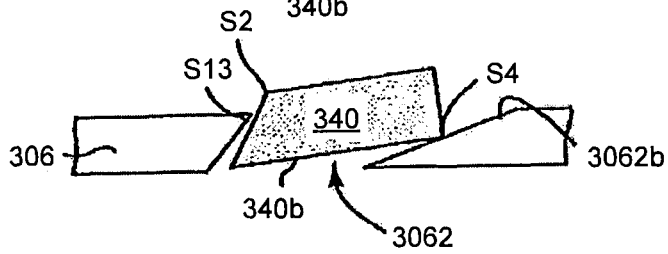
Figure 40E:
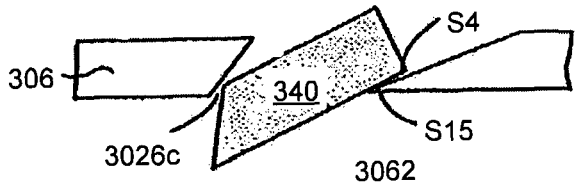
Figure 40F:
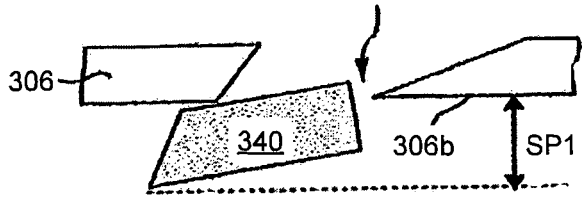
Figure 40G:
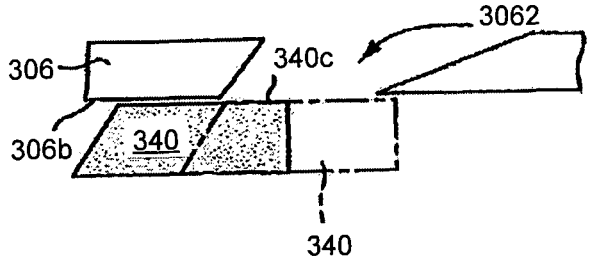

When the inclined portion 340*a* of the protrusion comes in contact with the opening inclined portion 3062*a*, the cover hook 340 rotates counterclockwise in the figures by using an end S4 of the bottom surface 340*b* of the cover hook 340 located on the upstream side in the attachment rotation direction R as a pivot on the opposite surface 3062*b* as illustrated in FIG. 40D. Subsequently, as illustrated in FIG. 40E, the end S2 defined by the inclined portion 340*a* and the upper surface 340*c* of the cover hook 340 passes by an end S13 of the second port 3062*d* of the opening 3062 located on the downstream side in the attachment rotation direction R. At this time, because the relation of (the thickness "d" of the cover hook 340)≤(the interval "t" of the opening 3062) is satisfied, the cover hook 340 passes through the opening 3062 as illustrated in FIGS. 40E and 40F. When the upstream end S4 of the bottom surface 340*b* of the cover hook 340 in the attachment rotation direction R passes by an end S15 of the first port 3062*c* located on the upstream side in the attachment rotation direction R, the cover hook 340 is located such that the upper surface 340*c* and the end surface 306*b* face each other as illustrated in FIG. 40G. At this time, if the length of the interval SP1 between the end surface 306*b* and a component of the container body 33 located on the downstream side in the detachment direction Q1 is set such that the cover hook 340 can sufficiently rotate and the end S4 can pass by the first port 3062*c*, rotational displacement of the cover hook 340 in the opening 3062 is smoothly performed, which is preferable.

That is, the opening 3062 is configured such that when the inclined portion 340*a* of the protrusion comes in contact with the opening inclined portion 3062*a*, the cover hook 340 passes through the opening 3062.

When the cover hook 340 passes through the opening 3062 that is provided in an inclined manner on the cover hook stopper 306 as described above, an engaged state is obtained, in which the upper surface 340*c* of the cover hook 340 and the end surface 306*b* of the cover hook stopper 3062 face each other while maintaining the state of being hooked with each other. Therefore, it is possible to ensure the attached state between the container body 33 and the container front end cover 34, and simplify the assembly and attachment.

Further, the width "a" of the first port 3062*c* of the opening 3062 is smaller than the width "e" of the upper surface 340*c* of the cover hook 340, so that even when the opening 3062 and the cover hook 340 face each other, the cover hook 340 does not easily pass through the opening 3062. Therefore, for example, when the toner container 32 is attached to and detached from the toner replenishing device 60, and even if a stress (restoring force) for compressing the container shutter spring 336 and a stress caused by the compression of the nozzle shutter spring 613 are applied to the toner container 32, the container body 33 and the container front end cover 34 are not detached from each other. Consequently, it is possible to improve the operability when the toner container 32 is attached and detached.

Further, in the fifth example, because the relation of (the width "c" of the bottom surface 340*b* of the cover hook 340)<(the width "b" of the second port 3062*d* of the opening 3062) is satisfied, an angle at which the cover hook 340 passes through the opening 3062 with respect to the rotation direction is smaller than that of the fourth example. Therefore, it is possible to reduce the interval SP1 than that of the fourth example.

Sixth Example

Figure 41A:
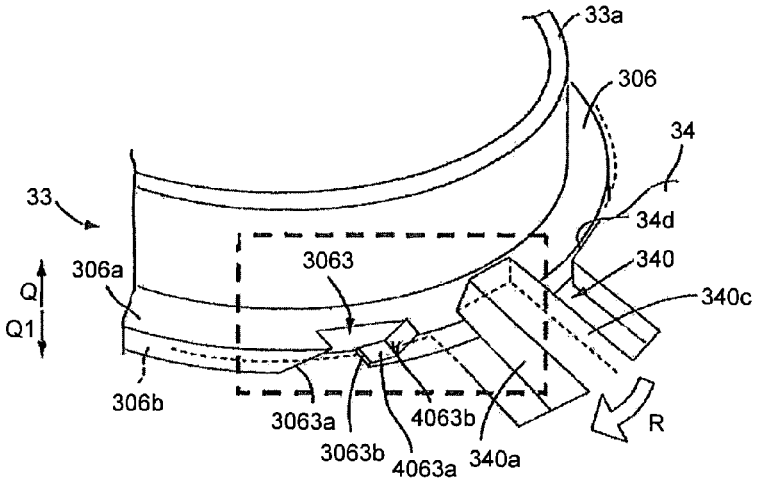
FIG. 41A is an enlarged view for explaining configurations of a protrusion and the vicinity of an opening according to a sixth example of the second embodiment.
Figure 41B:
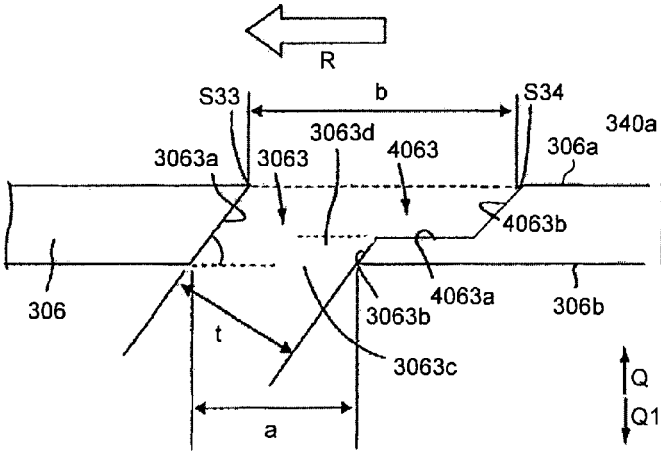
FIG. 41B is an enlarged view for explaining the configuration of the opening.
Figure 41C:
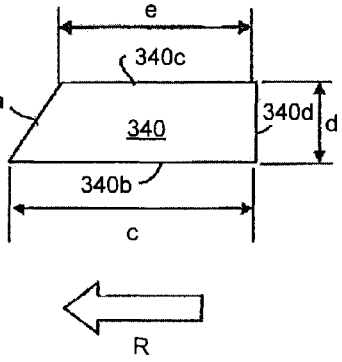
FIG. 41C is a diagram for explaining the configuration of the protrusion.

FIGS. 41A to 41C illustrate a cover hook and an opening according to a sixth example. FIG. 41A is a partially-enlarged perspective view illustrating the configurations of an opening 3063, which serves as a notch or a cutout and is provided on the container body 33, and the cover hook 340 provided on the container front end cover 34. FIG. 41B is an enlarged view for explaining the configuration of the opening 3063. FIG. 41C is an enlarged view for explaining the configuration of the cover hook 340.

The opening 3063 provided on the cover hook stopper 306 according to the sixth example differs from the openings according to the above described examples. The opening 3063 includes an opening inclined portion 3063*a* and an opposite surface 3063*b*, which is inclined in the same direction as and parallel to the opening inclined portion 3063*a*. The opening 3063 includes a concave portion 4063, which serves as a guiding portion, a depressed portion, or a recess and which is provided in a second port 3063*d* of the opening 3063 on the end surface 306*a* side so as to be recessed in the detachment direction Q1. The concave portion 4063 includes a first surface 4063*a*, which is parallel to the end surface 306*a* and continued to the opposite surface 3063*b*, and includes a second surface 4063*b*, which is connected to the first surface 4063*a* and the end surface 306*a*. The second surface 4063*b* is a surface inclined downward from the upstream side to the downstream side in the detachment direction Q1 from the end surface 306*a*.

In the sixth example, in the opening 3063, an interval between the opening inclined portion 3063*a* and the opposite surface 3063*b* is denoted by "t"; the width of the opening 3063 on a first port 3063*c* side on the end surface 306*b* side in the attachment rotation direction R is denoted by "a"; and the width of the opening 3061 on in the attachment rotation direction R is denoted by "b". The first port 3063*c* serves as an outlet port. The second port 3063*d* serves as an inlet port (an upperstream end port, an inlet, or a second portion of opening). The second port 3063*d* of the opening 3063 corresponds to a width between an end S23, which is defined by the opening inclined portion 3063*a* and the end surface 306*a*, and an end S34, which is defined by the second surface 4063*b* and the end surface 306*a*, in the attachment rotation direction R, and this width is assumed as the width "b" of the guiding portion in the rotation direction.

Further, the relation of (the thickness "d" of the cover hook 340)≤(the interval "t" of the opening 3063), the relation of (the width "a" of the first port 3063*c* of the opening 3063)<(the width "e" of the upper surface 340*c* of the cover hook 340), and the relation of (the width "c" of the bottom surface 340*b* of the cover hook 340)<(the width "b" of the guiding portion 4063) are satisfied.

Figure 42A:
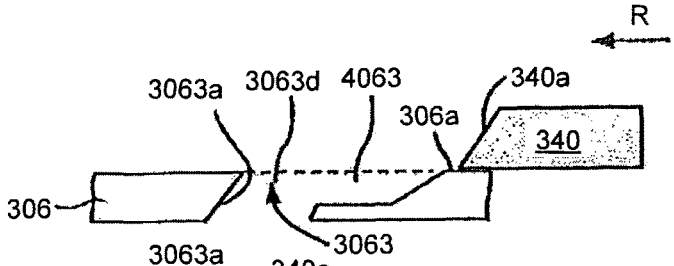
FIGS. 42A to 42I are diagrams for explaining operation of the opening and the protrusion according to the sixth example of the second embodiment.
Figure 42B:
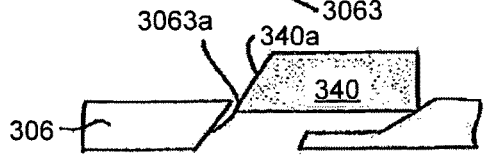
Figure 42C:
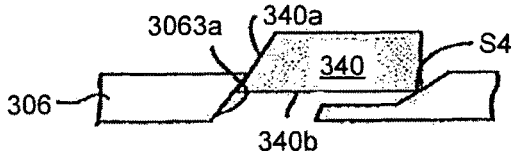

The entering operation of the cover hook 340 at the opening 3063 configured as described above will be described with reference to FIGS. 42A to 42I. As illustrated in FIG. 42A, when the container front end cover 34 is rotated in the attachment rotation direction R, the cover hook 340 moves from the right to the left on the end surface 306*a* in FIG. 42A. When the cover hook 340 is located above the guiding portion 4063 of the second port 3063*d* of the opening 3063, the cover hook 340 is pressed toward the opening 3063 as illustrated in FIG. 42B. Accordingly, because the relation of (the width "c" of the bottom surface 340*b* of the cover hook 340)<(the width "b" of the guiding portion) is satisfied, the cover hook 340 continuously moves while maintaining the same posture until the inclined portion 340*a* of the protrusion comes in contact with the opening inclined portion 3063*a* as illustrated in FIG. 42C.

Figure 42D:
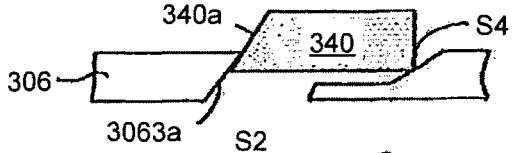
Figure 42E:
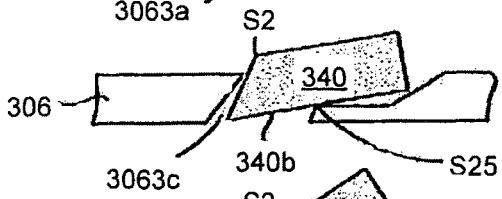

When the inclined portion 340*a* of the protrusion comes in contact with the opening inclined portion 3063*a*, the cover hook 340 rotates counterclockwise in the figures on the second surface 4063*b* by using the end S4 of the bottom surface 340*b* of the cover hook 340 on the upstream side in the attachment rotation direction R as a pivot as illustrated in FIG. 42D. Subsequently, during the rotation, as illustrated in FIG. 42E, the bottom surface 340*b* of the cover hook 340 comes in contact with an end S25 of the second port 3063*d*, and the cover hook 340 further rotates counterclockwise.

Figure 42F:
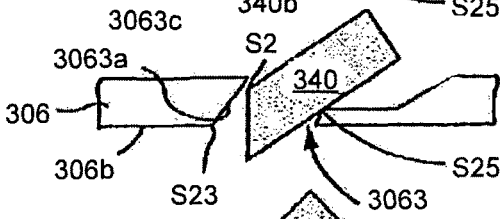
Figure 42G:
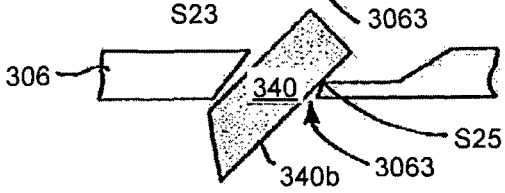
Figure 42H:
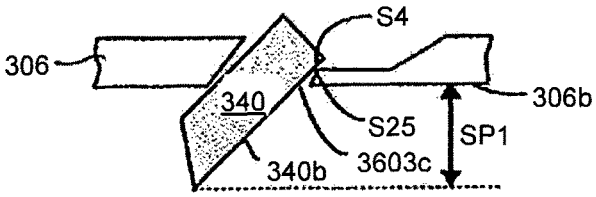
Figure 42I:
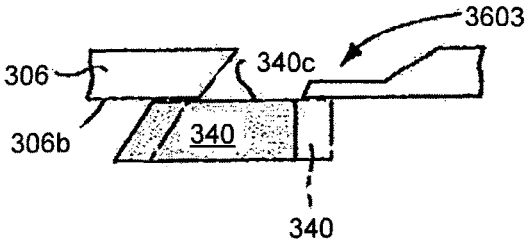

As illustrated in FIG. 42F, the end S2 defined by the inclined portion 340*a* and the upper surface 340*c* of the cover hook 340 passes by an end S23 defined by the opening inclined portion 3063*a* and the end surface 306*a* located on the downstream side in the attachment rotation direction R. At this time, because the relation of (the thickness "d" of the cover hook 340)≤(the interval "t" of the opening 3063), the cover hook 340 passes through the opening 3063 as illustrated in FIGS. 42G and 42H. When the upstream end S4 of the bottom surface 340*b* of the cover hook 340 in the attachment rotation direction R passes by the end S25 of the first port 3063*c* of the opening 3063, the upper surface 340*c* of the cover hook 340 and the end surface 306*b* face each other as illustrated in FIG. 42I. At this time, if the length of the interval SP1 between the end surface 306*b* and a component of the container body 33 located on the downstream side in the detachment direction Q1 is set such that the cover hook 340 can sufficiently rotate and the end S4 can pass by the first port 3063*c*, rotational displacement of the cover hook 340 in the opening 3062 is smoothly performed, which is preferable.

That is, the opening 3063 is configured such that when the inclined portion 340*a* of the protrusion comes in contact with the opening inclined portion 3063*a*, the cover hook 340 passes through the opening 3063.

When the cover hook 340 passes through the opening 3063 that is provided in an inclined manner on the cover hook stopper 306 as described above, an engaged state is obtained, in which the upper surface 340*c* of the cover hook 340 and the end surface 306*b* of the cover hook stopper 3063 face each other while maintaining the state of being hooked with each other. Therefore, it is possible to ensure the attached state between the container body 33 and the container front end cover 34, and simplify the assembly and attachment.

Further, the width "a" of the guiding portion 4063 of the opening 3063 is smaller than the width "e" of the upper surface 340*c* of the cover hook 340, so that even when the opening 3063 and the cover hook 340 face each other, the cover hook 340 does not easily pass through the opening 3063. Therefore, for example, when the toner container 32 is attached to and detached from the toner replenishing device 60, and even if a stress (restoring force) for compressing the container shutter spring 336 and a stress caused by the compression of the nozzle shutter spring 613 are applied to the toner container 32, the container body 33 and the container front end cover 34 are not detached from each other. Consequently, it is possible to improve the operability when the toner container 32 is attached and detached.

Seventh Example

Figure 43A:
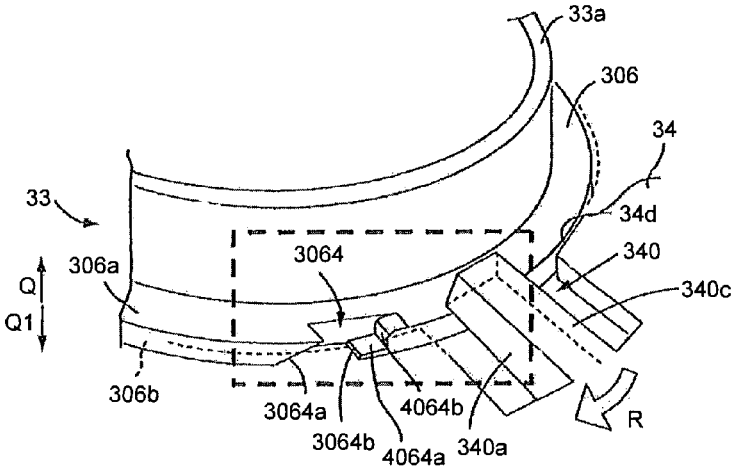
FIG. 43A is an enlarged view for explaining configurations of a protrusion and the vicinity of an opening according to a seventh example of the second embodiment.
Figure 43B:
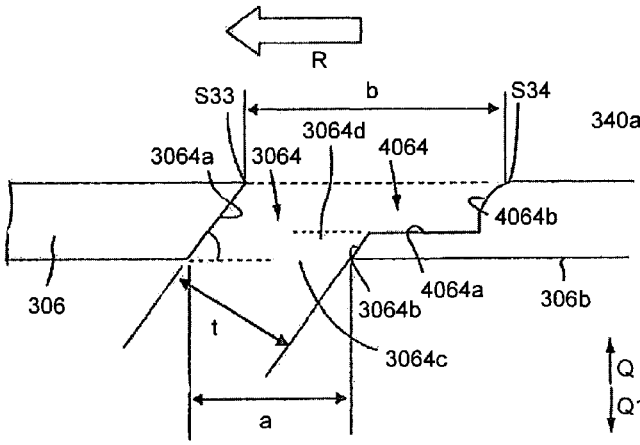
FIG. 43B is an enlarged view for explaining the configuration of the opening.
Figure 43C:
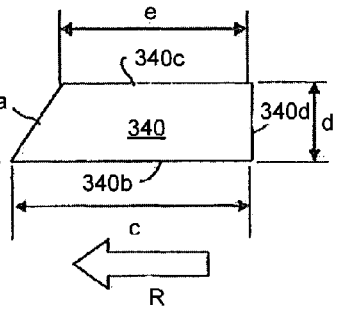
FIG. 43C is a diagram for explaining the configuration of the protrusion.

FIGS. 43A to 43C illustrate a cover hook and an opening according to a seventh example. FIG. 43A is a partially-enlarged perspective view illustrating the configurations of an opening 3064, which serves as a notch or a cutout and is provided on the container body 33, and the cover hook 340 provided on the container front end cover 34. FIG. 43B is an enlarged view for explaining the configuration of the opening 3064. FIG. 43C is an enlarged view for explaining the configuration of the cover hook 340.

The opening 3064 provided on the cover hook stopper 306 according to the seventh example differs from the openings according to the above described examples. The opening 3064 includes an opening inclined portion 3064*a* and an opposite surface 3064*b*, which is inclined in the same direction as and parallel to the opening inclined portion 3064*a*. The opening 3064 includes a concave portion 4064 which serves as a guiding portion, a depressed portion or a recess and which is provided in a second port 3064*d* of the opening 3064 on the end surface 306*a* side so as to be recessed in the detachment direction Q1. The concave portion 4064 includes a first surface 4064*a*, which is parallel to the end surface 306*a* and continued to the opposite surface 3064*b*, and includes a second surface 4064*b*, which is connected to the first surface 4064*a* and the end surface 306*a*.

In the seventh example, in the opening 3064, an interval between the opening inclined portion 3064*a* and the opposite surface 3064*b* is denoted by "t"; the width of the opening 3064 on the end surface 306*b* side in the attachment rotation direction R is denoted by "a"; and the width of the opening 3064 on the second port 3064*d* side in the attachment rotation direction R is denoted by "b". The first port 3064*c* serves as an outlet port (a downstream end port, an outlet, or a first portion of the opening). The second port 3064*d* serves as an inlet port (an upperstream end port, an inlet, or a second portion of opening). The second port 3064*d* of the opening 3064 corresponds to the width between an end S33, which is provided by the opening inclined portion 3064*a* and the end surface 306*a*, and the second surface 4064*b* in the attachment rotation direction R, and this width is assumed as the width "b" of the guiding portion in the rotation direction R. An end 35, which is defined by the opposite surface 3064*b* and the first surface 4064*a*, and an end S34, which is defined by the second surface 4064*b* and the end surface 306*a*, are chamfered in arc shapes.

Further, the relation of (the thickness "d" of the cover hook 340)≤(the interval "t" of the opening 3063), the relation of (the width "a" of the first port 3064*c* of the opening 3064)<(the width "e" of the upper surface 340*c* of the cover hook 340), and the relation of (the width "c" of the bottom surface 340*b* of the cover hook 340)<(the width "b" of the guiding portion (concave portion) 4064) are satisfied.

Figure 44A:
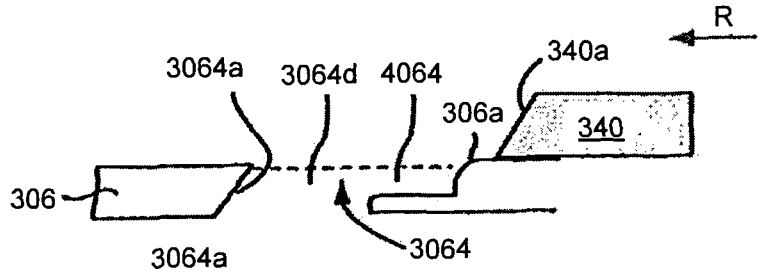
FIGS. 44A to 44G are diagrams for explaining operation of the opening and the protrusion according to the seventh example of the second embodiment.
Figure 44B:
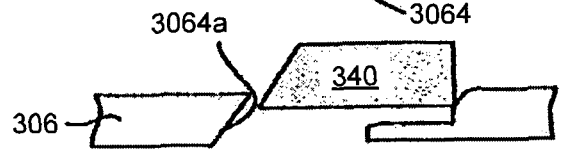
Figure 44C:
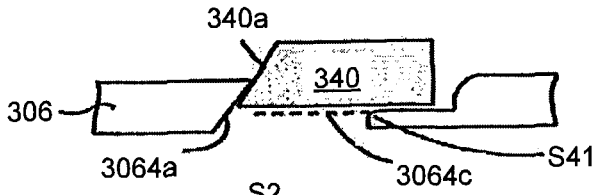

The entering operation of the cover hook 340 at the opening 3064 configured as described above will be described with reference to FIGS. 44A to 44G. As illustrated in FIG. 44A, when the container front end cover 34 is rotated in the attachment rotation direction R, the cover hook 340 moves from the right to the left on the end surface 306*a* in FIG. 44A. When the cover hook 340 is located above the guiding portion 4064 of the second port 3064*d* of the opening 3064, the cover hook 340 is pressed toward the opening 3064 as illustrated in FIG. 44B. Accordingly, because the relation of (the width "c" of the bottom surface 340*b* of the cover hook 340)<(the width "b" of the guiding portion) is satisfied, the cover hook 340 falls by gravity and continuously moves while maintaining the same posture until the inclined portion 340*a* comes in contact with the opening inclined portion 3064*a* as illustrated in FIG. 44C.

Figure 44D:
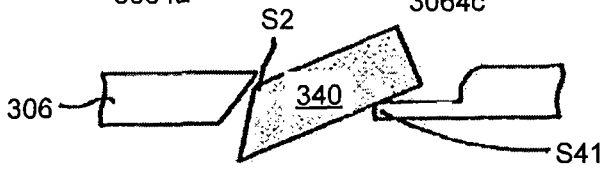
Figure 44E:
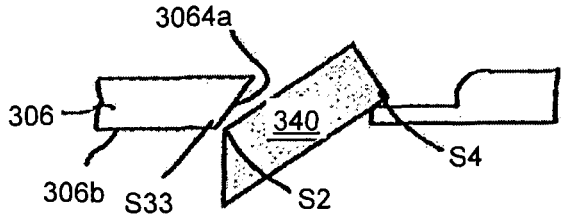
Figure 44F:
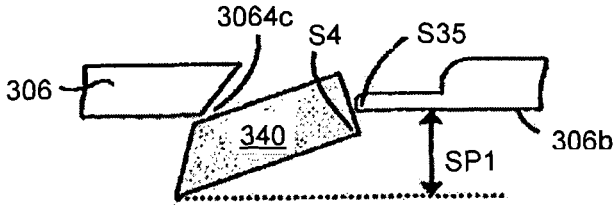
Figure 44G:
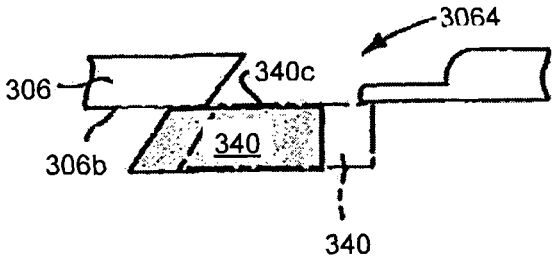

When the inclined portion 340*a* of the protrusion comes in contact with the opening inclined portion 3064*a*, as illustrated in FIG. 44D, the bottom surface 340*b* of the cover hook 340 comes in contact with an end S41 of the first port 3064*c*, and the cover hook 340 rotates counterclockwise in the figures. At this time, because the relation of (the thickness "d" of the cover hook 340) (the interval "t" of the opening 3064) is satisfied, the end S2, which is defined by the inclined portion 340*a* and the upper surface 340*c* of the cover hook 340, passes by an end S33 defined by the opening inclined portion 3064*a* and the end surface 306*a* on the downstream side in the attachment rotation direction R. Further, as illustrated in FIG. 44E, the cover hook 340 passes through the opening 3064, and the upstream end S4 of the bottom surface 340*b* of the cover hook 340 in the attachment rotation direction R passes by an end S35 of the first port 3064*c* located on the upstream side in the attachment rotation direction R as illustrated in FIG. 44F. Accordingly, as illustrated in FIG. 44G, the upper surface 340*c* of the cover hook 340 and the end surface 306*b* face each other. At this time, if the length of the interval SP1 between the end surface 306*b* and a component of the container body 33 located on the downstream side in the detachment direction Q1 is set such that the cover hook 340 can sufficiently rotate and the end S4 can pass by the first port 3064*c*, rotational displacement of the cover hook 340 in the opening 3062 is smoothly performed, which is preferable.

That is, the opening 3064 is configured such that when the inclined portion 340*a* of the protrusion comes in contact with the opening inclined portion 3064*a*, the cover hook 340 passes through the opening 3064.

When the cover hook 340 passes through the opening 3064 that is provided in an inclined manner on the cover hook stopper 306 as described above, an engaged state is obtained, in which the upper surface 340*c* of the cover hook 340 and the end surface 306*b* of the cover hook stopper 306 face each other while maintaining the state of being hooked with each other. Therefore, it is possible to ensure the attached state between the container body 33 and the container front end cover 34, and simplify the assembly and attachment.

Further, the width "a" of the first port 3064*c* of the opening 3064 is smaller than the width "e" of the upper surface 340*c* of the cover hook 340, so that even when the opening 3064 and the cover hook 340 face each other, the cover hook 340 does not easily pass through the opening 3064.

Therefore, for example, when the toner container 32 is attached to and detached from the toner replenishing device 60, and even if a stress (restoring force) for compressing the container shutter spring 336 and a stress caused by the compression of the nozzle shutter spring 613 are applied to the toner container 32, the container body 33 and the container front end cover 34 are not detached from each other. Consequently, it is possible to improve the operability when the toner container 32 is attached and detached.

Figure 45A:
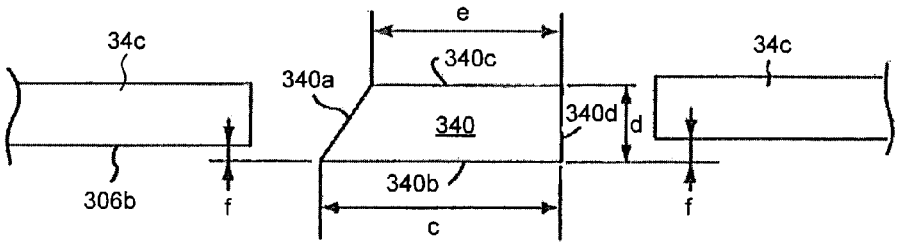
FIGS. 45A to 45C are diagrams illustrating a modification of the fourth to the seventh examples of the second embodiment.
Figure 45B:
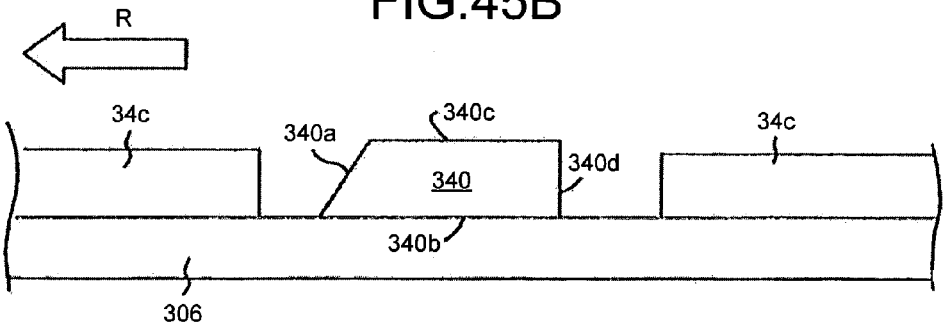
Figure 45C:
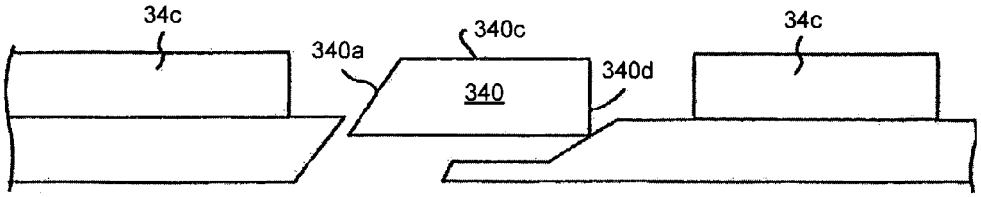

In the fifth to the seventh examples, the cover hook 340 is pressed and entered into the opening similarly to the fourth example; however, it is not limited thereto. As illustrated in FIGS. 45A to 45C, a configuration may be such that the cover hook 340 enters the opening when the container front end cover 34 is rotated in the attachment rotation direction R while the container front end cover 34 is brought into contact with the cover hook stopper 306. For example, as illustrated in FIG. 45A, the bottom surface 340*b* protrudes downward by f relative to the end surface 306*b*. When the container body 33 is inserted in the container front end cover 34 and abuts against the cover hook stopper 306, the cover hook 340 is elastically deformed in the Q direction (FIG. 45B). Because the width "e" of the upper surface 340*c* of the cover hook 340 is set to be smaller than the width "b" of the second port of each of the openings, when the container front end cover 34 is rotated in the attachment rotation direction R from the state illustrated in FIG. 45B and the cover hook 340 is located on the second port side of each of the openings, the cover hook 340 starts to fall with movement in the attachment rotation direction R (FIG. 45C). Therefore, it becomes possible to easily engage the cover hook 340 with the cover hook stopper 306 by only rotating the container front end cover 34, rather than pressing the container front end cover 34 including the cover hook 340 in the detachment direction Q1 as in the fourth example. Consequently, attachment operability can be improved. FIGS. 45A to 45C are applied to the opening of the sixth example; however, they are applicable to the openings of the fifth and the seventh examples.

Next, eighth to tenth examples will be described. In the eighth to the tenth examples, an opening provided on the cover hook stopper 306 is the same as the opening 3061 of the fourth example, and the shape of a cover hook which serves as a protrusion and is provided on the container front end cover 34 side is different. In the descriptions below, it is assumed that the relationship between the cover hook and the front surface 34*c* is the same as the relationship illustrated in FIGS. 45A to 45C; however, the relationships described in the fourth to the seventh examples are applicable.

Eighth Example

Figure 46A:
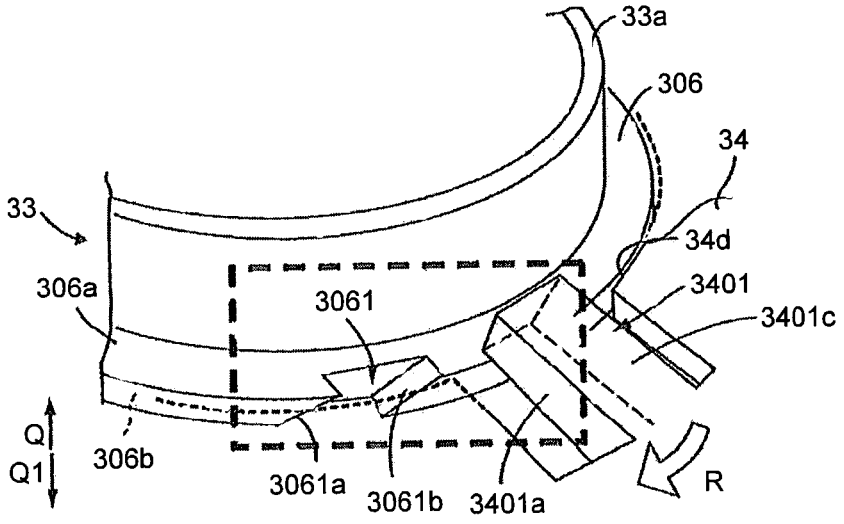
FIG. 46A is an enlarged view for explaining configurations of a protrusion and the vicinity of an opening according to an eighth example of the second embodiment.
Figure 46B:
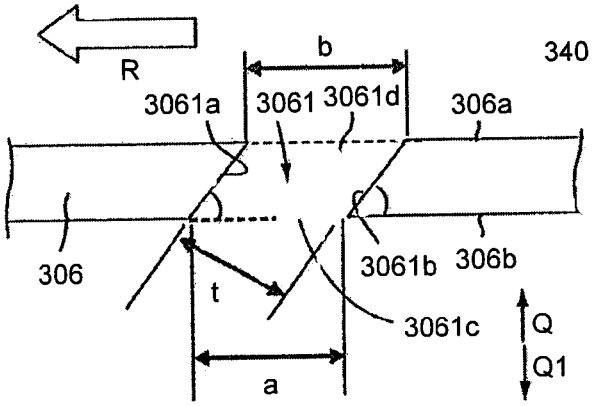
FIG. 46B is an enlarged view for explaining the configuration of the opening.
Figure 46C:
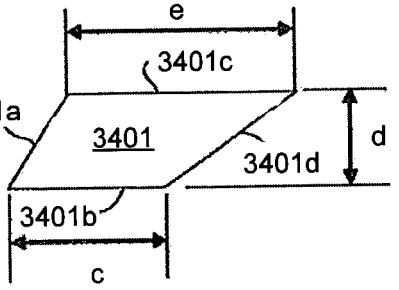
FIG. 46C is a diagram for explaining the configuration of the protrusion.

FIGS. 46A to 46C illustrate a cover hook and an opening according to the eighth example. FIG. 46A is a partially-enlarged perspective view illustrating the configurations of the opening 3061 provided on the container body 33 and a cover hook 3401 provided on the container front end cover 34. FIG. 46B is an enlarged view for explaining the configuration of the opening 3061. FIG. 46C is an enlarged view for explaining the configuration of the cover hook 3401.

In the eighth example, the cover hook 3401 includes an inclined portion 3401*a* of the protrusion, which is inclined in the attachment rotation direction R, on the end surface serving as an end located in the attachment rotation direction R. The inclined portion 3401*a* of the protrusion is an inclined surface with a flat top surface. A surface of the cover hook 3401, which is continued from the inclined portion 3401*a* and faces the end surface 306*a*, is referred to as a bottom surface 3401*b* of the cover hook 3401. The bottom surface 3401*b* serves as a second surface of the protrusion. A surface of the cover hook 340, which is continued from the inclined portion 3401*a* and located on the side opposite to the bottom surface 3401*b* of the cover hook 3401, is referred to as an upper surface 3401*c* of, the cover hook 3401. The upper surface 3401*c* serves as a first surface of the protrusion. A surface located opposite to the inclined portion 3401*a* of the protrusion is referred to as a side surface 3401*d* of the cover hook 3401.

The inclined portion 3401*a* of the protrusion is an inclined surface parallel to the opening inclined portion 3061*a*, and the side surface 3401*d* of the cover hook 3401 is provided as an inclined surface inclined by an acute angle with respect to the attachment rotation direction R rather than being parallel to the opening inclined portion 3061*a*. Further, the width of the bottom surface 3401*b* of the cover hook 3401 in the attachment rotation direction R is denoted by "c"; the width of the upper surface 3401*c* of the cover hook 3401 in the attachment rotation direction R is denoted by "e"; and the thickness between the bottom surface 3401*b* and the upper surface 3401*c* of the cover hook 3401, which is the thickness of the cover hook 3401, in the attachment/detachment direction is denoted by "d". In the cover hook 3401, the width "e" of the upper surface 3401*c* of the cover hook 3401 is greater than the width "c" of the bottom surface 3401*b* of the cover hook 3401. The cover hook 3401 has a trapezoidal cross-section, in which the inclined portion 3401*a* of the protrusion serves as an inclined surface inclined downward in the detachment direction Q1 from the upper surface 3401*c* of the cover hook 3401 to the bottom surface 3401*b* of the cover hook 3401 with respect to the attachment rotation direction R.

In the eighth example, the relation of (the thickness "d" of the cover hook 3401)≤(the interval "t" of the opening 3061), the relation of (the width "a" of the first port 3061*c* of the opening 3061)<(the width "e" of the upper surface 3401*c* of the cover hook 3401), and the relation of (the width "c" of the bottom surface 3401*b* of the cover hook 3401)<(the width "b" of the second port 3061*d* of the opening 3061) are satisfied.

Figure 47A:
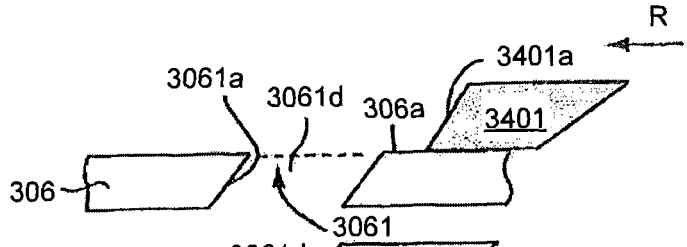
FIGS. 47A to 47H are diagrams for explaining operation of the opening and the protrusion according to the eighth example of the second embodiment.
Figure 47B:
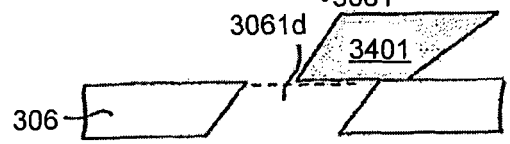
Figure 47C:
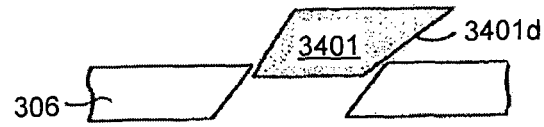
Figure 47D:
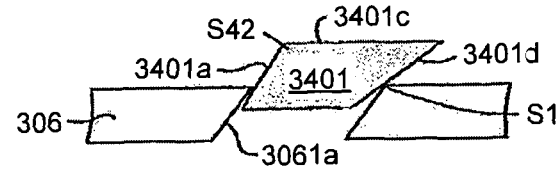

The entering operation of the cover hook 3401 at the opening 3061 configured as described above will be described with reference to FIGS. 47A to 47H. As illustrated in FIG. 47A, when the container front end cover 34 is rotated in the attachment rotation direction R, the cover hook 3401 moves from the right to the left on the end surface 306*a* in FIG. 47A. As illustrated in FIGS. 47B and 47C, when the cover hook 3401 is located above the second port 3061*d* the opening 3061, because the relation of (the width "c" of the bottom surface 3401*b* of the cover hook 3401)<(the width "b" of the second port 3061*d* of the opening 3061) is satisfied, the cover hook 340 falls while being elastically deformed and then restored. Accordingly, the side surface 3401*d* of the cover hook 3401 comes in contact with the end S1 as illustrated in FIG. 47D.

Figure 47E:
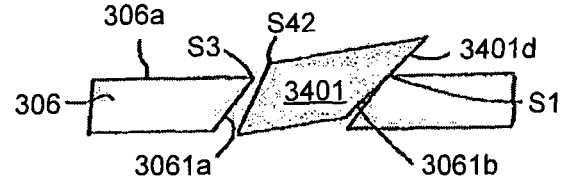
Figure 47F:
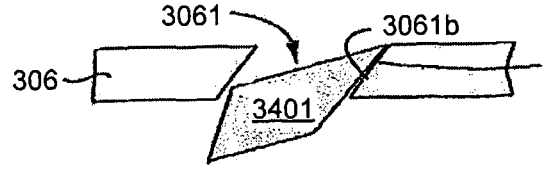
Figure 47G:
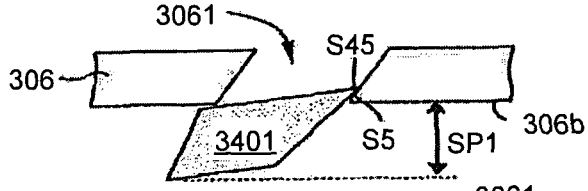
Figure 47H:
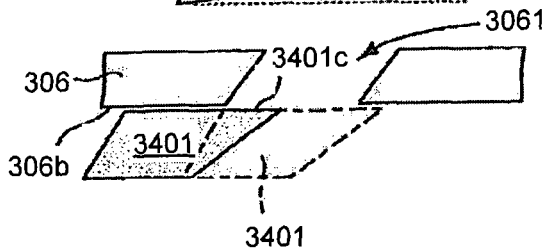

When the side surface 3401*d* of the cover hook 3401 comes in contact with the end S1, the cover hook 3401 rotates counterclockwise by using the contact point as a pivot as illustrated in FIG. 47E. Then, an end S42, which is defined by the inclined portion 3401*a* of the protrusion and the upper surface 3401*c* of the cover hook 3401, passes by the end S3 on the insertion side, which is defined by the opening inclined portion 3061*a* and the end surface 306*a* on the downstream side in the attachment rotation direction R. At this time, because the relation of (the thickness "d" of the cover hook 3401)≤(the interval "t" of the opening 3061) is satisfied, the side surface 3401*d* of the cover hook 3401 is guided by the opposite surface 3061*b* and passes through the opening 3061 as illustrated in FIGS. 47F and 47G. When an upstream end S45 of the upper surface 3401*c* of the cover hook 3401 in the attachment rotation direction R passes by the end S5 of the first port 3061*c* of the opening 3061 located on the upstream side in the attachment rotation direction R, the upper surface 3401*c* of the cover hook 3401 and the end surface 306*b* face each other as illustrated in FIG. 47H. At this time, if the length of an interval SP1 between the end surface 306*b* and a component of the container body 33 located on the downstream side in the detachment direction Q1 is set such that the cover hook 340 can sufficiently rotate and the end S4 can pass by the first port 3061*c*, rotational displacement of the cover hook 340 in the opening 3061 is smoothly performed, which is preferable.

That is, the opening 3061 is configured such that when the inclined portion 3401*a* of the protrusion comes in contact with the opening inclined portion 3061*a*, the cover hook 3401 passes through the opening 3061.

When the cover hook 3401 passes through the opening 3061 that is provided in an inclined manner on the cover hook stopper 306 as described above, an engaged state is obtained, in which the upper surface 3401*c* of the cover hook 3401 and the end surface 306*b* of the cover hook stopper 3061 face each other while maintaining the state of being hooked with each other. Therefore, it is possible to ensure the attached state between the container body 33 and the container front end cover 34, and simplify the assembly and attachment.

Further, the width "a" of the first port 3061*c* of the opening 3061 is smaller than the width "e" of the upper surface 3401*c* of the cover hook 3401, so that even when the opening 3061 and the cover hook 3401 face each other, the cover hook 3401 does not easily pass through the opening 3061.

Therefore, for example, when the toner container 32 is attached to and detached from the toner replenishing device 60, and even if a stress (restoring force) for compressing the container shutter spring 336 and a stress caused by the compression of the nozzle shutter spring 613 are applied to the toner container 32, the container body 33 and the container front end cover 34 are not detached from each other. Consequently, it is possible to improve the operability when the toner container 32 is attached and detached.

Ninth Example

Figure 48A:
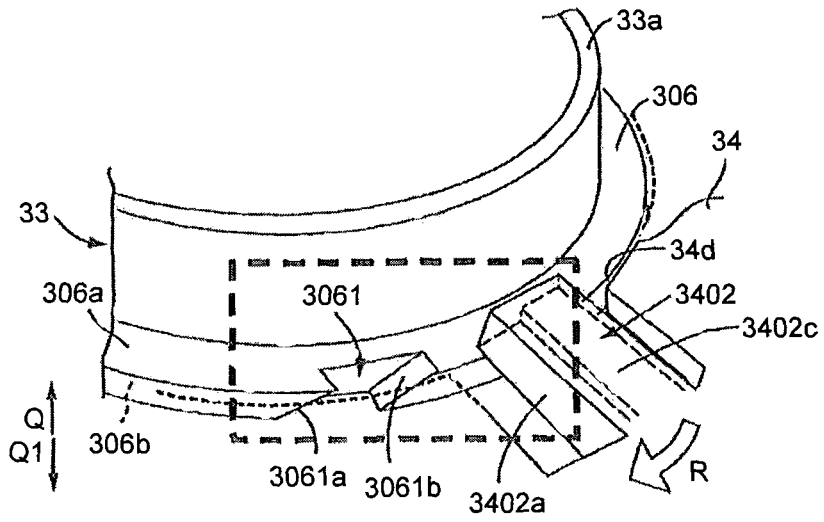
FIG. 48A is an enlarged view for explaining configurations of a protrusion and the vicinity of an opening according to a ninth example of the second embodiment.
Figure 48B:
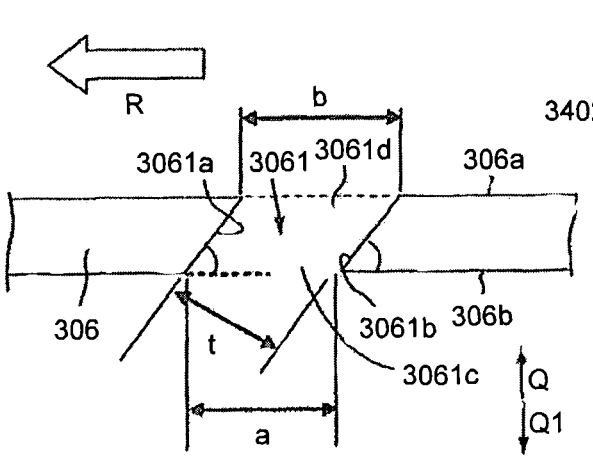
FIG. 48B is an enlarged view for explaining the configuration of the opening.
Figure 48C:
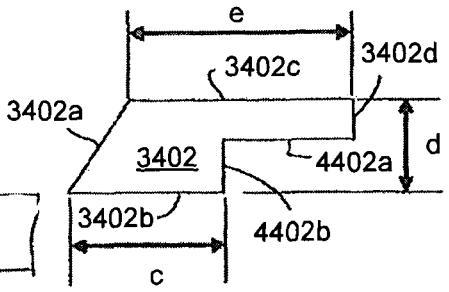
FIG. 48C is a diagram for explaining the configuration of the protrusion.

FIGS. 48A to 48C illustrate a cover hook and an opening according to the ninth example. FIG. 48A is a partially-enlarged perspective view illustrating the configurations of the opening 3061 provided on the container body 33 and a cover hook 3402 which serves as a protrusion and is provided on the container front end cover 34. FIG. 48B is an enlarged view for explaining the configuration of the opening 3061. FIG. 48C is an enlarged view for explaining the configuration of the cover hook 3402.

In the ninth example, a shape of an upstream portion of the cover hook 3402 in the attachment rotation direction R differs from that of the eighth example.

An inclined portion 3402*a* of the protrusion is an inclined surface parallel to the opening inclined portion 3061*a*. A side surface 3402*d* of the cover hook 3402 is provided so as to be recessed in the attachment rotation direction R rather than being parallel to the opening inclined portion 3061*a*. The recessed portion includes a first surface 4402*a* that is continued from the side surface 3402*d* and parallel to the end surface 306*a*, and a second surface 4402*b* that connects the first surface 4402*a* and a bottom surface 3402*b* of the cover hook 3402, which serves as a second surface of the protrusion.

In the cover hook 3402, the width of the bottom surface 3402*b* of the cover hook 3402 in the attachment rotation direction R is denoted by "c"; the width of an upper surface 3402*c* of the cover hook 3402, which serves as a first surface of the protrusion, in the attachment rotation direction R is denoted by "e"; and the thickness between the bottom surface 3402*b* and the upper surface 3402*c* of the cover hook 3402, which is the thickness of the cover hook 3402, in the attachment/detachment direction is denoted by "d". In the cover hook 3402, the width "e" of the upper surface 3402*c* of the cover hook 3402 is greater than the width "c" of the bottom surface 3402*b* of the cover hook 3402. The inclined portion 3402*a* of the protrusion is provided as an inclined surface inclined downward in the detachment direction Q1 from the upper surface 3402*c* of the cover hook 3402 to the bottom surface 3402*b* of the cover hook 3402.

In the ninth example, the relation of (the thickness "d" of the cover hook 3402)≤(the interval "t" of the opening 3061), the relation of (the width "a" of the first port 3061*c* of the opening 3061)<(the width "e" of the upper surface 3402*c* of the cover hook 3402), and the relation of (the width "c" of the bottom surface 3402*b* of the cover hook 3402)<(the width "b" of the second port 3061*d* of the opening 3061) are satisfied.

Figure 49A:
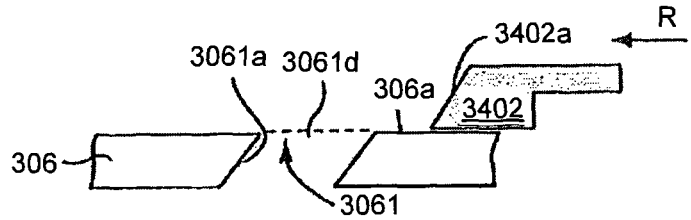
FIGS. 49A to 49H are diagrams for explaining operation of the opening and the protrusion according to the ninth example of the second embodiment.
Figure 49B:
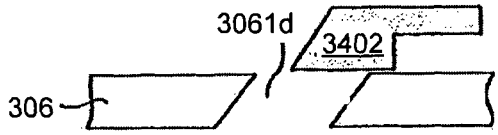
Figure 49C:
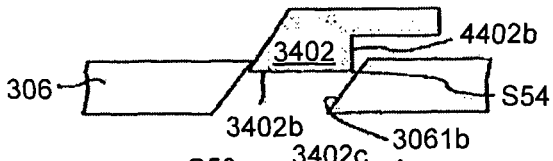
Figure 49D:
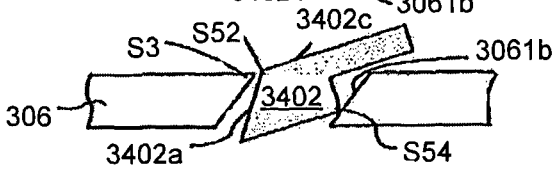

The entering operation of the cover hook 3402 at the opening 3061 configured as described above will be described with reference to FIGS. 49A to 49H. As illustrated in FIG. 49A, when the container front end cover 34 is rotated in the attachment rotation direction R, the cover hook 3402 moves from the right to the left on the end surface 306*a* in FIG. 49A. As illustrated in FIGS. 49B and 49C, when the cover hook 3402 is located above the second port 3061*d* of the opening 3061, because the relation of (the width "c" of the bottom surface 3402*b* of the cover hook 3402)<(the width "b" of the second port 3061*d* of the opening 3061) is satisfied, the cover hook 3402 falls while being elastically deformed and then restored. Accordingly, as illustrated in FIG. 49D, an end S54 defined by the bottom surface 3402*b* and the second surface 4402*b* of the cover hook comes in contact with the opposite surface 3061*b*.

Figure 49E:
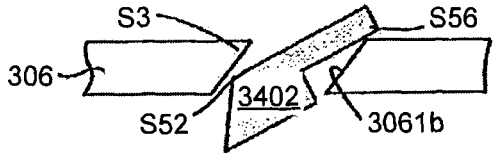
Figure 49F:
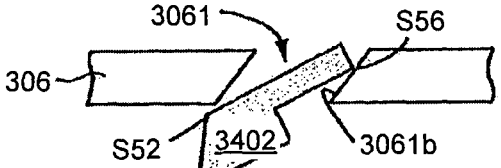
Figure 49G:
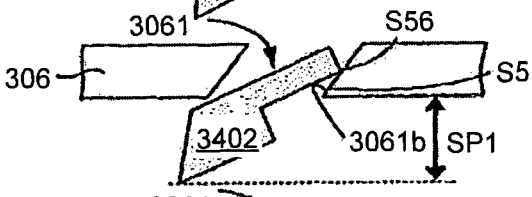
Figure 49H:
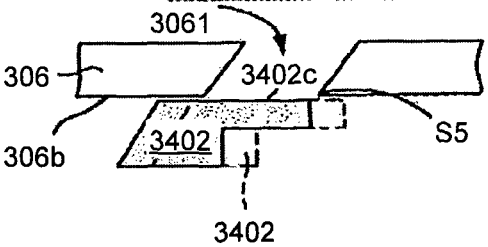

When the end S54 comes in contact with the opposite surface 3061*b*, the cover hook 3402 rotates counterclockwise by using the contact point as a pivot as illustrated in FIG. 49E. Then, an end S52 defined by the inclined portion 3402*a* and the upper surface 3402*c* of the cover hook 3402 passes by the end S3 on the insertion side, which is defined by the opening inclined portion 3061*a* and the end surface 306*a* located on the downstream side in the attachment rotation direction R. When the cover hook 3402 further rotates counterclockwise, an end S56 defined by the side surface 3402*d* and the first surface 4402*a* of the cover hook comes in contact with the end S1 of the second port 3061*d* of the opening 3061 as illustrated in FIG. 49E. Then, the cover hook 3402 rotates counterclockwise by using the contact portion as a pivot. At this time, because the relation of (the thickness "d" of the cover hook 3402) (the interval "t" of the opening 3061) is satisfied, the end S56 of the cover hook 3402 is guided by the opposite surface 3061*b* and passes through the opening 3061 as illustrated in FIGS. 49F and 49G. When the end S56 of the cover hook 3402 passes by the end S5 of the first port 3061*c* of the opening 3061 located on the upstream side in the attachment rotation direction R, the upper surface 3402*c* of the cover hook 3402 and the end surface 306*b* face each other as illustrated in FIG. 49H. At this time, if the length of an interval SP1 between the end surface 306*b* and a component of the container body 33 located on the downstream side in the detachment direction Q1 is set such that the cover hook 3402 can sufficiently rotate and the end S55 can pass by the first port 3061*c*, rotational displacement of the cover hook 3402 in the opening 3061 is smoothly performed, which is preferable.

That is, the opening 3061 is configured such that when the inclined portion 3402*a* of the protrusion comes in contact with the opening inclined portion 3061*a*, the cover hook 3402 passes through the opening 3061.

When the cover hook 3402 passes through the opening 3061 that is provided in an inclined manner on the cover hook stopper 306 as described above, an engaged state is obtained, in which the upper surface 3402*c* of the cover hook 3402 and the end surface 306*b* of the cover hook stopper 3061 face each other while maintaining the state of being hooked with each other. Therefore, it is possible to ensure the attached state between the container body 33 and the container front end cover 34, and simplify the assembly and attachment.

Further, the width "a" of the first port 3061*c* of the opening 3061 is smaller than the width "e" of the upper surface 3402*c* of the cover hook 3402, so that even when the opening 3061 and the cover hook 3402 face each other, the cover hook 3402 does not easily pass through the opening 3061. Therefore, for example, when the toner container 32 is attached to and detached from the toner replenishing device 60, and even if a stress (restoring force) for compressing the container shutter spring 336 or a stress caused by the compression of the nozzle shutter spring 613 are applied to the toner container 32, the container body 33 and the container front end cover 34 are not detached from each other. Consequently, it is possible to improve the operability when the toner container 32 is attached and detached.

Tenth Example

Figure 50A:
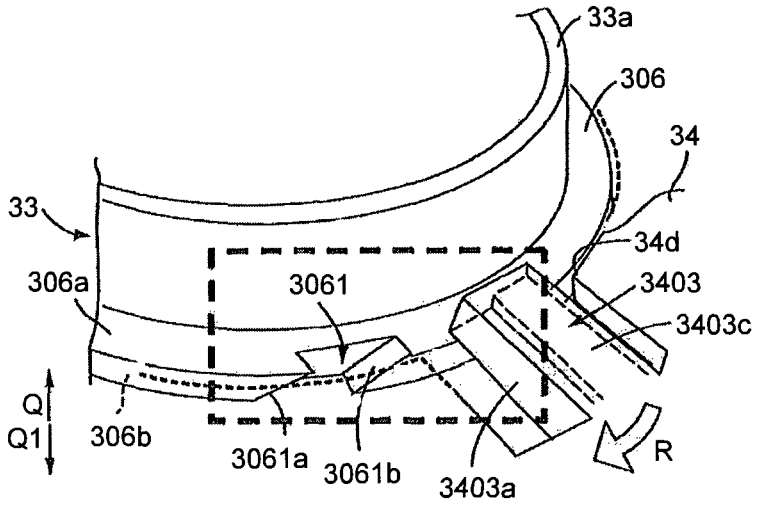
FIG. 50A is an enlarged view for explaining configurations of a protrusion and the vicinity of an opening according to a tenth example of the second embodiment.
Figure 50B:
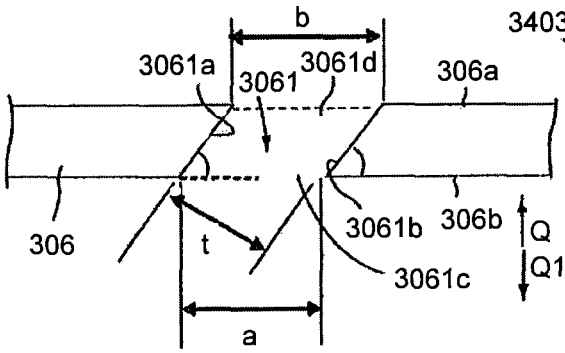
FIG. 50B is an enlarged view for explaining the configuration of the opening.
Figure 50C:
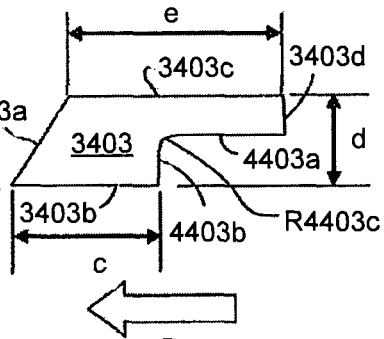
FIG. 50C is a diagram for explaining the configuration of the protrusion.
Figure 51A:
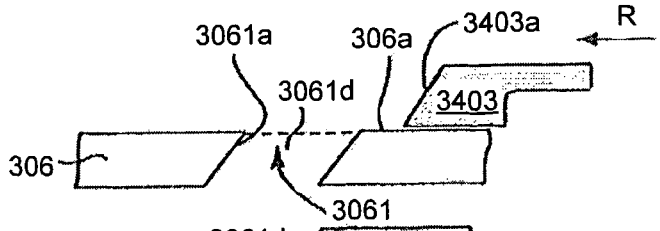
FIGS. 51A to 51H are diagrams for explaining operation of the opening and the protrusion according to the tenth example of the second, embodiment.
Figure 51B:
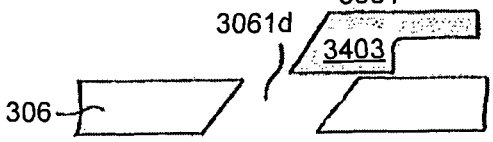
Figure 51C:
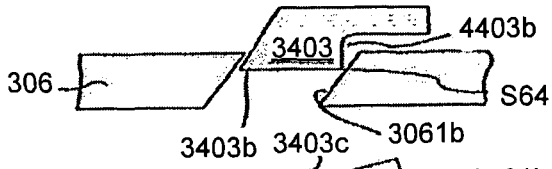
Figure 51D:
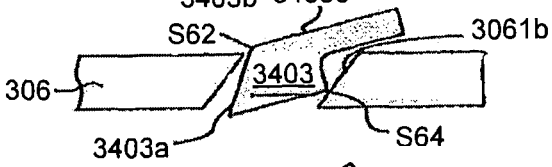
Figure 51E:
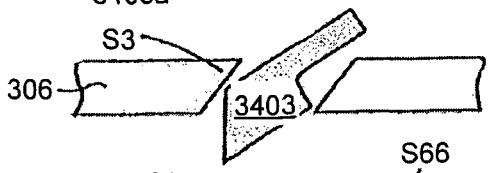
Figure 51F:
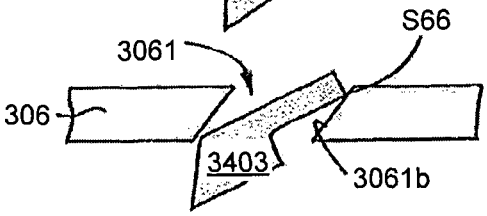
Figure 51G:
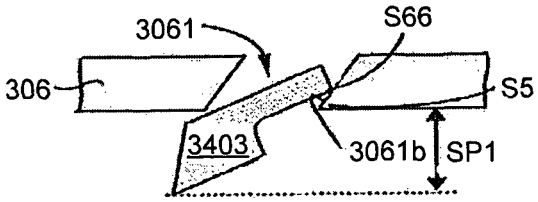
Figure 51H:
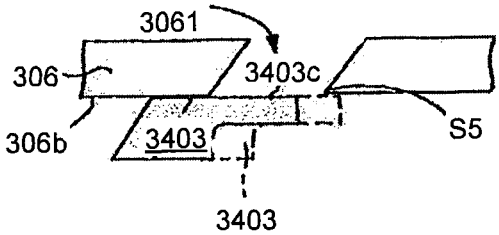

FIGS. 50A to 50C illustrate a cover hook and an opening according to the tenth example. FIG. 50A is a partially-enlarged perspective view illustrating the configurations of the opening 3061 provided on the container body 33 and a cover hook 3403, which serves as a protrusion and is provided on the container front end cover 34. FIG. 50B is an enlarged view for explaining the configuration of the opening 3061. FIG. 50C is an enlarged view for explaining the configuration of the cover hook 3403.

In the tenth example, a shape of a recessed portion of the cover hook 3403 differs from that of the ninth example. Other configurations are the same as those of the ninth example, and therefore, detailed explanation thereof will be omitted.

The recessed portion includes a first surface 4403*a* that is continued from a side surface 3403*d* and parallel to the end surface 306*a*, a second surface 4403*b* that is continued to a bottom surface 3403*b*, and a third surface 4403*c* that connects the first surface 4403*a* and the second surface 4403*b*. The third surface 4403*c* has a curved surface shape.

The entering operation of the cover hook 3403 at the opening 3061 is illustrated in FIGS. 51A to 51H. The entering operation illustrated in FIGS. 51A to 51H is the same as the entering operation illustrated in FIGS. 49A to 49H; therefore, explanation thereof will be omitted.

Eleventh Example

Figure 52A:
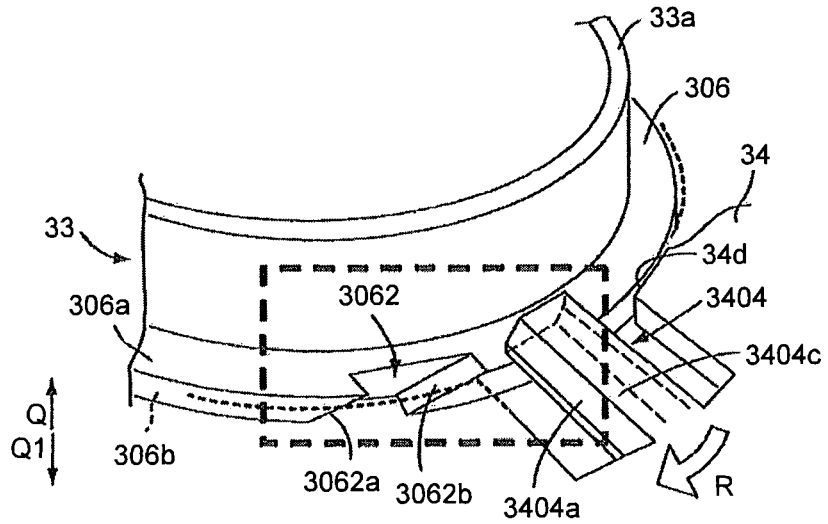
FIG. 52A is an enlarged view for explaining configurations of a protrusion and the vicinity of an opening according to an eleventh example of the second embodiment.
Figure 52B:
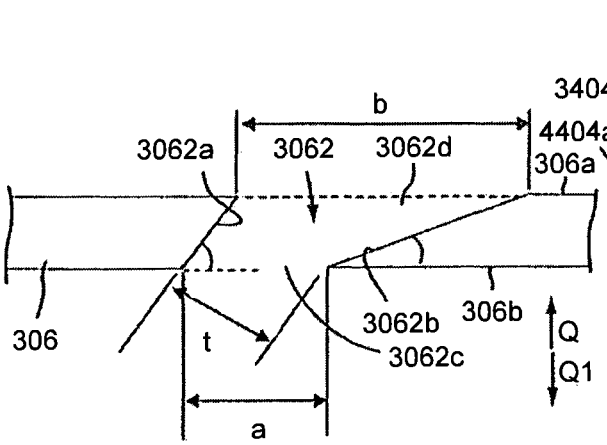
FIG. 52B is an enlarged view for explaining the configuration of the opening.
Figure 52C:
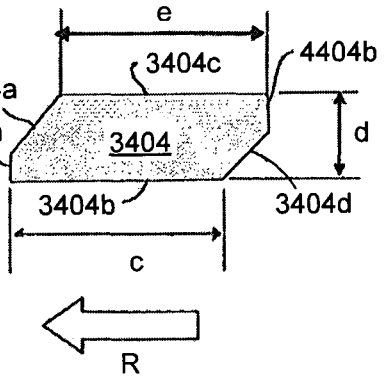
FIG. 52C is a diagram for explaining the configuration of the protrusion.

FIGS. 52A to 52C illustrate a cover hook and an opening according to the eleventh example. FIG. 52A is a partially-enlarged perspective view illustrating the configurations of the opening 3062 provided on the container body 33 and a cover hook 3404, which serves as a protrusion and is provided on the container front end cover 34. FIG. 52B is an enlarged view for explaining the configuration of the opening 3062. FIG. 52C is an enlarged view for explaining the configuration of the cover hook 3404. The shape of the opening 3062 is the same as that of the fifth example.

In the eleventh example, the cover hook 3404 includes an inclined portion 3404*a* of the protrusion, which is inclined in the attachment rotation direction R, on the end surface serving as an end located on the downstream side in the attachment rotation direction R. The inclined portion 3404*a* of the protrusion is an inclined surface with a flat top surface. A first surface 4404*a* is provided so as to be connected to an end of the inclined portion 3404*a*. The first surface 4404*a* includes a standing surface standing in a direction perpendicular to the attachment rotation direction R. A bottom surface 3404*b* of the cover hook 3404, which serves as a second surface of the protrusion, faces the end surface 306*a*. A surface, which is continued from the inclined portion 3404*a* of the protrusion and located opposite to the bottom surface 3404*b* of the cover hook 3404, is referred to as an upper surface 3404*c* of the cover hook 3404. The upper surface 3404*c* serves as a first surface of the protrusion. An inclined surface opposite to the inclined portion 3404*a* of the protrusion serves as a side surface 3404*d* of the cover hook 3404. A second surface 4404*b* parallel to the first surface 4404*a* is provided between the side surface 3404*d* and the upper surface 3404*c* of the cover hook 3404.

In the cover hook 3404, the width of the bottom surface 3404*b* of the cover hook 3404 in the attachment rotation direction R is denoted by "c"; the width of the upper surface 3404*c* of the cover hook 3404 in the attachment rotation direction R is denoted by "e"; and the thickness between the bottom surface 3404*b* and the upper surface 3404*c* of the cover hook 3404, which is the thickness of the cover hook 3404, in the attachment/detachment direction is denoted by "d". In the cover hook 3404, the width "e" of the upper surface 3404*c* of the cover hook 3404 and the width "c" of the bottom surface 3404*b* of the cover hook 3404 are the same.

In the eleventh example, the relation of (the thickness "d" of the cover hook 3404)≤(the interval "t" of the opening 3062), the relation of (the width "a" of the first port 3062*c* of the opening 3062)<(the width "e" of the upper surface 3404*c* of the cover hook 3404), and the relation of _(the width "c" of the bottom surface 3403*b* of the cover hook 3403)<(the width "b" of the second port 3062*d* of the opening 3062) are satisfied.

Figure 53A:
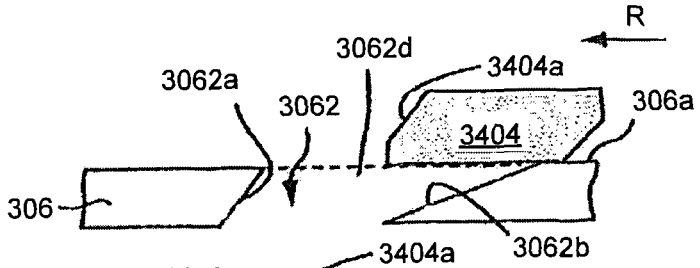
FIGS. 53A to 53G are diagrams for explaining operation of the opening and the protrusion according to the eleventh example of the second embodiment.
Figure 53B:
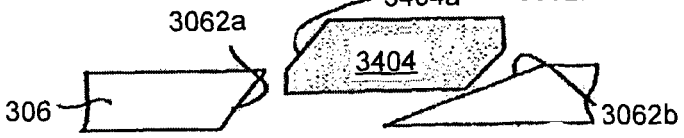
Figure 53C:
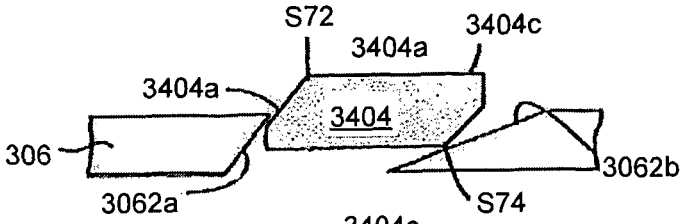

The entering operation of the cover hook 3404 at the opening 3062 configured as described above will be described with reference to FIGS. 53A to 53G. As illustrated in FIG. 53A, when the container front end cover 34 is rotated in the attachment rotation direction R, the cover hook 3404 moves from the right to the left on the end surface 306*a* in FIG. 53A. As illustrated in FIG. 53B, when the cover hook 3404 is located above the second port 3062*d* of the opening 3062, because the relation of (the width "c" of the bottom surface 3404*b* of the cover hook 3404)<(the width "b" of the second port 3062*d* of the opening 3062) is satisfied, the cover hook 3404 falls in the second port 3062*d* of the opening 3062 while being elastically deformed and then restored. The falling continues until the inclined portion 3404*a* of the protrusion comes in contact with the opening inclined portion 3062*a* as illustrated in FIG. 53C.

Figure 53D:
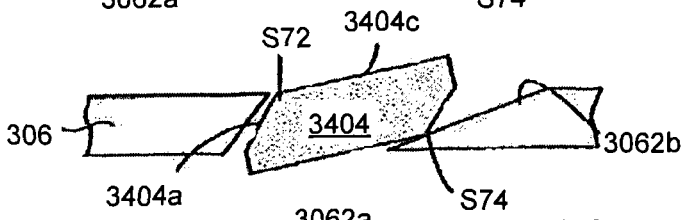
Figure 53E:
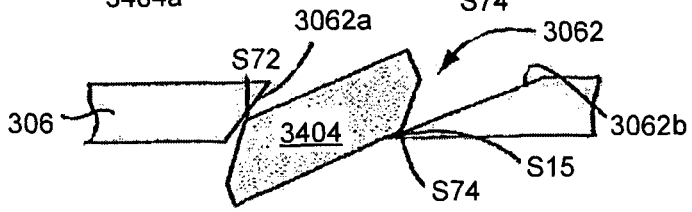
Figure 53F:
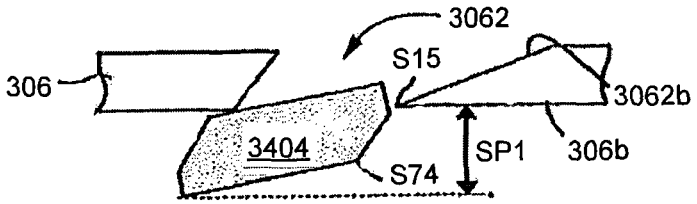
Figure 53G:
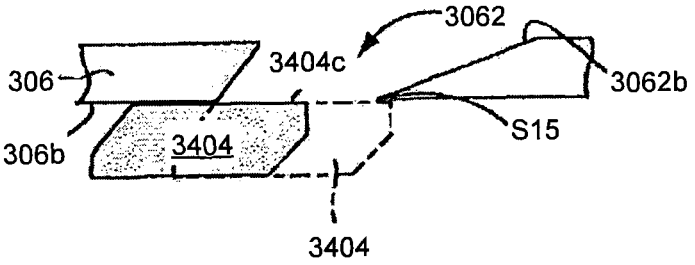

When the inclined portion 3404*a* of the protrusion comes in contact with the opening inclined portion 3062*a*, the cover hook 3404 rotates counterclockwise in the figures by using an end S74 of the bottom surface 3404*b* of the cover hook 3404 located on the upstream side in the attachment rotation direction R as a pivot on the opposite surface 3062*b*. Subsequently, as illustrated in FIG. 53D, an end S72 defined by the inclined portion 3404*a* and the upper surface 3404*c* of the cover hook 3404 passes by the end S13 of the second port 3062*d* of the opening 3062 located on the downstream side in the attachment rotation direction R. At this time, because the relation of (the thickness "d" of the cover hook 3404)≤(the interval "t" of the opening 3062) is satisfied, the end S72 of the cover hook 3404 comes in contact with the opening inclined portion 3062*a* and the cover hook 3404 passes through the opening 3062 as illustrated in FIG. 53E. At this time, the cover hook 3404 rotates clockwise by using the contact portion between the opening inclined portion 3062*a* and the end S72 as a pivot. As illustrated in FIG. 53F, the end S74 of the bottom surface 3404*b* of the cover hook passes by the end S15 of the first port 3062*c* located on the upstream side in the attachment rotation direction R. Accordingly, the side surface 3404*d* of the cover hook 3404 rotating clockwise passes through the first port 3062*c*, and the upper surface 3404*c* of the cover hook 3404 and the end surface 306*b* face each other as illustrated in FIG. 53G. At this time, if the length of an interval SP1 between the end surface 306*b* and a component of the container body 33 located on the downstream side in the detachment direction Q1 is set such that the cover hook 3404 can sufficiently rotate and the end S74 can pass by the first port 3062*c*, rotational displacement of the cover hook 3404 in the opening 3062 is smoothly performed, which is preferable.

That is, the opening 3062 is configured such that the inclined portion 3404*a* of the protrusion comes in contact with the opening inclined portion 3062*a*, the cover hook 3404 passes through the opening 3062.

When the cover hook 3404 passes through the opening 3062 that is provided in an inclined manner on the cover hook stopper 306 as described above, an engaged state is obtained, in which the upper surface 3404*c* of the cover hook 3404 and the end surface 306*b* of the cover hook stopper 3062 face each other while maintaining the state of being hooked with each other. Therefore, it is possible to ensure the attached state between the container body 33 and the container front end cover 34, and simplify the assembly and attachment.

Further, the width "a" of the first port 3062*c* of the opening 3062 is smaller than the width "e" of the upper surface 3404*c* of the cover hook 3404, so that even when the opening 3062 and the cover hook 3404 face each other, the cover hook 3404 does not easily pass through the opening 3062. Therefore, for example, when the toner container 32 is attached to and detached from the toner replenishing device 60, and even if a stress (restoring force) for compressing the container shutter spring 336 and a stress caused by the compression of the nozzle shutter spring 613 are applied to the toner container 32, the container body 33 and the container front end cover 34 are not detached from each other. Consequently, it is possible to improve the operability when the toner container 32 is attached and detached.

Further, in the eleventh example, because the relation of (the width "c" of the bottom surface 3404*b* of the cover hook 3404)<(the width "b" of the second port 3062*d* of the opening 3062) is satisfied, an angle at which the cover hook 3404 passes through the opening 3062 with respect to the rotation direction is smaller than that of the fourth example. Therefore, it is possible to reduce the interval SP1 as compared to the fourth example.

In the fourth to the eleventh examples, the attachment rotation direction R of the container front end cover 34 with respect to the container body 33 and the rotation direction A of the container body 33 with respect to the container front end cover 34 in the toner container 32 attached to the image forming apparatus are opposite to each other. Therefore, even when the toner container 32 is attached to the toner replenishing device 60 and the container body 33 is rotated, if each of the cover hooks has passed through each of the openings in the detachment direction Q1 and is maintained in the engaged state, each of the cover hooks is prevented from coming off from the cover hook stopper 306. For example, with reference to FIG. 38G, if the container body 33 rotates in the rotation direction A relative to the container front end cover 34, the cover hook stopper 306 moves from the left to the right in the figure. In this case, even if a bottom end of the opening inclined portion 3061*a* comes in contact with the inclined portion 340*a* of the protrusion, the cover hook stopper 306 moves upward with the aid of the inclined surface of the opening inclined portion 3061*a*. Therefore, rotation of the container body 33 relative to the container front end cover 34 is not restricted.

Further, when the container body 33 and the container front end cover 34 are rotated in the direction opposite to the assembly direction, and if the container body 33 is rotated in the rotation direction while being pressed toward the attachment direction Q, it is possible to easily guide each of the cover hooks to the inside of each of the openings from the end surface 306*b* side. Therefore, the container body 33 and the container front end cover 34 can easily be detached when they are separated from each other. Consequently, the recyclability can be improved.

Figure 54A:
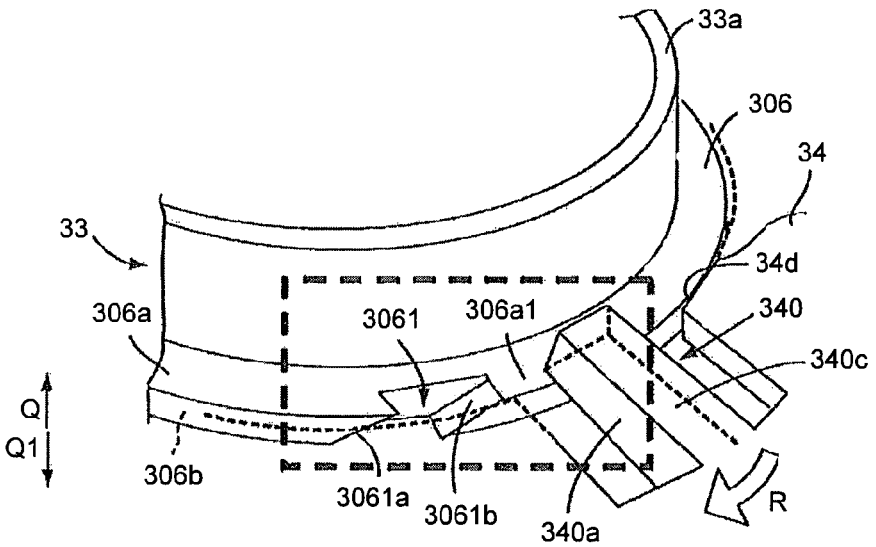
FIG. 54A is an enlarged view for explaining configurations of a protrusion and the vicinity of an opening according to another example of the second embodiment.
Figure 54B:
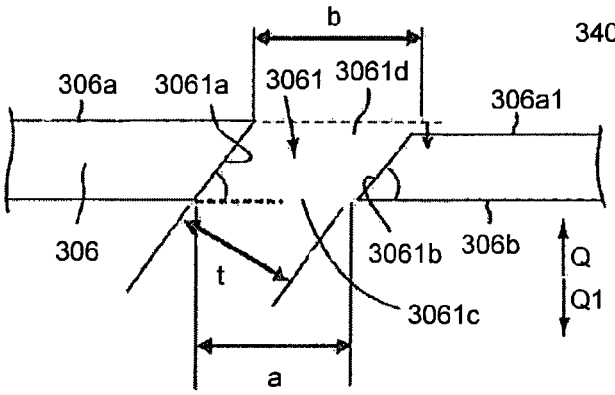
FIG. 54B is an enlarged view for explaining the configuration of the opening.
Figure 54C:
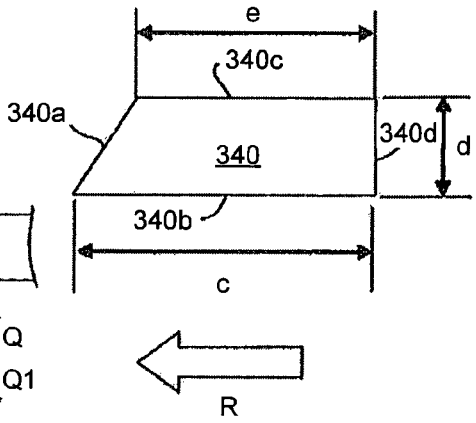
FIG. 54C is a diagram for explaining the configuration of the protrusion.

In the fourth to the eleventh examples, the end surface 306*a* of the cover hook stopper 306 is assumed as the same plane except for the openings. However, a portion of the end surface 306*a* on the upstream side in the rotation direction relative to the opening inclined portion may be provided so as to be lower in height than an end of the opening inclined portion on an insertion side in the detachment direction. In other words, when the cover hook stopper 306 is viewed with the second port of the opening facing upward, a portion of the cover stopper 306 on the upstream side in the rotation direction relative to the opening is lower in height than the end of the opening inclined portion on the second port side. In FIGS. 54A to 54C, in the configuration of the fourth example, an end surface 306*a*1 located on the upstream side in the attachment rotation direction R relative to the opening 3061 is provided such that the height thereof in the detachment direction Q1 is lower than that of the opening inclined portion 3061*a* side.

As described above, if the end surface 306*a*1 located on the upstream side in the attachment rotation direction R relative to the opening 3061 is provided such that the height thereof in the detachment direction Q1 is lower than that of the opening inclined portion 3061*a* side, the inclined portion 340*a* of the cover hook 340 and the opening inclined portion 3061*a* face each other when the container front end cover 34 is rotated. Therefore, it becomes not necessary to press the cover hook 340 in the detachment direction Q1 when the container body 33 and the container front end cover 34 are assembled, enabling to improve the operability.

The cover hooks 340, 3401 to 3404 and the opening 3061 to 3064 described in the above described examples can be used in various combinations. For example, the combination of the opening 3064 illustrated in FIG. 43B and the cover hooks 3404 illustrated in FIG. 52C can be used.

In the above described, examples, the container body 33 and the container gear 301 are integrally formed. However, the container body 33 and the container gear 301 may be separately formed depending on the resin material used for the container body 33. In this case, as illustrated in FIGS. 12A to 12C, the cover hook stopper 306 is provided on the container gear 301, any of the above described openings is provided on the cover hook stopper 306 on the container gear 301, and the container gear 301 is attached to the container body 33 in an integrated manner.

Figure 55:
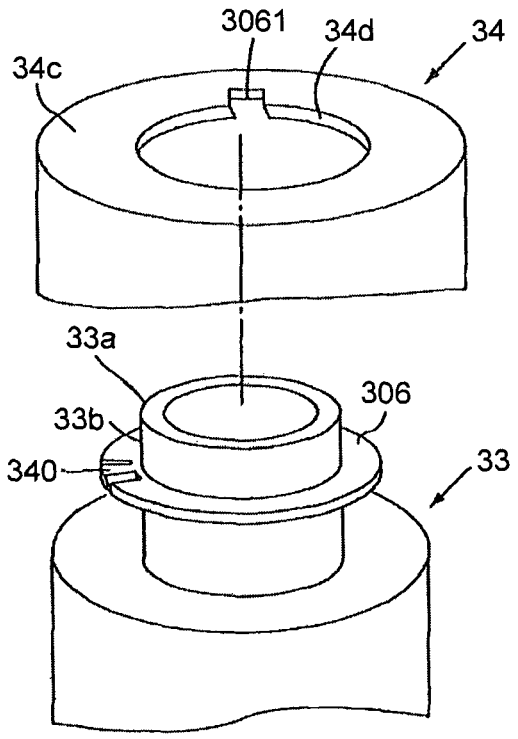
FIG. 55 is an enlarged perspective view for explaining a configuration of a protrusion of a container front end cover and configurations of a restrictor and an opening of a container body according to another example of the second embodiment.

In the above described examples, the restrictor and the opening are provided on the container body 33, and the cover hook is provided on the container front end cover 34. However, an arrangement opposite to those of the examples may be employed by providing the restrictor and the opening on the container front end cover 34 and providing the cover hook on the container body 33. In FIG. 55, the single opening 3061 is provided on the front surface 34*c* in the attachment direction so as to face the hole 34*d* of the container front end cover 34, the cover hook stopper 306 is provided on the outer surface 33*b* of the container opening 33*a* of the container body 33 in the rotation direction (circumferential direction), and the single cover hook 340 is provided on the cover hook stopper 306.

In the above described examples, the powder container of the image forming apparatus has been explained as an application example of the configuration, which includes the protrusion of the embodiments, the restrictor that extends in the rotation direction and that is hooked on the protrusion, and the opening provided on the restrictor through which the protrusion can pass in the direction perpendicular to the rotation direction.

Figure 56A:
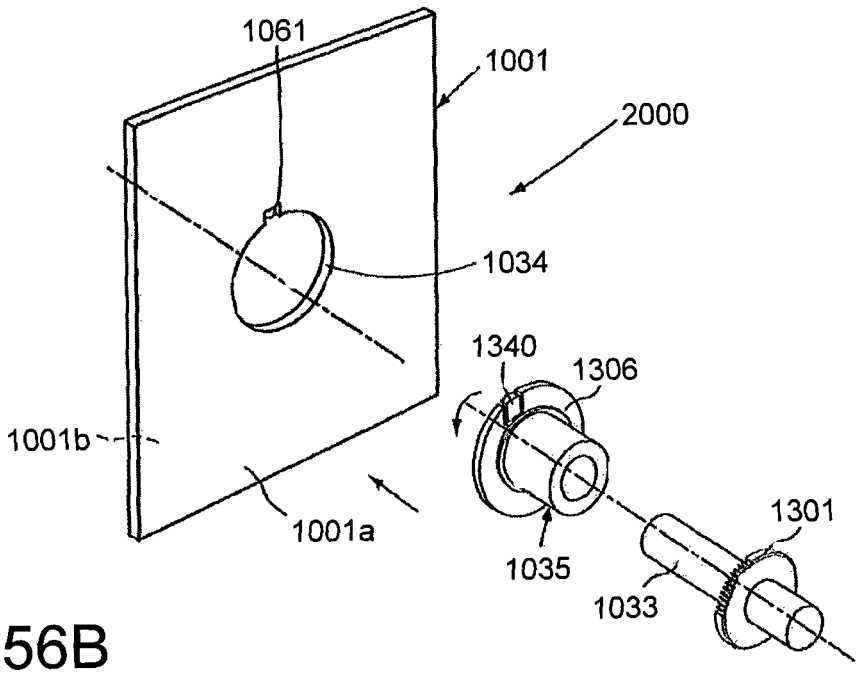
FIG. 56A is an exploded perspective view for explaining a mode in which the technology of the second embodiment is applied to a bearing attachment structure.

However, the present invention is not limited to the image forming apparatus and the powder container used in the image forming apparatus. For example, in a supporting device 2000 as illustrated in FIG. 56A, a through hole 1034 is provided on a plate-shaped frame 1001 serving as a first member, and a restrictor 1306 is provided on a bearing 1035 serving as a second member that is detachably attached to the through hole 1034 of the frame 1001 and that rotatably supports a shaft 1033 on which a gear 1301 is mounted. The restrictor 1306 also functions as a mounting flange of the bearing 1305. A hook 1340 serving as a protrusion is provided on the restrictor 1306, and an opening 1061, through which the hook 1340 can pass in a direction perpendicular to the rotation direction, is provided on the through hole 1034.

Figure 56B:
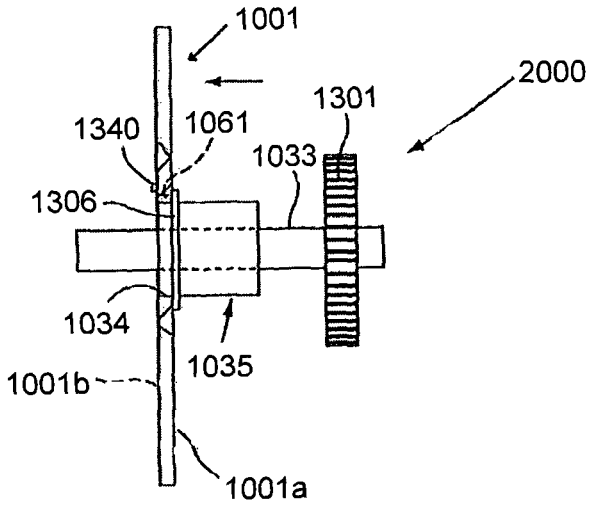
FIG. 56B is a side view illustrating an assembled state.

With this configuration, as illustrated in FIG. 56B, the restrictor 1306 of the bearing 1035 is inserted in the through hole 1034 from a surface 1001*a* on one side of the frame 1001 and is then rotated. Accordingly, the hook 1340 passes through the opening 1061 from the surface 1001*a* to a surface 1001*b* on the other side of the frame 1001, and the hook 1340 is engaged with and attached to the other surface 1001*b* of the frame 1001, so that the hooked state is maintained. Therefore, it is possible to ensure the attached state of the frame 1001 and the bearing 1035.

While the preferred embodiments of the present invention are described above, the present invention is not limited to the specific embodiments. Various modifications and changes are possible within the scope of the appended claims unless otherwise specified.

The advantageous effects described in the embodiments are the preferable effects that may be obtained by the present invention, and are not limited to those described herein.

According to an embodiment of the present invention, it is possible to reduce the frequency that powder is compressed and cohered, so that it is possible to prevent the powder from precluding movement of the opening/closing member, which opens and closes an opening of a nozzle receiver of a powder container, to a closing position.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The present invention further includes the following aspects.

Aspect A

A nozzle insertion member to be arranged in a powder container used in an image forming apparatus, the nozzle insertion member comprising:

a nozzle insertion opening, in and from which a conveying nozzle for conveying powder supplied from the powder container is inserted and removed in the image forming apparatus;

an opening/closing member to move to an opening position to open the nozzle insertion opening by being pressed with insertion of the conveying nozzle, and to move to a closing position to close the nozzle insertion opening with removal of the conveying nozzle;

a supporter to support the opening/closing member to guide movement of the opening/closing member to the opening position and the closing position; and a biasing member that is on the supporter to bias the opening/closing member to the closing position, wherein the opening/closing member includes a sealing portion to seal the nozzle insertion opening, the supporter includes an end surface portion perpendicular to a moving direction of the opening/closing member, and a projection area of the end surface portion in the moving direction of the opening/closing member is smaller than a projection area of the sealing portion in the moving direction of the opening/closing member.

Aspect B

A nozzle receiver to be arranged in a powder container used in an image forming apparatus, the nozzle receiver comprising:

a nozzle receiving opening, in which a conveying nozzle for conveying powder supplied from the powder container is inserted in the image forming apparatus;

an opening/closing member to open and to close the nozzle receiving opening; and a supporter to support the opening/closing member; wherein the opening/closing member includes a sealing portion to seal the nozzle insertion opening, the supporter includes an end surface portion perpendicular to a moving direction of the opening/closing member, and an area of the end surface portion is smaller than an area of the sealing portion in a direction perpendicular to the moving direction of the opening/closing member.

Aspect C

A nozzle receiver to be arranged in a powder container used in an image forming apparatus, the nozzle receiver comprising:

a nozzle receiving opening, in which a conveying nozzle for conveying powder supplied from the powder container is inserted in the image forming apparatus;

an opening/closing member to open and to close the nozzle receiving opening; and a supporter to support the opening/closing member; wherein the opening/closing member includes a sealing portion to seal the nozzle insertion opening, the supporter includes an end surface portion perpendicular to a moving direction of the opening/closing member, and the sealing portion includes an area which overlaps with the end surface portion in the moving direction and the other area which does not overlap with the end surface portion in the moving direction.

Aspect D

A powder container to be attached to an image forming apparatus, the powder container comprising:

a powder storage to contain powder;

a holder attached to the powder storage;

a protrusion that is on one of the powder storage and the holder; and a restrictor that is on the other one of the powder storage and the holder and is to restrict the movement of the protrusion in a longitudinal direction of the powder storage, wherein the powder storage is to rotate relative to the holder, the restrictor includes an opening through which the protrusion passes when the holder is attached to the powder storage, and relations of $d \leq t$ and $a < e$ are satisfied, where t is an interval of the opening between the opening inclined portion and an opposite surface facing the opening inclined portion, a is a length of a first port of the opening in the rotation direction, the first port being located on a downstream side in a direction in which the protrusion passes through the opening when the holder is attached to the powder storage;

d is a thickness of the protrusion in an attachment/detachment direction in which the powder container is attached to and detached from the powder replenishing device, and e is a length of a first surface of the protrusion in the rotation direction, the first surface being a surface that faces the first port after the protrusion passes through the opening.

Aspect E

The powder container according to Aspect D, wherein a relation of $c < b$ is satisfied, where b is a length of a second port of the opening in the rotation direction, the second port being located on an upstream side in the direction in which the protrusion passes through the opening when the holder is attached to the powder storage, and c is a length of a second surface of the protrusion in the rotation direction, the second surface being a surface opposite to the first surface of the protrusion.

Aspect F

The powder container according to Aspect D, wherein the opening includes, on the second port side, a guiding portion that is recessed in a detachment direction in which the powder container is detached from the powder replenishing device or inclined in the detachment direction, and a relation of $c < b$ is satisfied, where b is a length of the second port of the opening including the guiding portion in the rotation direction, and c is a length of a second surface of the protrusion in the rotation direction, the second surface being a surface opposite to the first surface of the protrusion.

Aspect G

A supporting device comprising:

a first member that includes a through hole;

a second member that is detachably attached to the through hole;

a protrusion that is on one of the first member and the second member; and a restrictor that is on the other one of the first member and the second member and on which the protrusion is hooked, wherein the first member and the second member are rotatable relative to each other, the restrictor extends in a rotation direction and includes an opening through which the protrusion passes in a direction perpendicular to the rotation direction.

Aspect A1

A nozzle receiver for use in a powder container used in an image forming apparatus, the nozzle receiver comprising:

a nozzle receiving opening, in which a conveying nozzle for conveying powder supplied from the powder container is inserted in the image forming apparatus;

a shutter to open and or to close the nozzle receiving opening; and a support to support the shutter, wherein the shutter includes a sealing portion to seal the nozzle receiving opening, the sealing portion having an outer surface which is perpendicular to a moving direction of the shutter, the support includes an end surface portion perpendicular to a moving direction of the shutter, and an area of the end surface portion of the support is smaller than the outer surface receiving of the shutter.

Aspect A2

The nozzle receiver according to Aspect A1, further comprising a biasing member that is on the support to bias the shutter to a closing position, wherein the shutter moves to an opening position to open the nozzle receiving opening by being pressed with insertion of the conveying nozzle.

Aspect A3

The nozzle receiver according to Aspect A1, wherein the shutter includes an elongated portion extending toward the end surface portion of the support, and the end surface portion includes a through hole into which the elongated portion is inserted and a tapered surface at the through hole.

Aspect A4

The nozzle receiver according to Aspect A2, wherein the support includes a protrusion that protrudes from the end surface portion.

Aspect A5

The nozzle receiver according to Aspect A4, wherein the protrusion protrudes from the end surface portion in an opening direction of the shutter.

Aspect A6

The nozzle insertion member according to Aspect A4, wherein the shutter includes a hook to be hooked on the end surface portion, and the protrusion protrudes more than the hook in the opening direction of the shutter.

Aspect A7

The nozzle receiver according to any one of Aspects A1 to A6, wherein, a relation of $1 < L1/L2 \leq 2$ is satisfied, where L1 is a distance between the end surface portion and a rear end surface, which faces to the end surface portion, of the sealing portion when the shutter is at a closing position to close the nozzle receiving opening, and L2 is a distance between the end surface portion and the rear end surface of the sealing portion when the shutter is at an opening position to open the nozzle receiving opening.

Aspect A8

A powder container comprising the nozzle receiver according to any one of Aspects A1 to A7.

Aspect A9

The powder container according to Aspect A8, further comprising a portion to contain powder, wherein the powder includes toner.

Aspect B1

A nozzle receiver to be arranged in a powder container used in an image forming apparatus, the nozzle receiver comprising:

a nozzle receiving opening, in which a conveying nozzle for conveying powder supplied from the powder container is inserted in the image forming apparatus;

an opening/closing member to open and to close the nozzle receiving opening; and a supporter to support the opening/closing member, wherein the opening/closing member includes a sealing portion to seal the nozzle insertion opening, the supporter includes an end surface portion perpendicular to a moving direction of the opening/closing member, and a projection area of the end surface portion in the moving direction of the opening/closing member is smaller than a projection area of the sealing portion in the moving direction of the opening/closing member.

Aspect B2

The nozzle receiver according to Aspect B1, further comprising a biasing member that is on the supporter to bias the opening/closing member to a closing position, wherein the opening/closing member moves to an opening position to open the nozzle receiving opening by being pressed with insertion of the conveying nozzle.

Aspect B3

The nozzle receiver according to Aspect B1 or B2, wherein the opening/closing member includes an elongated portion extending toward the end surface portion of the supporter, and the end surface portion includes a through hole into which the elongated portion is inserted and a tapered surface at the through hole.

Aspect B4

The nozzle receiver according to any one of Aspects B1 to B3, wherein the supporter includes a protrusion that protrudes from the end surface portion.

Aspect B5

The nozzle receiver according to Aspect claim B4, wherein the protrusion protrudes from the end surface portion in an opening direction of the opening/closing member.

Aspect B6

The nozzle receiver according to Aspect B4 or B5, wherein the opening/closing member includes a hook to be hooked on the end surface portion, and the protrusion protrudes more than the hook in the opening direction of the opening/closing member.

Aspect B7

The nozzle receiver according to any one of Aspects B1 to B6, wherein, a relation of $1<L1/L2\leq 2$ is satisfied, where L1 is a distance between the end surface portion and a rear end surface, which faces to the end surface portion, of the sealing portion when the opening/closing member is at a closing position to close the nozzle receiving opening, and L2 is a distance between the end surface portion and the rear end surface of the sealing portion when the opening/closing member is at an opening position to open the nozzle receiving opening.

Aspect B8

A powder container comprising the nozzle receiver according to any one of Aspects B1 to B7.

Aspect B9

The powder container according to Aspect B8, further comprising a portion to contain powder, wherein the powder includes toner.

Aspect B10

The powder container according to Aspect B9, wherein the powder includes carrier particles.

Aspect B11

An image forming apparatus comprising the powder container according to any one of Aspects B8 to B10.

Aspect B12

A powder container to be attached to an image forming apparatus, the powder container comprising:

a powder storage to contain powder;

a holder attached to the powder storage;

a protrusion that is on one of the powder storage and the holder; and a restrictor that is on the other one of the powder storage and the holder and is to restrict the movement of the protrusion in a longitudinal direction of the powder storage, wherein the powder storage is to rotate relative to the holder, and the restrictor includes an opening through which the protrusion passes when the holder is attached to the powder storage.

Aspect B13

The powder container according to Aspect B12, wherein the protrusion includes an inclined portion that is inclined in the rotation direction, the opening includes an opening inclined portion that is inclined in the same direction as the inclined portion of the protrusion, and when the inclined portion of the protrusion comes in contact with the opening inclined portion, the protrusion passes through the opening.

Aspect B14

The powder container according to Aspect B12 or B13, wherein the powder storage includes a removable container-side gear to which a drive force is transmitted, and the protrusion is on the gear.

Aspect B15

The powder container according to Aspect B14, wherein the powder storage includes powder, and the powder includes toner.

Aspect B16

The powder container according to Aspect B15, wherein the powder includes carrier particles.

Aspect B17

An image forming apparatus comprising the powder container according to any one of Aspects B12 to B16.

REFERENCE SIGNS LIST

32 (Y, M, C, K) TONER CONTAINER (POWDER CONTAINER)

33 CONTAINER BODY (POWDER STORAGE)

33*a* OPENING (CONTAINER OPENING)

33*b* OUTER SURFACE OF CONTAINER OPENING
33*c* FRONT END OF CONTAINER OPENING
34 CONTAINER FRONT END COVER
34*a* GEAR EXPOSING OPENING
34*b* OUTER SURFACE OF CONTAINER COVER
34*d* HOLE (THROUGH HOLE)
41 (Y, M, C, K) PHOTOCONDUCTOR (IMAGE BEARER)
42 (Y, M, C, K) CLEANING DEVICE (PHOTOCONDUCTOR CLEANING DEVICE)
42*a* CLEANING BLADE
44 (Y, M, C, K) CHARGING ROLLER (CHARGING DEVICE)
46 (Y, M, C, K) IMAGE FORMING SECTION (IMAGE FORMING UNIT)
47 EXPOSING DEVICE
48 INTERMEDIATE TRANSFER BELT
49 (Y, M, C, K) PRIMARY-TRANSFER BIAS ROLLER
50 DEVELOPING DEVICE
51 (Y, M, C, K) DEVELOPING ROLLER (DEVELOPER BEARER)
52 (Y, M, C, K) DOCTOR BLADE (DEVELOPER REGULATING PLATE)
53 (Y, M, C, K) FIRST DEVELOPER ACCOMMODATING SECTION
54 (Y, M, C, K) SECOND DEVELOPER ACCOMMODATING SECTION
55 (Y, M, C, K) DEVELOPER CONVEYING SCREW
56 (Y, M, C, K) TONER DENSITY SENSOR
60 (Y, M, C, K) TONER REPLENISHING DEVICE (POWDER REPLENISHING DEVICE)
64 (Y, M, C, K) TONER DROPPING PASSAGE
70, 2070 TONER CONTAINER HOLDER (CONTAINER HOLDING SECTION)
71*b* INSERTION HOLE BASE
85 INTERMEDIATE TRANSFER DEVICE
86 FIXING DEVICE
89 SECONDARY-TRANSFER ROLLER
100 PRINTER (COPIER MAIN BODY, IMAGE FORMING APPARATUS MAIN BODY)
200 SHEET FEEDER (SHEET FEED TABLE)
301 CONTAINER GEAR (CONTAINER-SIDE GEAR)
302 SPIRAL RIB (ROTARY CONVEYOR)
303 GRIPPER
304 SCOOPING PORTION
305 FRONT END OPENING
306 COVER HOOK STOPPER (RESTRICTOR)
330, 330' NOZZLE RECEIVER (NOZZLE INSERTION MEMBER)
331 RECEIVING OPENING (NOZZLE INSERTION OPENING)
332 CONTAINER SHUTTER (OPENING/CLOSING MEMBER)
332*a* SHUTTER HOOK
332*c* FRONT CYLINDRICAL PORTION (CLOSURE)
332*d* SLIDE AREA (GLIDING PORTION, SEALING PORTION)
332*da* REAR END SURFACE OF SLIDE AREA (REAR END SURFACE OF GLIDING PORTION, EDGE OF SEALING PORTION)
332*e* GUIDING ROD (ELONGATED PORTION)
333 CONTAINER SEAL (SEAL)
333*a* INNER SURFACE OF NOZZLE INSERTION OPENING
334, 334' CONTAINER SHUTTER SUPPORTER (SUPPORTER)
335, 335' SHUTTER REAR END SUPPORTING PORTION (SHUTTER REAR PORTION)
335*a*, 335*a* SHUTTER SIDE SUPPORTING PORTION (SIDE PORTION)
335*b* OPENING OF SHUTTER SUPPORTING PORTION (SHUTTER SIDE OPENING)
335*c* END SURFACE PORTION OF SUPPORTER
335*ca* INNER WALL SURFACE
355*cc* PROTRUSION
335*d* REAR END OPENING (THROUGH HOLE)
335*da* TAPERED SURFACE
336 CONTAINER SHUTTER SPRING (BIASING MEMBER)
339 CONTAINER ENGAGING PORTION
339*a* GUIDING PROTRUSION
339*b* GUIDING GROOVE
339*c* BUMP
339*d* ENGAGING OPENING (AXIAL RESTRICTOR)
340, 3401 to 3404 COVER HOOK (PROTRUSION)
340*b*, 3401*b*, 3402*b*, 3403*b*, 3404*b* BOTTOM SURFACE OF COVER HOOK (SECOND SURFACE OF PROTRUSION)
340*c*, 3401*c*, 3402*c*, 3403*c*, 3404*c* UPPER SURFACE OF COVER HOOK (FIRST SURFACE OF PROTRUSION)
400 SCANNER (SCANNER SECTION)
500 COPIER (IMAGE FORMING APPARATUS)
601 CONTAINER DRIVING GEAR (APPARATUS MAIN-BODY GEAR)
610 NOZZLE HOLE (POWDER RECEIVING HOLE)
611 CONVEYING NOZZLE
611*a* FRONT END (END SURFACE) of CONVEYING NOZZLE
612 NOZZLE SHUTTER (NOZZLE OPENING/CLOSING MEMBER)
613 NOZZLE SHUTTER SPRING (BIASING MEMBER)
614 CONVEYING SCREW (MAIN BODY CONVEYOR)
615 CONTAINER SETTING SECTION (CONTAINER RECEIVING SECTION)
615*a* INNER SURFACE OF CONTAINER SETTING SECTION
615*c* SPRING SECURING SECTION
1001 FIRST MEMBER
1034 THROUGH HOLE
1035 SECOND MEMBER
1061 OPENING
1306 HOOK
1340 PROTRUSION
2000 SUPPORTING DEVICE
3061 to 3064 OPENING (NOTCH, CUTOUT)
3061*a*, 3062*a*, 3063*a*, 3064*a* OPENING INCLINED PORTION
3061*b*, 3062*b*, 3063*b*, 3064*b* OPPOSITE SURFACE FACING OPENING INCLINED PORTION
3061*c*, 3062*c*, 3063*c*, 3064*c* FIRST PORT OF OPENING (OUTLET PORT, DOWNSTREAM END PORT, OUTLET, OR FIRST PORTION OF OPENING)
3061*d*, 3062*d*, 3063*d*, 3064*d* SECOND PORT OF OPENING (INLET PORT, UPPERSTREAM END PORT, INLET, OR SECOND PORTION OF OPENING)
3401*a* to 3404*a* INCLINED PORTION OF PROTRUSION
4063, 4064 GUIDING PORTION (CONCAVE PORTION, DEPRESSED PORTION, RECESS)

G DEVELOPER
Q ATTACHMENT DIRECTION
Q1 DETACHMENT DIRECTION

The invention claimed is:

1. A nozzle receiver for use in a powder container used in an image forming apparatus, the nozzle receiver comprising:
a nozzle receiving opening, in which a conveying nozzle for conveying powder supplied from the powder container is inserted in the image forming apparatus;
a shutter to open and to close the nozzle receiving opening, the shutter including a moving direction; and
a support to support the shutter, wherein
the shutter includes a sealing portion to seal the nozzle receiving opening, the sealing portion having an outer surface which is perpendicular to the moving direction of the shutter,
the support includes an end surface portion perpendicular to the moving direction of the shutter,
an area of the end surface portion of the support is smaller than an area of the outer surface of the shutter, and
a relation of $1<L1/L2\leq 2$ is satisfied,
where L1 is a distance between the end surface portion and a rear end surface, which faces to the end surface portion, of the sealing portion when the shutter is at a closing position to close the nozzle receiving opening, and L2 is a distance between the end surface portion and the rear end surface of the sealing portion when the shutter is at an opening position to open the nozzle receiving opening.

2. The nozzle receiver according to claim 1, further comprising a biasing member that is on the support to bias the shutter to a closing position, wherein
the shutter moves to an opening position to open the nozzle receiving opening by being pressed with insertion of the conveying nozzle.

3. The nozzle receiver according to claim 1, wherein
the shutter includes an elongated portion extending toward the end surface portion of the support, and
the end surface portion includes a through hole into which the elongated portion is inserted and a tapered surface at the through hole.

4. The nozzle receiver according to claim 1, wherein the support includes a protrusion that protrudes from the end surface portion.

5. The nozzle receiver according to claim 4, wherein the protrusion protrudes from the end surface portion in an opening direction of the shutter.

6. The nozzle receiver according to claim 4, wherein
the shutter includes a hook to be hooked on the end surface portion, and
the protrusion protrudes more than the hook in the opening direction of the shutter.

7. A powder container for use in an image forming apparatus, the powder container comprising:
a powder storage to contain powder; and
a nozzle receiver attached to the powder storage, wherein
the nozzle receiver includes:
a nozzle receiving opening, in which a conveying nozzle for conveying powder supplied from the powder container is inserted in the image forming apparatus;
a shutter to open and to close the nozzle receiving opening, the shutter including a moving direction; and
a support to support the shutter;
the shutter includes a sealing portion to seal the nozzle receiving opening, the sealing portion having an outer surface which is perpendicular to the moving direction of the shutter,
the support includes an end surface portion perpendicular to the moving direction of the shutter,
an area of the end surface portion of the support is smaller than an area of the outer surface of the shutter, and
a relation of $1<L1/L2<2$ is satisfied,
where L1 is a distance between the end surface portion and a rear end surface, which faces to the end surface portion, of the sealing portion when the shutter is at a closing position to close the nozzle receiving opening, and L2 is a distance between the end surface portion and the rear end surface of the sealing portion when the shutter is at an opening position to open the nozzle receiving opening.

8. The powder container according to claim 7, further comprising:
a holder attached to the powder storage;
a protrusion that is on one of the powder storage and the holder; and
a restrictor that is on the other one of the powder storage and the holder and is to restrict the movement of the protrusion in a longitudinal direction of the powder storage, wherein
the powder storage is to rotate relative to the holder, and
the restrictor includes an opening through which the protrusion passes when the holder is attached to the powder storage.

9. The powder container according to claim 8, wherein
the protrusion includes an inclined portion that is inclined in a rotation direction of the powder storage,
the nozzle receiving opening includes an opening inclined portion that is inclined in the same direction as the inclined portion of the protrusion, and
when the inclined portion of the protrusion comes in contact with the opening inclined portion, the protrusion passes through the opening.

10. The powder container according to claim 8, wherein
the powder storage includes a removable container-side gear to which a drive force is transmitted, and
the protrusion is on the gear.

11. The powder container according to claim 7, wherein
the powder storage includes powder, and
the powder includes toner.

12. The powder container according to claim 11, wherein the powder includes carrier particles.

13. An image forming apparatus comprising the powder container according to claim 7.

14. The powder container according to claim 9, wherein relations of $d\leq t$ and $a<e$ are satisfied,
where t is an interval of the nozzle receiving opening between the nozzle receiving opening inclined portion and an opposite surface facing the nozzle receiving opening inclined portion,
a is a length of a first port of the nozzle receiving opening in the rotation direction, the first port being located on a downstream side in a direction in which the protrusion passes through the nozzle receiving opening when the holder is attached to the powder storage;
d is a thickness of the protrusion in an attachment/detachment direction in which the powder container is attached to and detached from the image forming apparatus, and
e is a length of a first surface of the protrusion in the rotation direction, the first surface being a surface that faces the first port after the protrusion passes through the nozzle receiving opening.

15. The powder container according claim 14, wherein a relation of $c<b$ is satisfied, where b is a length of a second port of the nozzle receiving opening in the rotation direction, the second port being located on an upstream side in the direction in which the protrusion passes through the nozzle receiving opening when the holder is attached to the powder storage, and c is a length of a second surface of the protrusion in the rotation direction, the second surface being a surface opposite to the first surface of the protrusion.

16. The powder container according claim 9, wherein the nozzle receiving opening includes, on a second port side, a guiding portion that is recessed in a detachment direction in which the powder container is detached from the image forming apparatus or inclined in the detachment direction, and a relation of $c<b$ is satisfied, where b is a length of the second port of the nozzle receiving opening including the guiding portion in the rotation direction, and c is a length of a second surface of the protrusion in the rotation direction, the second surface being a surface opposite to a first surface of the protrusion.

* * * * *